US010149577B2

(12) United States Patent
Lopez

(10) Patent No.: US 10,149,577 B2
(45) Date of Patent: Dec. 11, 2018

(54) MOTORIZED BODY CLEANSING APPARATUS

(71) Applicant: Kenneth Oscar Lopez, Park Forest, IL (US)

(72) Inventor: Kenneth Oscar Lopez, Park Forest, IL (US)

( * ) Notice: Subject to any disclaimer, the term of this patent is extended or adjusted under 35 U.S.C. 154(b) by 258 days.

(21) Appl. No.: 15/273,700

(22) Filed: Sep. 22, 2016

(65) Prior Publication Data

US 2017/0007078 A1 Jan. 12, 2017

Related U.S. Application Data

(63) Continuation-in-part of application No. 13/536,937, filed on Jun. 28, 2012, now Pat. No. 9,474,359.

(60) Provisional application No. 61/501,897, filed on Jun. 28, 2011.

(51) Int. Cl.

| | |
|---|---|
| ***A46B 11/02*** | (2006.01) |
| ***A47K 7/02*** | (2006.01) |
| ***A46B 5/04*** | (2006.01) |
| ***A47K 7/04*** | (2006.01) |
| ***A46B 9/02*** | (2006.01) |
| ***A46D 1/00*** | (2006.01) |
| *A46B 11/00* | (2006.01) |

(52) U.S. Cl.

CPC ..... *A47K 7/02* (2013.01); *A46B 5/04* (2013.01); *A46B 9/026* (2013.01); *A46D 1/0253* (2013.01); *A46D 1/0292* (2013.01); *A47K 7/04* (2013.01); *A46B 11/002* (2013.01); *A46B 2200/102* (2013.01)

(58) Field of Classification Search

CPC .. A46B 9/026; A46B 2200/10; A46D 1/0253; A47K 7/00

See application file for complete search history.

(56) References Cited

U.S. PATENT DOCUMENTS 4,462,413 A * 7/1984 Schmitz ..... A45D 19/02 132/113
4,958,596 A * 9/1990 Belan ..... A01K 13/001 119/603

(Continued)

FOREIGN PATENT DOCUMENTS

WO WO 2010034802 A1 * 4/2010 ..... A61H 7/003

*Primary Examiner* — Michael Jennings

(74) *Attorney, Agent, or Firm* — Ashok Tankha; Lipton, Weinberger & Husick

(57) ABSTRACT

A motorized body cleansing apparatus includes a base plate detachably attachable to a support structure, rollers, a guide slide plate (GSP), a split cover plate, a motion transmission assembly, and a base member. The base plate includes guideways positioned on a front surface of the base plate for accommodating the rollers. Elongate guide projections extend from a rear surface of the GSP and slide on the rollers at the front surface of the base plate. The split cover plate secures the GSP to the base plate. The motion transmission assembly is positioned in a cavity of the base plate and is operably coupled to the GSP for moving the GSP upwards and downwards. The base member is detachably attached to a front surface of the GSP. The base member includes one or more cleansing members for cleansing a user's body part during the movement of the GSP upwards and downwards.

15 Claims, 67 Drawing Sheets

(56) References Cited

U.S. PATENT DOCUMENTS

| | | | | |
|---|---|---|---|---|
| 5,311,887 | A * | 5/1994 | Ramsey | A45D 24/22 132/112 |
| 6,457,476 | B1 * | 10/2002 | Elmer | A45D 19/02 132/114 |
| 6,539,949 | B2 * | 4/2003 | Christensen | A45D 19/02 132/112 |
| 6,962,158 | B1 * | 11/2005 | Anguelo | A45D 24/22 132/113 |
| 7,153,282 | B1 * | 12/2006 | Dudley | A61H 7/004 601/93 |
| 2005/0138745 | A1 * | 6/2005 | Huang | A46B 3/22 15/187 |
| 2005/0257800 | A1 * | 11/2005 | Inoue | A45D 24/26 132/114 |
| 2008/0245380 | A1 * | 10/2008 | Ecker | A01K 13/002 132/114 |
| 2009/0019719 | A1 * | 1/2009 | Yde | A45D 1/00 34/96 |
| 2010/0237104 | A1 * | 9/2010 | Schneider | B05C 17/00516 222/330 |
| 2012/0118311 | A1 * | 5/2012 | Rose | A45D 24/04 132/114 |

* cited by examiner

MOTORIZED BODY CLEANSING APPARATUS

CROSS-REFERENCE TO RELATED APPLICATIONS

This application is a continuation-in-part application of non-provisional patent application Ser. No. 13/536,937 (now U.S. Pat. No. 9,474,359) titled "Body Cleansing Apparatus", filed in the United States Patent and Trademark Office on Jun. 28, 2012, which claims priority to and the benefit of provisional patent application No. 61/501,897 titled "Cleansing Kit", filed in the United States Patent and Trademark Office on Jun. 28, 2011. The specifications of the above referenced patent applications are incorporated herein by reference in their entirety.

BACKGROUND

The apparatus disclosed herein, in general, relates to a cleansing apparatus. More particularly, the apparatus disclosed herein relates to a body cleansing apparatus comprising multiple different types of cleansing members positioned on the body cleansing apparatus for cleansing a user's body.

Commercially available cleansing apparatuses typically include handheld brushes that can be used to cleanse a user's back. However, a user may not be able to easily access all areas of the user's back for cleansing using these handheld brushes. Conventional handheld back brushes that have fixed and detachable handles typically require a fair amount of physical flexibility and coordination on the part of the user for their effective use. Users with stiff necks, stiff backs, arthritis, etc., typically find it difficult to use these handheld back brushes for cleansing body parts that are difficult to access, for example, their backs.

Moreover, bristles provided on conventional brushing devices have a linear design. These linear bristle structures do not sufficiently collect, contain, retain, and dispense a cleansing agent used for cleansing, resulting in wastage of the cleansing agent. Linear bristles also accumulate dead skin cells, which in turn can result in breeding conditions for microbes. The design of linear bristles may also damage sensitive skin if a user scrubs his/her skin rigorously with minimal lubrication provided by a dispensed cleansing agent. An insufficient cleansing agent being dispensed on the linear bristles during cleansing can cause abrasions and cuts in sensitive skin.

Furthermore, a conventional cleansing apparatus that is fixed to a bathroom wall is stationary and requires a user to move physically in an upward direction and a downward direction to produce a scrubbing action and cleanse the user's body. The user will have to physically change his/her position frequently to establish contact with the cleansing apparatus to cleanse the user's body part. This strenuous physical movement requires additional effort from the user, thereby causing fatigue while performing daily cleansing of the user's body. Some users, for example, elderly persons may find it difficult to use a stationary cleansing apparatus for performing a daily cleansing activity. Furthermore, a conventional cleansing apparatus that is rigidly fixed to a bathroom wall is difficult to maintain. Furthermore, in a household, there may be a large number of users with different physical attributes, for example, different heights. Conventional back cleansing apparatuses that are typically fixed to bathroom walls may not be positioned to suit each user's height, thereby making it difficult for different users having different heights to use the same back cleansing apparatus.

Hence, there is a long felt need for a body cleansing apparatus that is accessible to all areas of the user's back or other body parts, without requiring any effort from the user for cleansing such body parts. Moreover, there is a need for a motorized body cleansing apparatus that moves in an upward direction and a downward direction automatically to produce an automated scrubbing action on a user's back or other body parts. Furthermore, there is a need for a body cleansing apparatus comprising bristle structures and other sponge based cleansing members that sufficiently collect, contain, retain, and dispense a cleansing agent for allowing the user to simultaneously brush and cleanse the user's body parts. Furthermore, there is a need for a position adjustable body cleansing apparatus that allows users of different heights to use the body cleansing apparatus without manually removing and fixing the body cleansing apparatus to a support structure to suit each user's height each time. Furthermore, there is a need for a body cleansing apparatus that can be detachably attached to a support structure, for example, a bathroom wall for convenient removal and maintenance of the body cleansing apparatus.

SUMMARY OF THE INVENTION

This summary is provided to introduce a selection of concepts in a simplified form that are further disclosed in the detailed description of the invention. This summary is not intended to determine the scope of the claimed subject matter.

The apparatus disclosed herein addresses the above recited needs for a detachable and washable body cleansing apparatus that is accessible to all areas of a user's back or other body parts, without requiring any effort from the user for cleansing such body parts. The body cleansing apparatus configured for cleansing the user's rear body part is detachably attachable to a support structure, for example, a wall by one or more fasteners, for example, hook and loop fasteners, suction cups, etc. The apparatus disclosed herein also addresses the above recited need for a motorized body cleansing apparatus that moves in an upward direction and a downward direction automatically to produce an automated scrubbing action on a user's back or other body parts. The motorized body cleansing apparatus comprises a base plate, multiple rollers, a guide slide plate, a split cover plate, a motion transmission assembly, and a base member. The base plate comprises a front surface and a rear surface. The rear surface of the base plate is detachably attached to a support structure using fasteners. The base plate comprises guideways positioned on the front surface of the base plate. The base plate further comprises a cavity configured between the guideways on the front surface of the base plate. The rollers are positioned in the guideways of the base plate. The rollers roll within the guideways of the base plate. The guide slide plate is positioned on the rollers at the front surface of the base plate. The guide slide plate comprises elongate guide projections extending from a rear surface of the guide slide plate. The elongate guide projections of the guide slide plate slide on the rollers at the front surface of the base plate.

The split cover plate of the motorized body cleansing apparatus is positioned between the base plate and the guide slide plate. The split cover plate comprises a securing element and a cap element. The securing element is fixedly attached to a body section of the base plate. The securing element comprises multiple vertical slots configured to accommodate the elongate guide projections of the guide slide plate. The cap element is fixedly attached to an upper section of the base plate. The cap element secures the guide slide plate to the base plate to preclude the guide slide plate from sliding out of the base plate. The motion transmission assembly is positioned in the cavity of the base plate and is operably coupled to the guide slide plate. The motion transmission assembly moves the guide slide plate in an upward direction and a downward direction over the rollers. The base member is detachably attached to a front surface of the guide slide plate using fasteners. The base member comprises one or more contoured profiles configured to conform to a user's body part. In an embodiment, the base member is configured to conform to a rear body part of the user, that is, the user's back, neck, shoulders, etc., for cleansing the user's rear body part. The base member further comprises one or more cleansing members attached to a front surface of the base member for cleansing the body part when the body part contacts and applies a pressure on the cleansing members, while the motion transmission assembly moves the guide slide plate with the detachably attached base member in the upward direction and the downward direction.

The body cleansing apparatus disclosed herein also addresses the above recited need for cleansing members comprising bristle structures and other sponge based cleansing members that sufficiently collect, contain, retain, and dispense a cleansing agent for allowing the user to simultaneously brush and cleanse the user's body parts. The cleansing members are positioned and attached at multiple locations on one or more of the contoured profiles of the base member. In an embodiment, one or more of the cleansing members are detachably attachable to one or more of multiple locations on one or more of the contoured profiles of the base member for allowing the user to flexibly configure the cleansing members on the base member for cleansing the user's body part.

In an embodiment, one or more of the cleansing members comprise a stem and a cluster of flexible bristles. The stem of each cleansing member is attached to and extends outwardly from a front surface of the base member. The flexible bristles in each cluster curvedly branch outwards from an upper end of the stem and define a reservoir within each cluster. The reservoir stores and retains a cleansing agent and releases the cleansing agent along the flexible bristles when the user's body part contacts and applies a pressure, for example, on the stem of each cleansing member. Each cluster of flexible bristles comprises a central flexible bristle extending from the upper end of the stem, and radial flexible bristles surrounding the central flexible bristle. In an embodiment, one or more of the flexible bristles in the cluster comprise one or more apertures positioned on a body of each of the flexible bristles. The apertures dispense the cleansing agent contained within the stem. In an embodiment, one or more of the flexible bristles in the cluster comprise a spoon section that defines the reservoir. The spoon section collects and retains the cleansing agent for cleansing the user's body part.

In another embodiment, one or more of the cleansing members comprise one or more generally concave troughs positioned at a base of each of the flexible bristles in the cluster where each of the flexible bristles meets the stem of the corresponding cleansing member. The generally concave troughs are configured to contain the cleansing agent. In another embodiment, one or more of the flexible bristles in the cluster are configured in a wide generally concave configuration that defines the reservoir. The flexible bristles in the wide generally concave configuration collect and retain the cleansing agent for cleansing the user's body part.

In an embodiment, the base member of the body cleansing apparatus further comprises a bladder for storing and containing the cleansing agent. The stored cleansing agent is drawn from the bladder through the stem of a cleansing member and out through one or more apertures positioned on the body of each of the flexible bristles in the cluster of the cleansing member, when the user's body part contacts and applies a pressure on the stem for dispensing the cleansing agent. The stem of each of the cleansing members comprises a cavity, in fluid communication with the bladder defined within the base member, for extracting the cleansing agent stored in the bladder, and for containing and dispensing the cleansing agent through one or more apertures positioned on the body of each of the flexible bristles in the cluster for cleansing the user's body part, when the user's body part contacts and applies a pressure on the stem.

In an embodiment, one or more of the cleansing members are single elongate flexible bristles attached to and extending outwardly from the base member. In an embodiment, each of the flexible bristles comprises a flexible tip configured to contact and cleanse the user's body part. In another embodiment, the body cleansing apparatus disclosed herein further comprises a spring member operably connected to a lower end of the cleansing members for enabling the flexible movement of each of the cleansing members during cleansing of the body part. The flexible bristles coated with the cleansing agent allow the user to cleanse the body part when the body part contacts and applies a pressure on the flexible bristles.

In another embodiment, the cleansing member of the body cleansing apparatus disclosed herein comprises a retention member and flexible bristles of configurable dimensions. The retention member is, for example, a porous water absorbent body made of a sponge material. The retention member is fixedly attached to a front surface of the base member. The retention member comprises multiple cavities for accommodating multiple flexible bristles. In an embodiment, the cavities of the retention member are configured as holes for draining fluids that pass through the retention member. The retention member retains a cleansing agent dispensed on the retention member. The flexible bristles are fixedly attached to the base member and positioned within the cavities of the retention member. The flexible bristles with the retention member cleanse the user's body part when the body part contacts and applies a pressure on the cleansing member.

In another embodiment, the cleansing members of the body cleansing apparatus disclosed herein are positioned and attached at multiple locations on the contoured profiles of the base member. Each cleansing member comprises a stem, a cluster of flexible bristles, and a retention member. The stem is attached to and extends outwardly from the base member. In an embodiment, the flexible bristles in the cluster curvedly branch outwards from an upper end of the stem. The retention member is detachably attached to one or more of the flexible bristles. The retention member retains a cleansing agent dispensed on the retention member and cleanses the body part, when the body part contacts and applies a pressure on the flexible bristles with the retention member. In another embodiment, the body cleansing apparatus disclosed herein comprises a combination of different types of cleansing members disclosed above positioned on predefined or configurable locations on the base member.

The apparatus disclosed herein also addresses the above recited need for a position adjustable body cleansing apparatus that allows users of different heights to use the body cleansing apparatus without manually removing and fixing the body cleansing apparatus to a support structure, for example, a bathroom wall to suit each user's height each time. Furthermore, the apparatus disclosed herein addresses the above recited need for a body cleansing apparatus that can be detachably attached to a support structure for convenient removal and maintenance of the body cleansing apparatus.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF THE INVENTION

Figure 1:
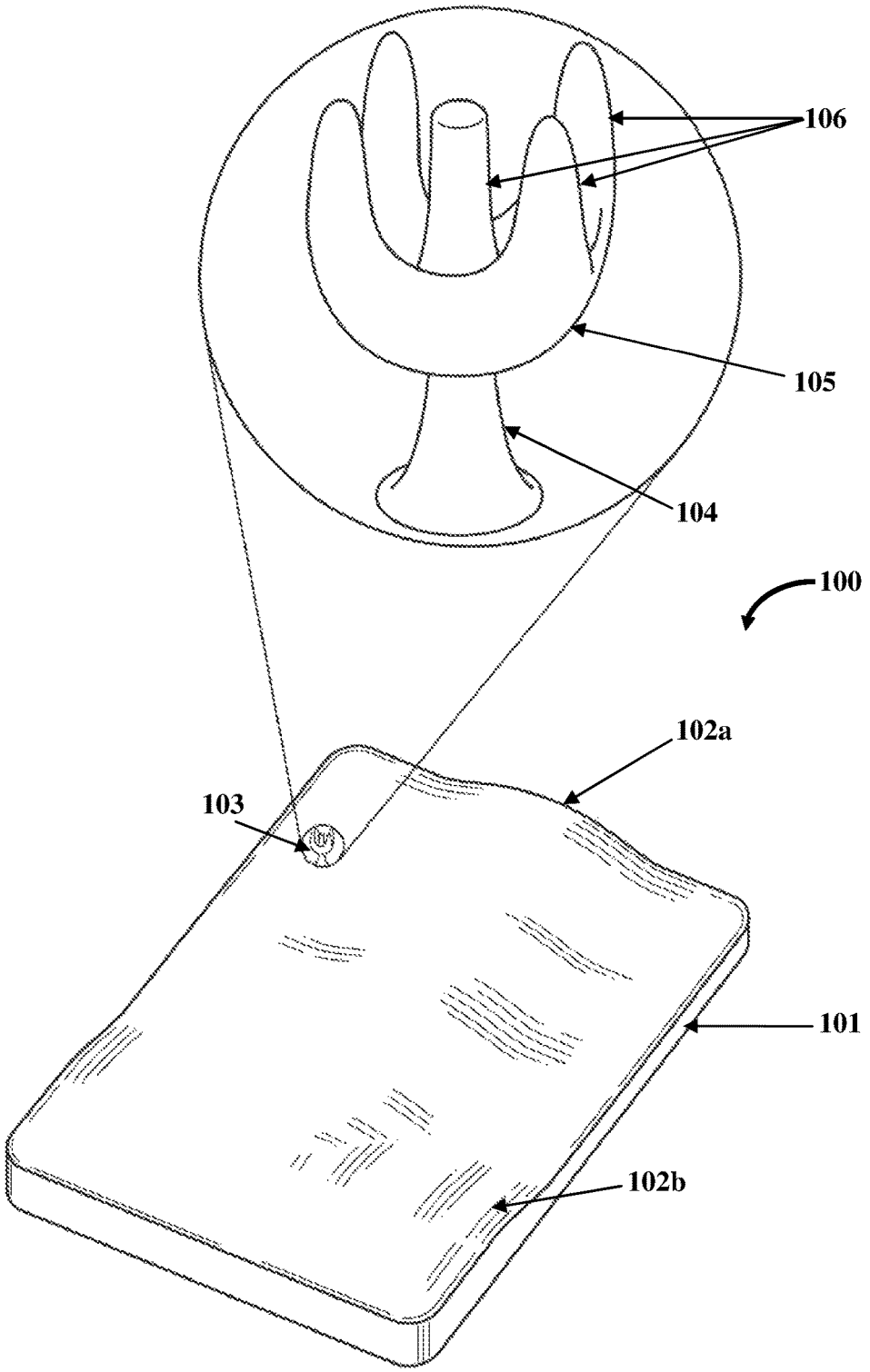
FIG. 1 exemplarily illustrates a front isometric view of a body cleansing apparatus, showing a projected enlarged view of one of multiple cleansing members positioned on a base member of the body cleansing apparatus.

FIG. 1 exemplarily illustrates a front isometric view of a body cleansing apparatus 100, showing a projected enlarged view of one of multiple cleansing members 103 positioned on a base member 101 of the body cleansing apparatus 100. The body cleansing apparatus 100 comprises a base member 101 and multiple cleansing members 103 positioned on the base member 101. The base member 101 comprises one or more contoured profiles 102*a* and 102*b* configured to conform to a user's body part, for example, a user's back, neck, shoulders, etc. As exemplarily illustrated in FIGS. 1-2, FIGS. 4-6, FIG. 17, FIG. 23, and FIGS. 26-28, FIG. 35A, FIG. 39A, FIG. 40, FIG. 42, FIG. 44, FIG. 45A, FIG. 46A, FIG. 48, and FIG. 58, the base member 101 is, for example, of a generally rectangular shape configured to conform to a user's rear body part and used to cleanse rear areas of the user's body, for example, the user's back. The base member 101 is, for example, made of a synthetic material, rubber, etc. In an embodiment, the base member 101 is backed with a foam material. A contoured profile 102*a*, for example, a spongy generally concave shaped hump at the center of the base member 101 is configured to the contour of the user's rear body part, for example, to a posterior curvature of the user's back. In an embodiment, the contoured profiles 102*a* and 102*b* of the base member 101 are customizable to any specific part or curvature of a user's rear body part. The contoured profiles 102*a* and 102*b* of the base member 101 taper downwardly to direct water, a cleansing agent 1001 exemplarily illustrated in FIG. 10A, FIG. 10C, FIG. 11, FIG. 12B, FIG. 13, and FIGS. 15-16, etc., away from the body cleansing apparatus 100 during cleansing. The cleansing members 103 are positioned and attached at multiple locations on one or more of the contoured profiles 102*a* and 102*b* of the base member 101. The structure of a cleansing member 103 comprising a stem 104 and a cluster 105 of flexible bristles 106 is disclosed in the detailed description of FIG. 7.

Figure 2:
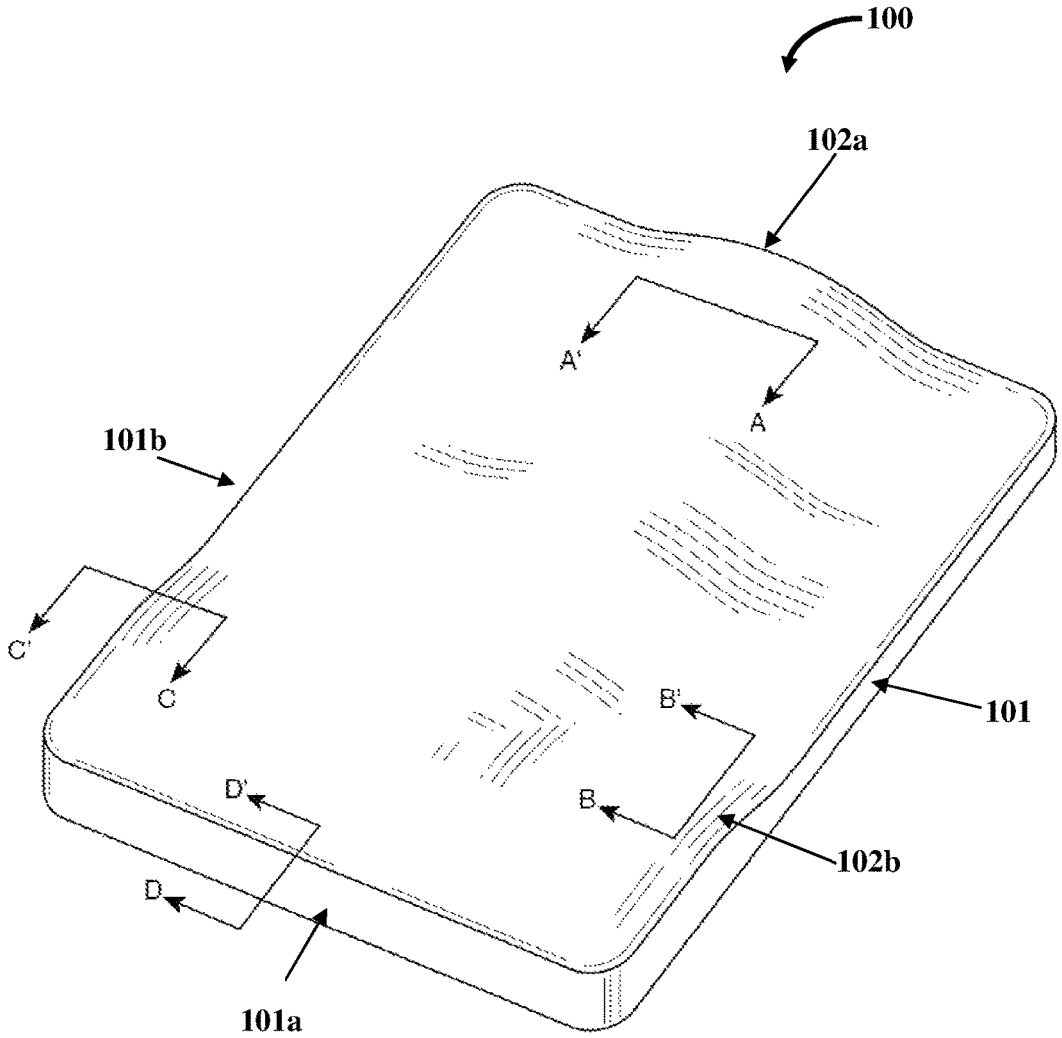
FIG. 2 exemplarily illustrates a front isometric view of the body cleansing apparatus, showing sections taken along multiple contoured profiles of the base member.

FIG. 2 exemplarily illustrates a front isometric view of the body cleansing apparatus 100, showing sections taken along multiple contoured profiles 102*a* and 102*b* of the base member 101. The sections A-A', B-B', C-C', and D-D' of the base member 101 taken along different contoured profiles, for example, 102*a* and 102*b* of the base member 101 are exemplarily illustrated in FIGS. 3A-3D respectively.

Figure 3A:
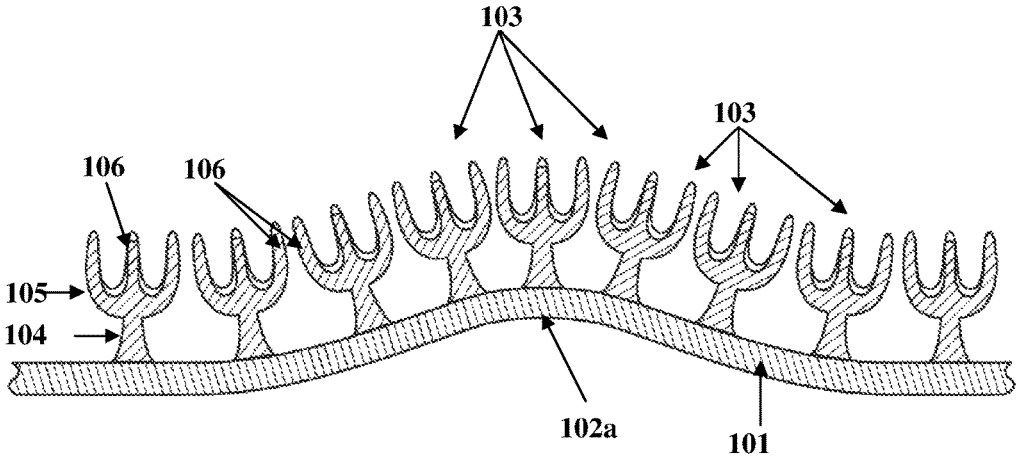
FIG. 3A exemplarily illustrates a sectional view of the body cleansing apparatus taken along a section A-A' of FIG. 2.

FIG. 3A exemplarily illustrates a sectional view of the body cleansing apparatus 100 taken along a section A-A' of FIG. 2. As exemplarily illustrated in FIG. 3A, the cleansing members 103, each comprising a stem 104 and a cluster 105 of flexible bristles 106, are positioned and attached along the contoured profile 102*a* of the base member 101. The cleansing members 103 along the contoured profile 102*a* configured at the center of the base member 101 follow a contour of the user's back to cleanse the user's back.

Figure 3B:
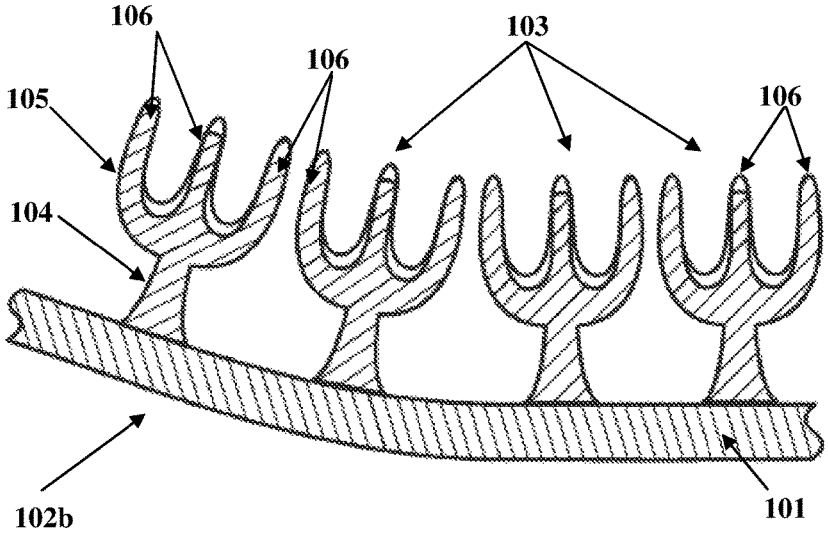
FIG. 3B exemplarily illustrates a sectional view of the body cleansing apparatus taken along a section B-B' of FIG. 2.

FIG. 3B exemplarily illustrates a sectional view of the body cleansing apparatus 100 taken along a section B-B' of FIG. 2. As exemplarily illustrated in FIG. 3B, the cleansing members 103, each comprising a stem 104 and a cluster 105 of flexible bristles 106, are positioned and attached along the contoured profile 102*b* of the base member 101. The cleansing members 103 along the contoured profile 102*b* configured proximal to the bottom end 101*a* of the base member 101 exemplarily illustrated in FIG. 2, cleanse the user's lower back. The base member 101 of the body cleansing apparatus 100 tapers downwardly along the contoured profile 102*b* to facilitate removal of a cleansing agent 1001, for example, liquid soap exemplarily illustrated in FIG. 10A, FIG. 10C, FIG. 11, FIG. 12B, FIG. 13, and FIGS. 15-16, and water from the body cleansing apparatus 100, during cleansing.

Figure 3C:
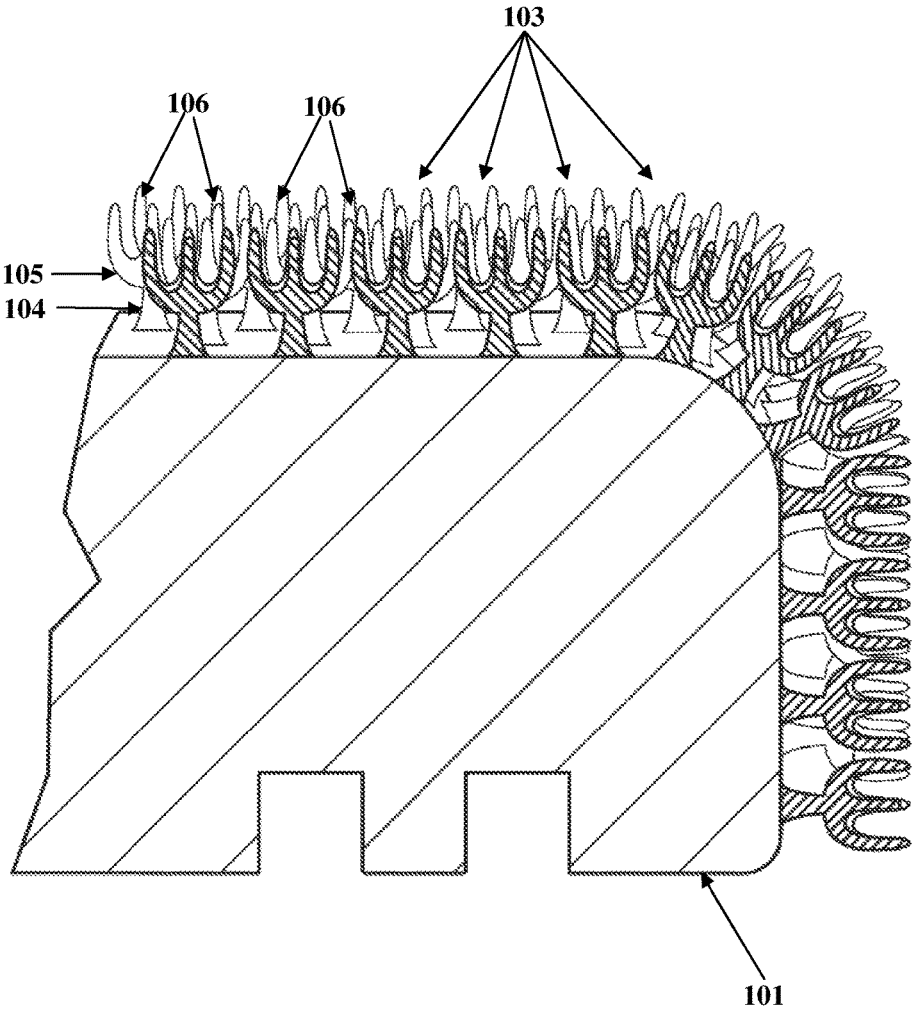
FIG. 3C exemplarily illustrates a sectional view of the body cleansing apparatus taken along a section C-C' of FIG. 2.

FIG. 3C exemplarily illustrates a sectional view of the body cleansing apparatus 100 taken along a section C-C' of FIG. 2. As exemplarily illustrated in FIG. 3C, the cleansing members 103, each comprising a stem 104 and a cluster 105 of flexible bristles 106, are positioned and attached along the sides 101*b* of the base member 101 exemplarily illustrated in FIG. 2.

Figure 3D:
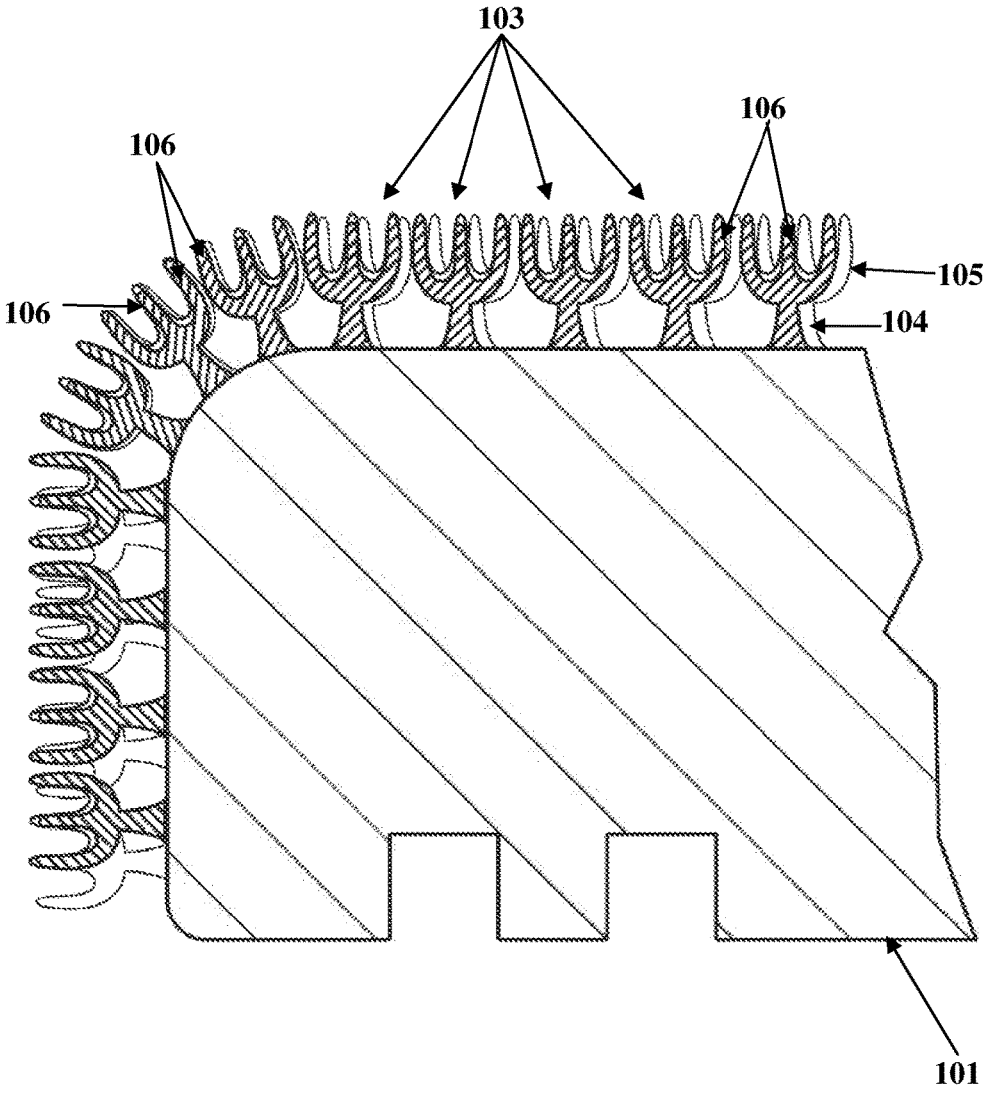
FIG. 3D exemplarily illustrates a sectional view of the body cleansing apparatus taken along a section D-D' of FIG. 2.

FIG. 3D exemplarily illustrates a sectional view of the body cleansing apparatus 100 taken along a section D-D' of FIG. 2. As exemplarily illustrated in FIG. 3D, the cleansing members 103, each comprising a stem 104 and a cluster 105 of flexible bristles 106, are positioned and attached at the bottom end 101*a* of the base member 101 exemplarily illustrated in FIG. 2.

Figure 4:
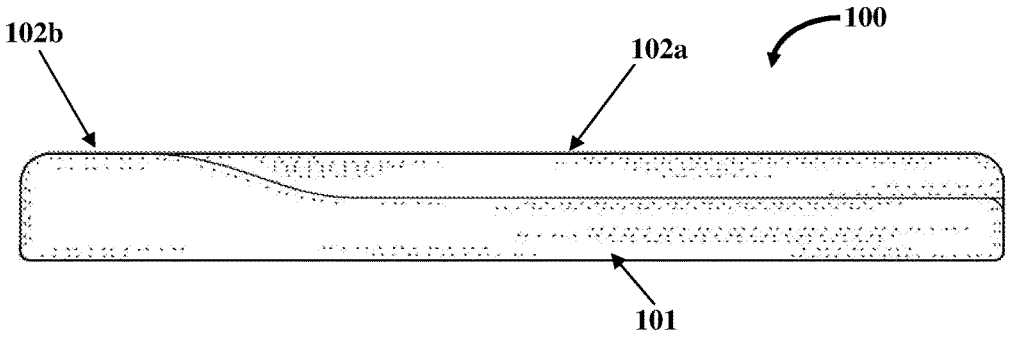
FIG. 4 exemplarily illustrates a right side elevation view of the body cleansing apparatus.
Figure 5:
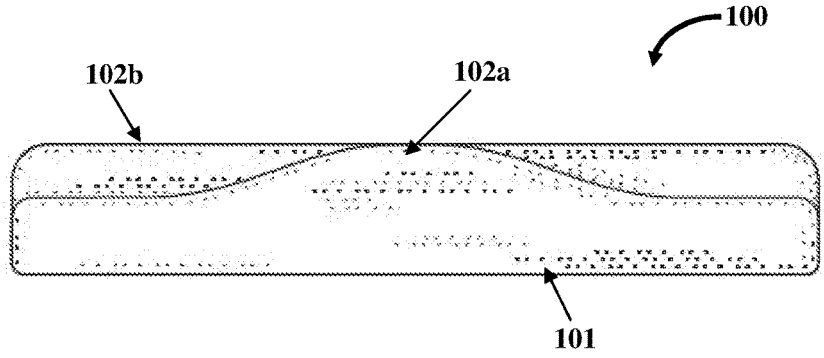
FIG. 5 exemplarily illustrates a top view of the body cleansing apparatus.
Figure 6:
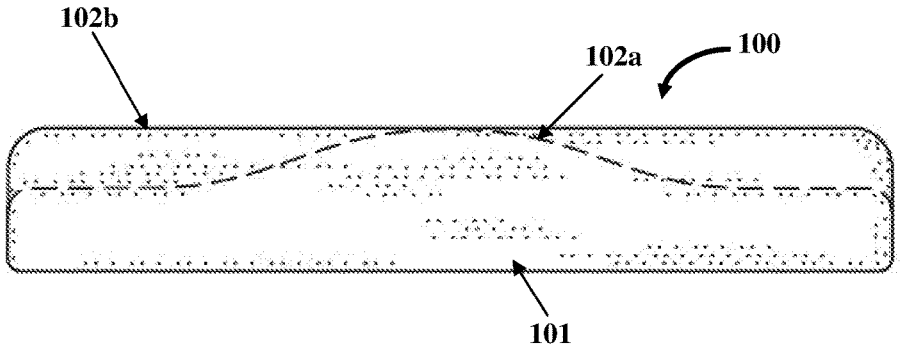
FIG. 6 exemplarily illustrates a bottom view of the body cleansing apparatus.

FIGS. 4-6 exemplarily illustrate a right side elevation view, a top view, and a bottom view respectively, of the body cleansing apparatus 100. The contoured profiles 102*a* and 102*b* of the base member 101 are exemplarily illustrated in FIGS. 4-6.

Figure 7:
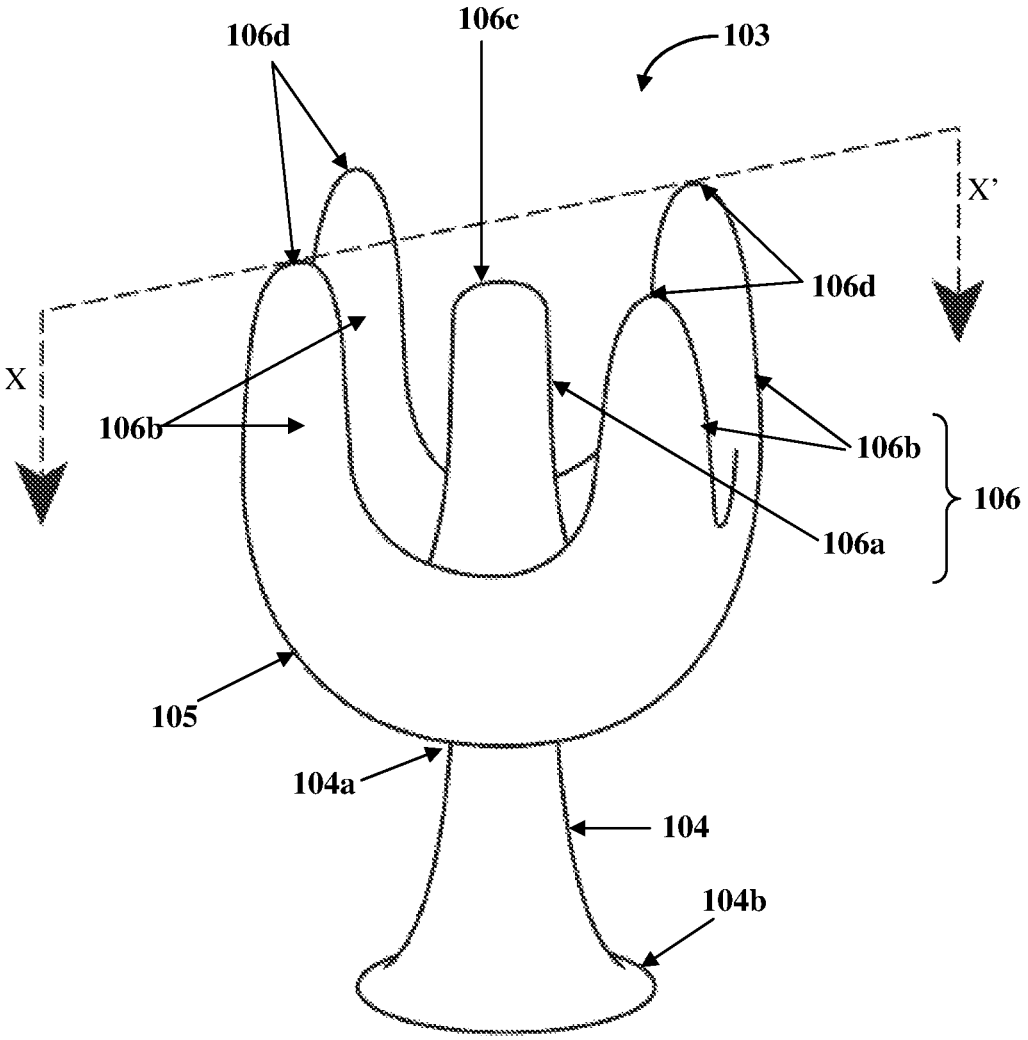
FIG. 7 exemplarily illustrates an isometric view of a cleansing member.

FIG. 7 exemplarily illustrates an isometric view of a cleansing member 103. The cleansing member 103, exemplarily illustrated in FIG. 7, comprises a stem 104 and a cluster 105 of flexible bristles 106. The stem 104 is attached to and extends outwardly from the base member 101 of the body cleansing apparatus 100 as exemplarily illustrated in FIG. 1. The flexible bristles 106 in the cluster 105 curvedly branch outwards from an upper end 104*a* of the stem 104 and define a reservoir 110 within each cluster 105 as exemplarily illustrated in FIGS. 12A-12B, FIG. 13, and FIGS. 15-16. The reservoir 110 prevents the cleansing agent 1001 exemplarily illustrated in FIG. 12B, FIG. 13, and FIGS. 15-16, from draining out of the cluster 105, thereby preventing wastage of the cleansing agent 1001 during cleansing of the user's body part. The cluster 105 of flexible bristles 106 comprises a central flexible bristle 106*a* extending from the upper end 104*a* of the stem 104, and radial flexible bristles 106*b* surrounding the central flexible bristle 106*a*. The radial flexible bristles 106*b* curvedly branch outwards from the upper end 104*a* of the stem 104. In an embodiment, the radial flexible bristles 106*b* are longer than the central flexible bristle 106*a*. In an embodiment, each cluster 105 has a configurable number of radial flexible bristles 106*b* surrounding the central flexible bristle 106*a*. In an embodiment, the flexible bristles 106*a* and 106*b* in each cluster 105 taper toward their corresponding tips 106*c* and 106*d* respectively. The flexible bristles 106 grip, for example, the user's back during cleansing. The flexible bristles 106 are, for example, made from a rubber material, a silicone rubber material, or any type of flexible material.

Figure 8:
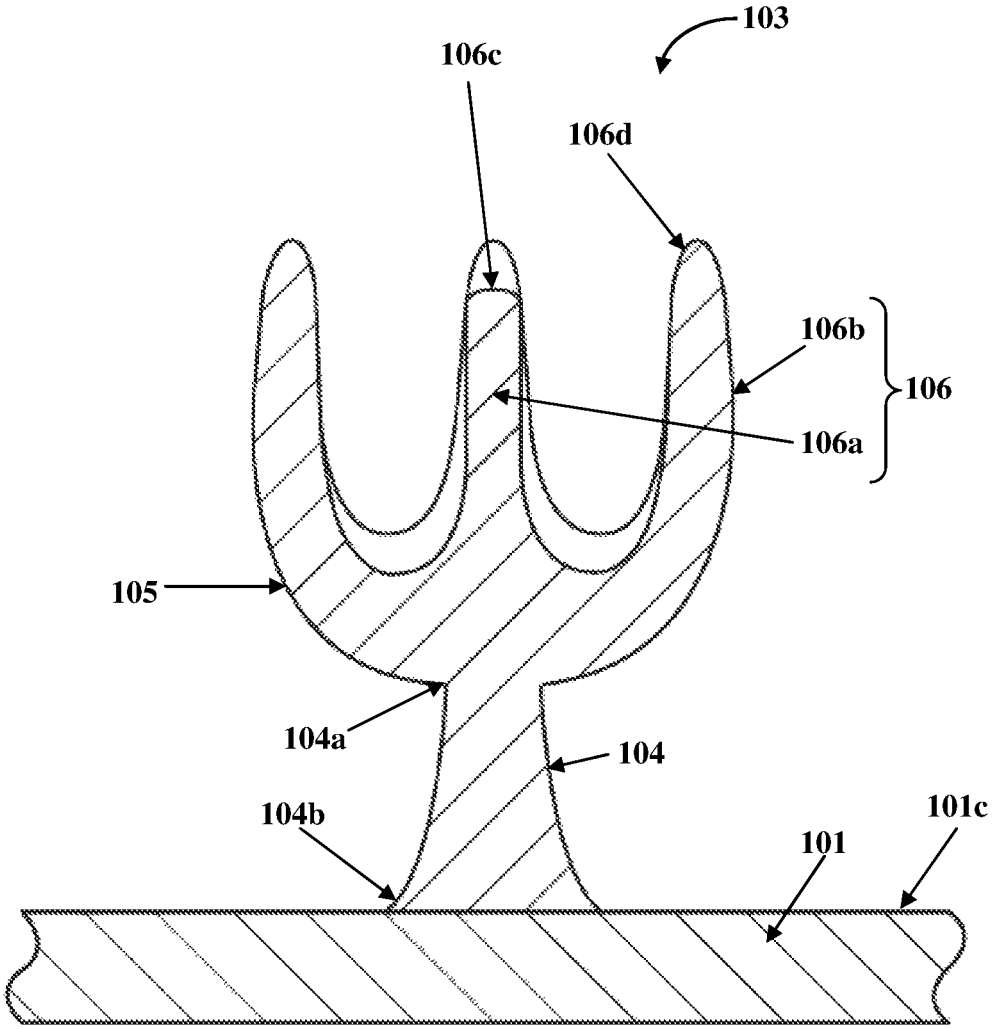
FIG. 8 exemplarily illustrates a sectional view of the cleansing member taken along a section X-X' of FIG. 7.

FIG. 8 exemplarily illustrates a sectional view of the cleansing member 103 taken along a section X-X' of FIG. 7. The sectional view in FIG. 8 shows the central flexible bristle 106*a* and the radial flexible bristles 106*b* of the cleansing member 103. In an embodiment, a configurable number of clusters 105 of flexible bristles 106 are detachably attached per square inch on a front surface 101*c* of the base member 101 and extend approximately one inch away from the base member 101.

Figure 9:
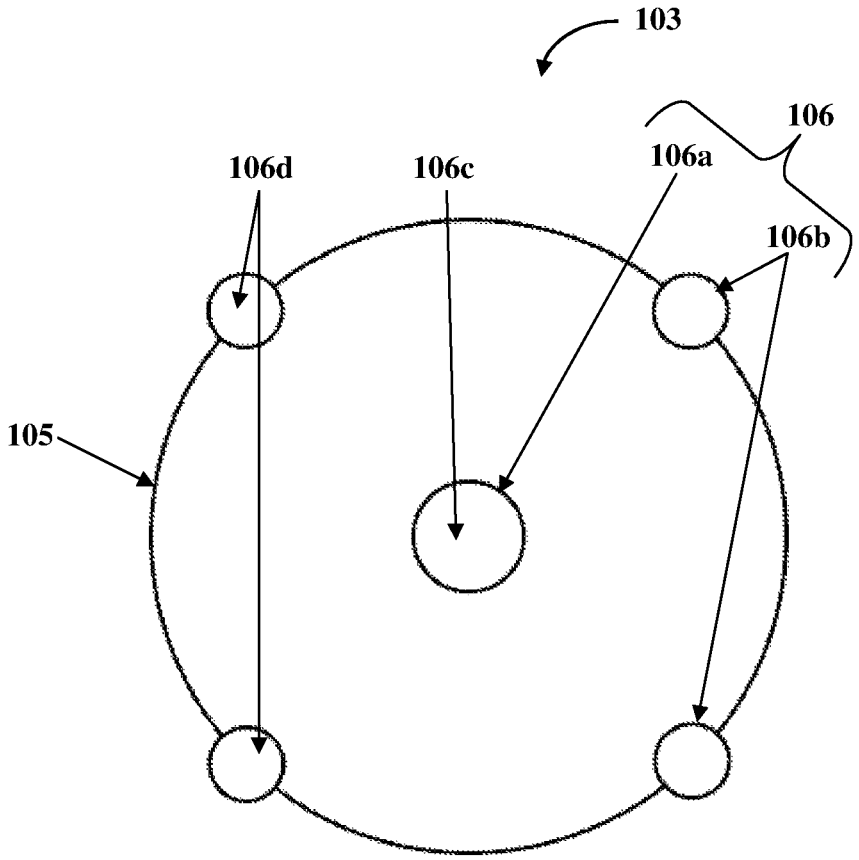
FIG. 9 exemplarily illustrates a top view of the cleansing member.

FIG. 9 exemplarily illustrates a top view of the cleansing member 103. The tips 106*c* and 106*d* of the central flexible bristle 106*a* and the radial flexible bristles 106*b* respectively, of the cluster 105 are exemplarily illustrated in FIG. 9. The tip 106*c* of the central flexible bristle 106*a* is broader in comparison to the tips 106*d* of the radial flexible bristles 106*b*. In an embodiment, each of the flexible bristles 106 comprises a flexible tip 106*c* or 106*d* configured to contact and cleanse the user's body part. The flexible tip 106*c* or 106*d* of each of the flexible bristles 106 is, for example, made from a rubber material or any type of flexible material.

Figure 10A:
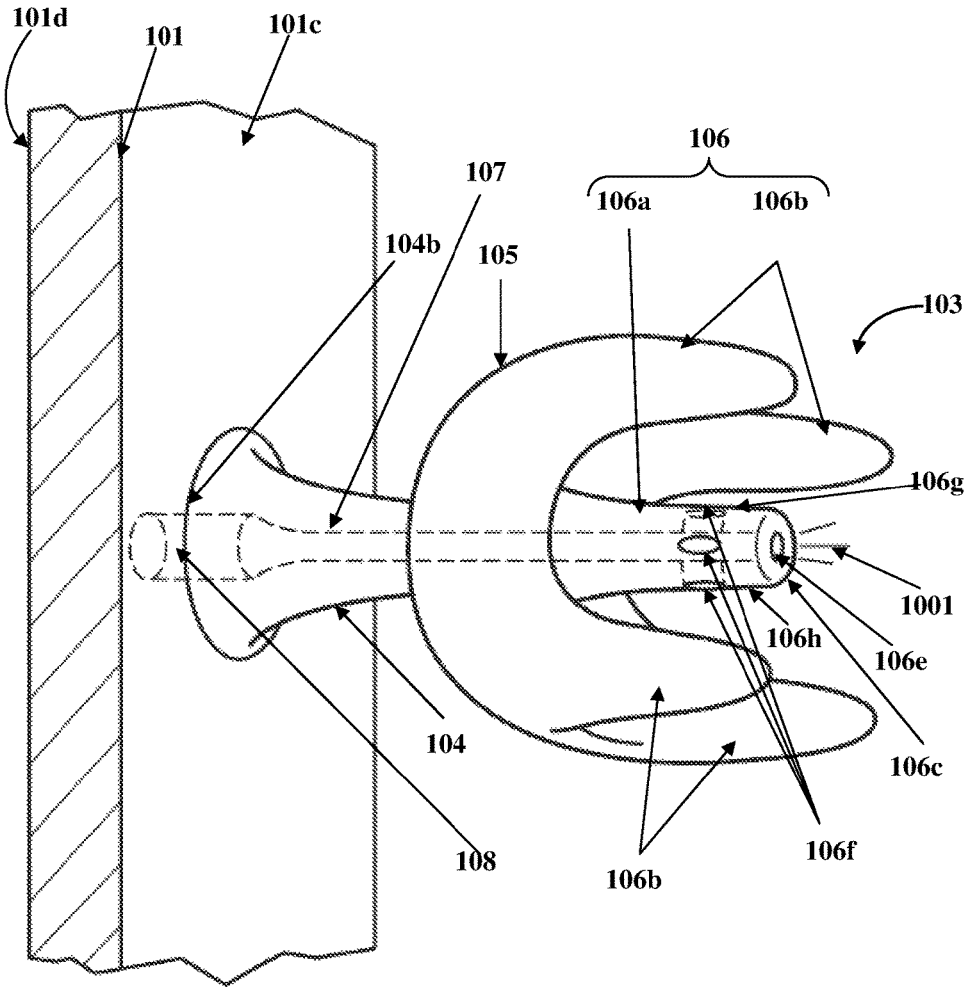
FIG. 10A exemplarily illustrates an enlarged isometric view of an embodiment of the cleansing member attached to a front surface of the base member of the body cleansing apparatus, where a stem of the cleansing member comprises a cavity, in fluid communication with a bladder in the base member that contains a cleansing agent.

FIG. 10A exemplarily illustrates an enlarged isometric view of an embodiment of the cleansing member 103 attached to the front surface 101*c* of the base member 101 of the body cleansing apparatus 100 exemplarily illustrated in FIG. 2, where the stem 104 of the cleansing member 103 comprises a cavity 107, in fluid communication with a bladder 108 in the base member 101 that contains a cleansing agent 1001. In an embodiment, one or more of the flexible bristles 106 in the cluster 105 comprise one or more apertures 106*e* and 106*f* positioned on bodies of the flexible bristles 106. The apertures 106*e* and 106*f* are configured to dispense the cleansing agent 1001 contained within the stem 104. As exemplarily illustrated in FIG. 10A, the central flexible bristle 106*a* of the cluster 105 comprises an aperture 106*e* on the tip 106*c* of the central flexible bristle 106*a* and additional apertures 106*f* on the sides 106*g* and 106*h* of the central flexible bristle 106*a*. In an embodiment, the base member 101 further comprises a bladder 108 for storing and containing the cleansing agent 1001.

Figure 10B:
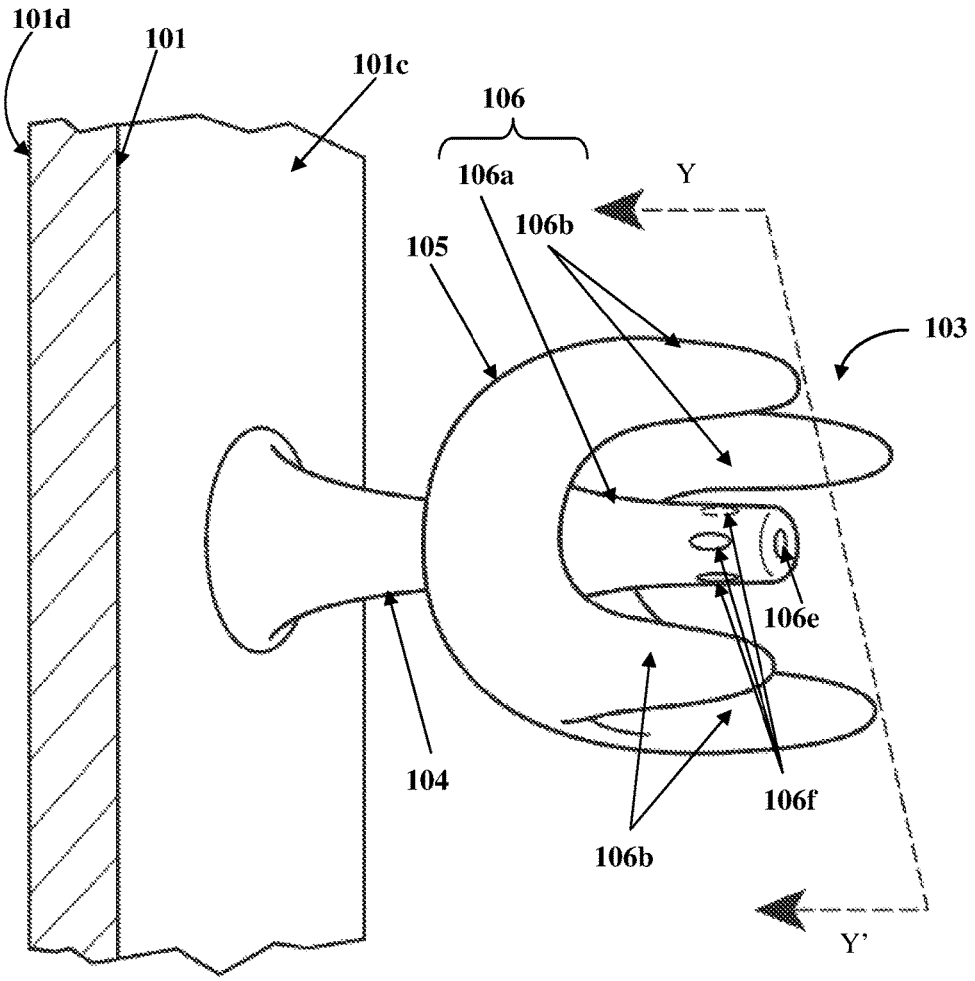
FIG. 10B exemplarily illustrates an enlarged isometric view of the embodiment of the cleansing member shown in FIG. 10A, attached to the base member of the body cleansing apparatus, showing a section Y-Y' taken along the cleansing member.
Figure 10C:
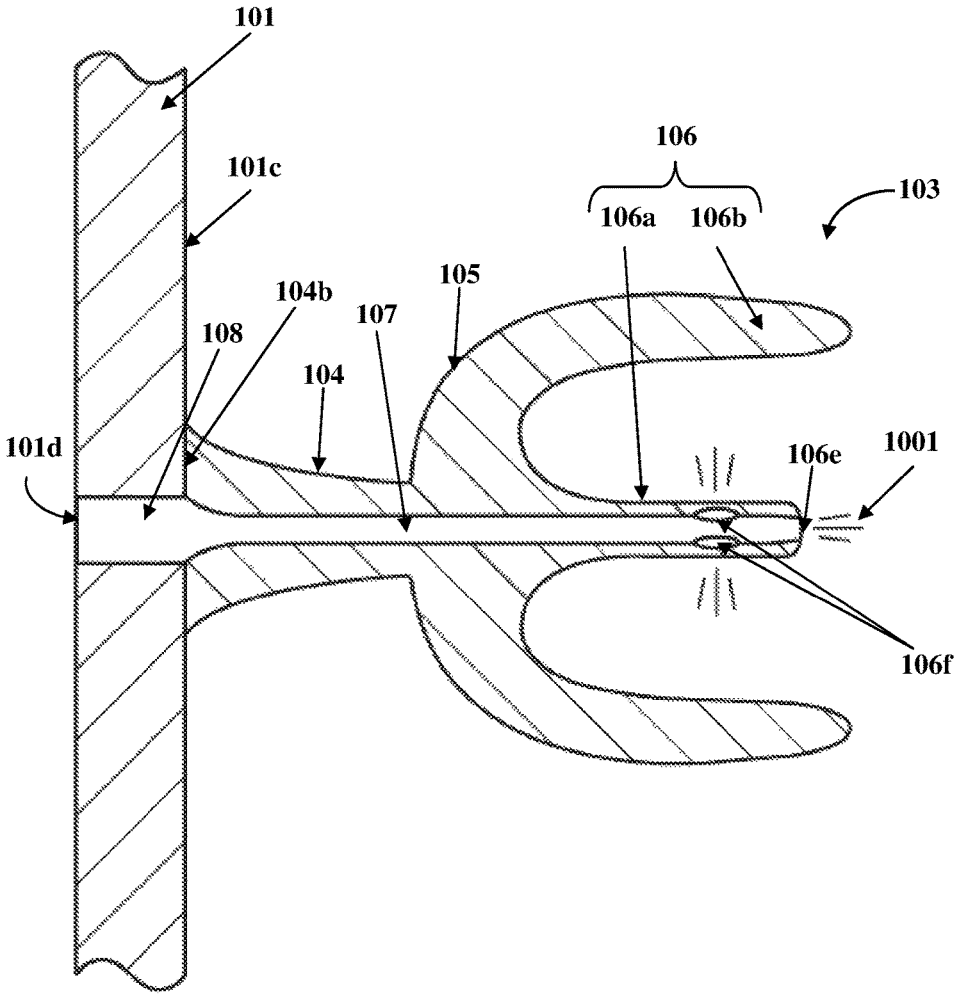
FIG. 10C exemplarily illustrates an enlarged sectional view of the embodiment of the cleansing member attached to the base member of the body cleansing apparatus, taken along the section Y-Y' of FIG. 10B, showing a cavity within the stem of the cleansing member, in fluid communication with the bladder in the base member that contains a cleansing agent.

As exemplarily illustrated in FIG. 10A and FIG. 10C, a cylindrical bladder 108 that stores the cleansing agent 1001 extends from the lower end 104*b* of the stem 104 of the cleansing member 103 on the front surface 101*c* of the base member 101 to a rear surface 101*d* of the base member 101. The stored cleansing agent 1001 is drawn from the bladder 108 through the stem 104 and out through one or more apertures 106*e* and 106*f* positioned on the central flexible bristle 106*a*, when the user's body part contacts and applies a pressure on the stem 104 for dispensing the cleansing agent 1001. The stem 104 of the cleansing member 103 comprises a cavity 107, in fluid communication with the bladder 108 defined within the base member 101, for extracting the cleansing agent 1001 stored in the bladder 108, and for containing and dispensing the cleansing agent 1001 through one or more apertures 106*e* and 106*f* positioned, for example, on the central flexible bristle 106*a* for cleansing the user's body part, when the user's body part contacts and applies a pressure on the stem 104. As exemplarily illustrated in FIG. 10A, the cleansing agent 1001 is drawn from the bladder 108 through the cavity 107 and out through the aperture 106*e* on the tip 106*c* of the central flexible bristle 106*a*, when the user's body part contacts and applies a pressure on the stem 104.

In another embodiment, any two of the flexible bristles 106*b* can be joined together to create a web (not shown) for collecting the cleansing agent 1001, for example, soap particulates within the cluster 105 of flexible bristles 106.

FIG. 10B exemplarily illustrates an enlarged isometric view of the embodiment of the cleansing member 103 shown in FIG. 10A, attached to the base member 101 of the body cleansing apparatus 100 exemplarily illustrated in FIG. 2, showing a section Y-Y' taken along the cleansing member 103.

FIG. 10C exemplarily illustrates an enlarged sectional view of the embodiment of the cleansing member 103 attached to the base member 101 of the body cleansing apparatus 100 exemplarily illustrated in FIG. 2, taken along the section Y-Y' of FIG. 10B, showing a cavity 107 within the stem 104 of the cleansing member 103, in fluid communication with the bladder 108 in the base member 101 that contains a cleansing agent 1001. As exemplarily illustrated in FIG. 10C, the cleansing agent 1001 is drawn from the bladder 108 through the cavity 107 and out through the apertures 106*e* and 106*f* of the central flexible bristle 106*a*, when the user's body part contacts and applies a pressure on the stem 104.

Figure 11:
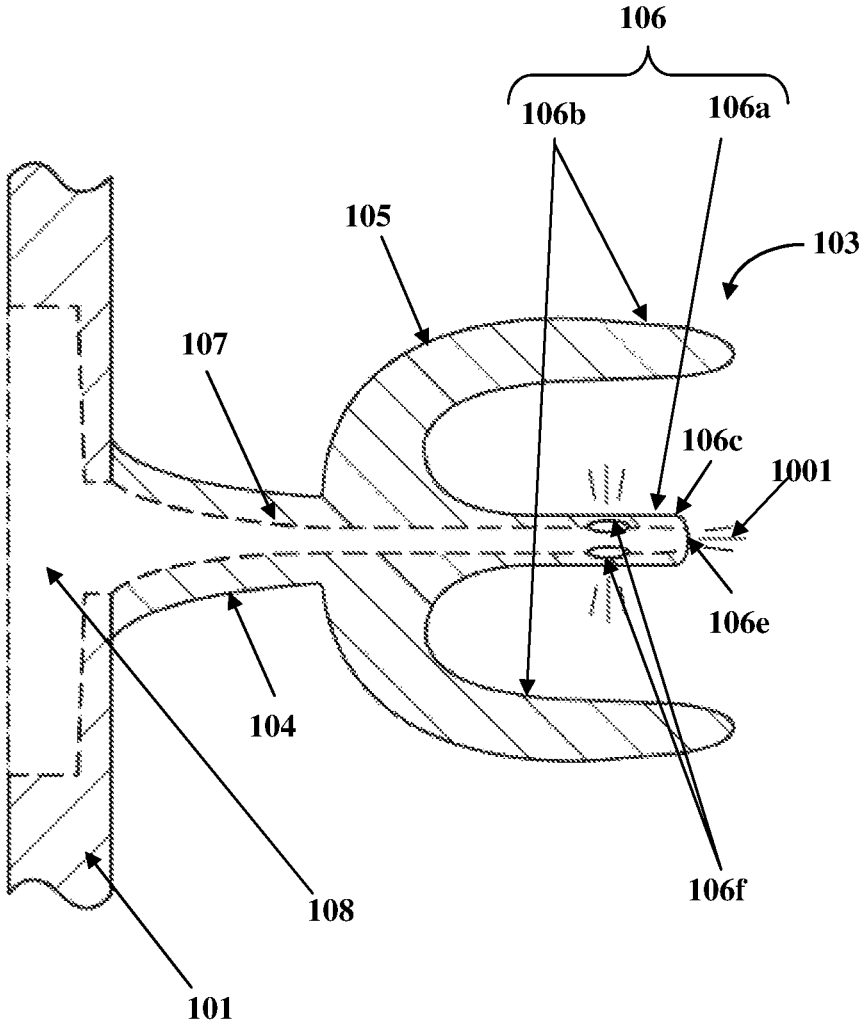
FIG. 11 exemplarily illustrates an enlarged sectional view of an embodiment of the cleansing member attached to the base member of the body cleansing apparatus, showing the cavity in the stem of the cleansing member, in fluid communication with an extended bladder defined in the base member.

FIG. 11 exemplarily illustrates an enlarged sectional view of an embodiment of the cleansing member 103 attached to the base member 101 of the body cleansing apparatus 100 exemplarily illustrated in FIG. 2, showing the cavity 107 in the stem 104 of the cleansing member 103, in fluid communication with an extended bladder 108 defined in the base member 101. In an embodiment, an extended bladder 108 is defined within the base member 101 for storing the cleansing agent 1001. As exemplarily illustrated in FIG. 11, the cavity 107 communicates with the extended bladder 108 defined within the base member 101, for extracting the cleansing agent 1001 stored in the extended bladder 108, containing, and dispensing the cleansing agent 1001 through the apertures 106*e* and 106*f* positioned on the central flexible bristle 106*a* for cleansing the user's body part, when the user's body part contacts and applies a pressure on the stem 104. The cleansing agent 1001 is dispensed from the cavity 107 towards the tips 106*c* and 106*d* of any of the flexible bristles 106 via their apertures 106*e* and 106*f* respectively, for cleansing the user's body part. For example, the cleansing agent 1001 such as liquid soap is dispensed through the tip 106*c* of the central flexible bristle 106*a* via its aperture 106*e*, when a user's body part, for example, the user's back applies a pressure to the stem 104. In another embodiment, the cleansing agent 1001 is dispensed from the cavity 107 towards the tip 106*d* of any of the other flexible bristles 106*b*.

When the user's body part contacts and pushes against the central flexible bristle 106*a*, the cleansing agent 1001 is dispensed from the cavity 107 towards the tip 106*c* of the central flexible bristle 106*a* and then onto the user's body part that contacts the tip 106*c*. In an embodiment, any other flexible bristle 106*b* comprises a cavity similar to the cavity 107 for containing and dispensing the cleansing agent 1001.

Figure 12A:
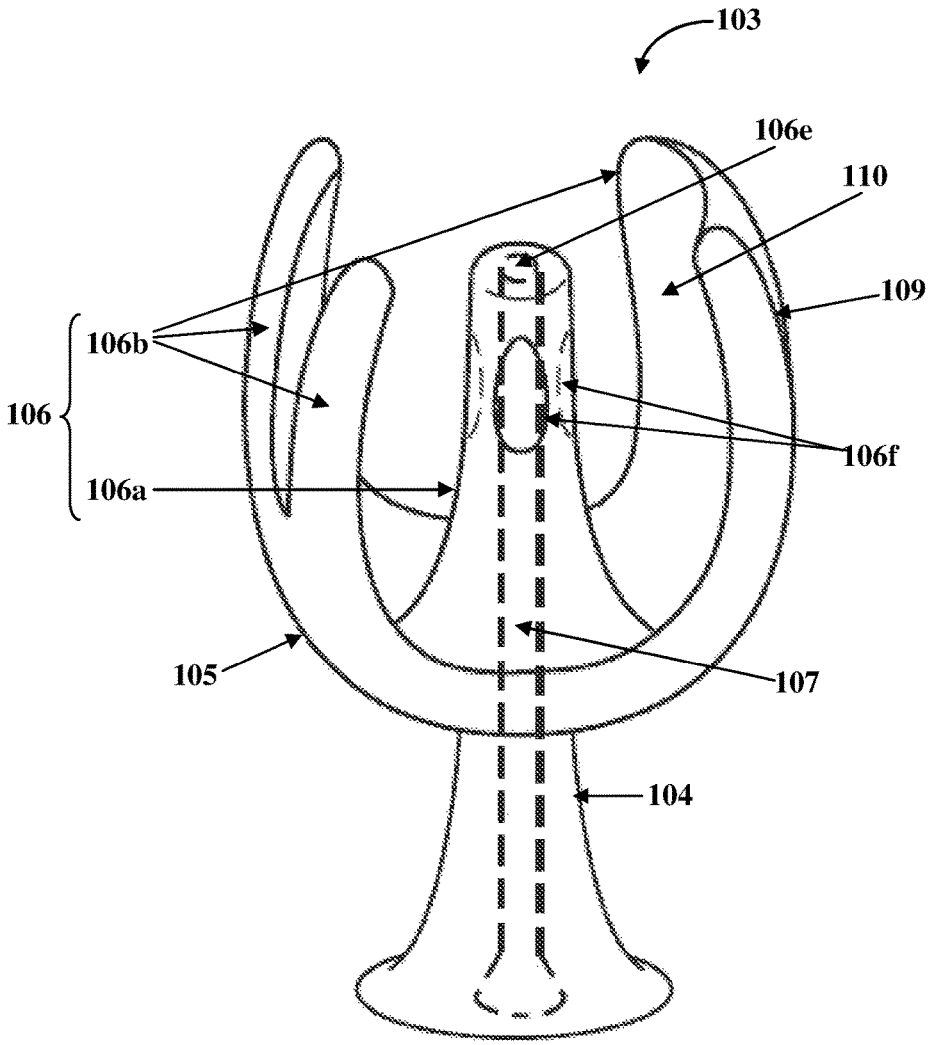
FIG. 12A exemplarily illustrates an isometric view of an embodiment of the cleansing member, showing a flexible bristle in a cluster of flexible bristles, in a wide generally concave configuration that defines a reservoir for collecting and retaining a cleansing agent for cleansing a body part.
Figure 12B:
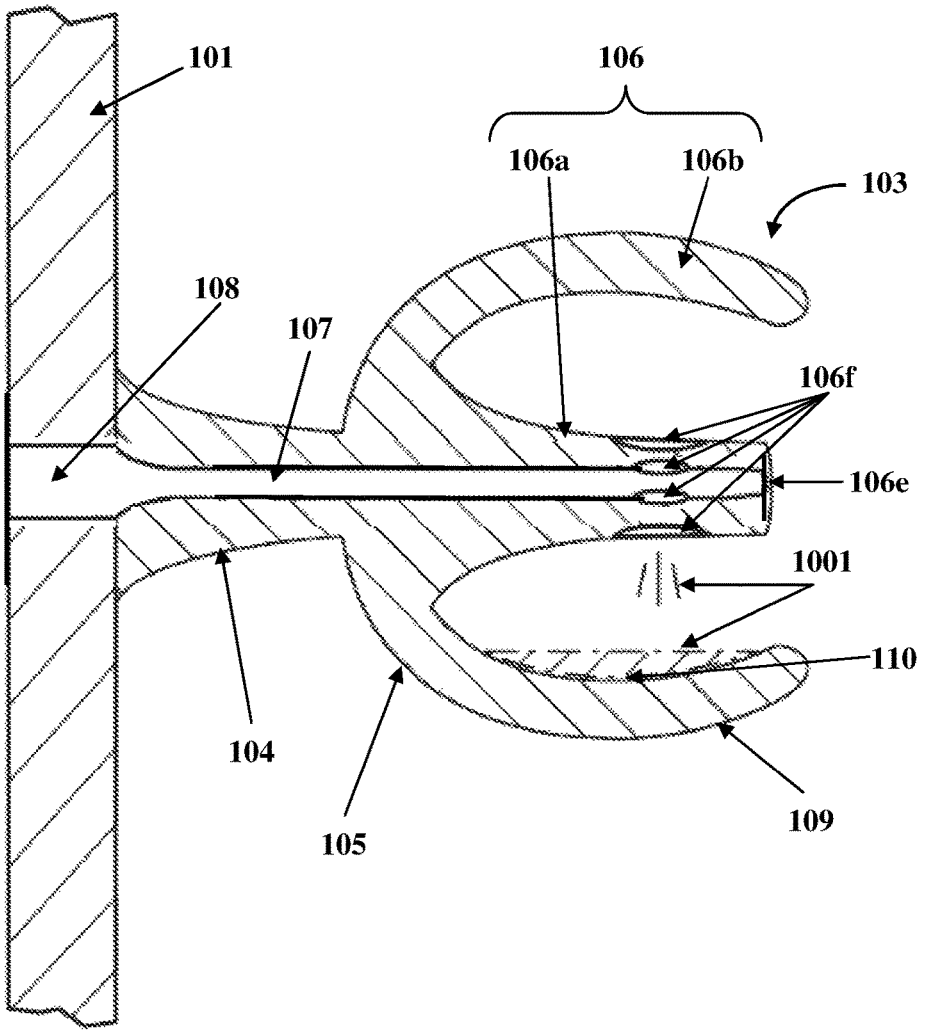
FIG. 12B exemplarily illustrates an enlarged sectional view of the embodiment of the cleansing member shown in FIG. 12A, attached to the base member of the body cleansing apparatus, where the stem of the cleansing member comprises a cavity in fluid communication with the bladder defined in the base member, for dispensing the cleansing agent stored in the bladder into the reservoir defined by a flexible bristle in the cluster.

FIG. 12A exemplarily illustrates an isometric view of an embodiment of the cleansing member 103, showing a flexible bristle 109 in the cluster 105 of flexible bristles 106, in a wide generally concave configuration that defines a reservoir 110 for collecting and retaining a cleansing agent 1001 exemplarily illustrated in FIG. 12B, for cleansing a user's body part. The reservoir 110 receives, stores, and retains a cleansing agent 1001 as exemplarily illustrated in FIG. 12B, FIG. 13, and FIGS. 15-16, and releases the cleansing agent 1001 along the flexible bristles 106 when the user's body part contacts and applies a pressure on the stem 104 of the cleansing member 103.

FIG. 12B exemplarily illustrates an enlarged sectional view of the embodiment of the cleansing member 103 shown in FIG. 12A, attached to the base member 101 of the body cleansing apparatus 100 exemplarily illustrated in FIG. 2, where the stem 104 of the cleansing member 103 comprises a cavity 107 in fluid communication with the bladder 108 defined in the base member 101, for dispensing a cleansing agent 1001, for example, soap stored in the bladder 108 into the reservoir 110 defined by a flexible bristle 109 in the cluster 105. When the body cleansing apparatus 100 is attached to a support structure 2801, for example, a wall as exemplarily illustrated in FIG. 28, the cleansing member 103 exemplarily illustrated in FIG. 12A, attached to the base member 101 is oriented in a generally horizontal position as exemplarily illustrated in FIG. 12B. When the user's body part contacts and pushes against the central flexible bristle 106*a* of the cleansing member 103, the cleansing agent 1001 dispenses from the cavity 107 through the apertures 106*e* and 106*f* of the central flexible bristle 106*a* and collects in the reservoir 110 defined by the flexible bristle 109 which is in the wide generally concave configuration, thereby retaining the cleansing agent 1001 within the cluster 105 as exemplarily illustrated in FIG. 12B, for cleansing the user's body part. The cleansing agent 1001 coats the flexible bristles 106 and allows the application of the cleansing agent 1001 on the user's body part when the body part contacts and applies a pressure on the flexible bristles 106.

Figure 13:
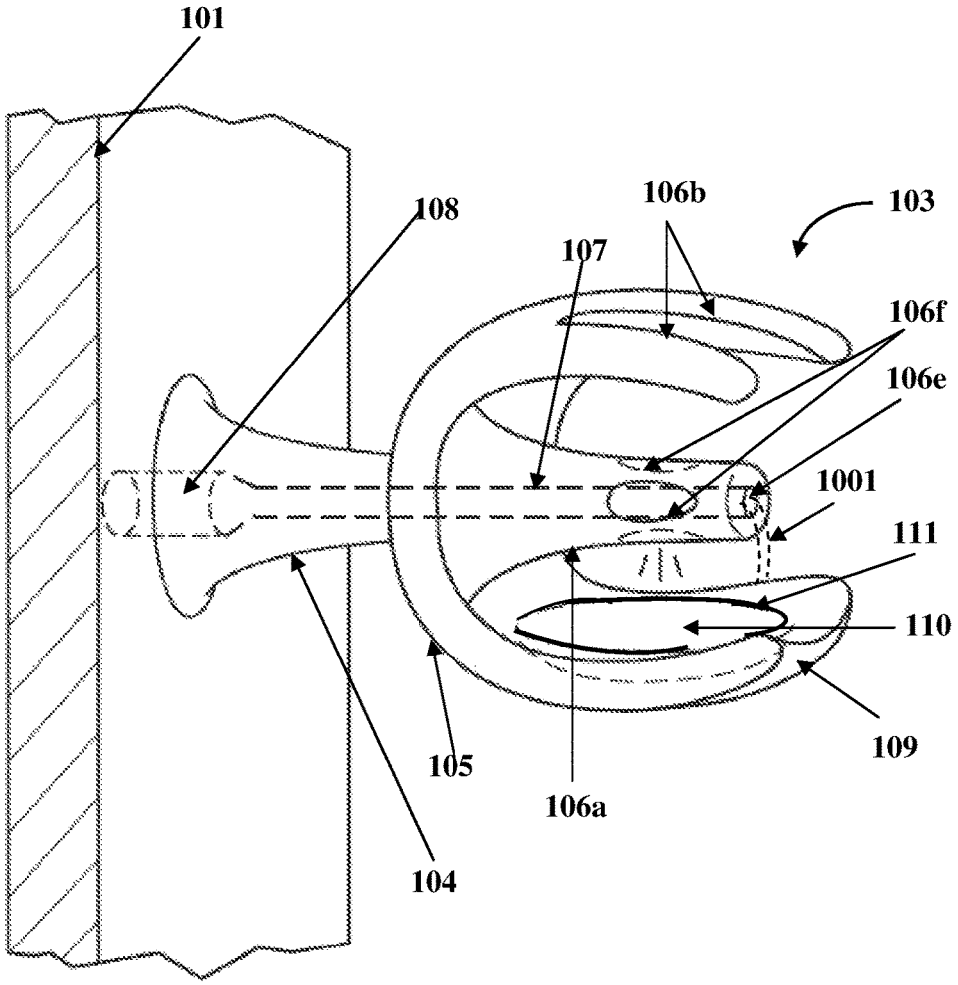
FIG. 13 exemplarily illustrates an enlarged isometric view of an embodiment of the cleansing member attached to the base member of the body cleansing apparatus, where one of the flexible bristles comprises a spoon section that defines a reservoir for collecting and retaining a cleansing agent dispensed from a cavity in the stem of the cleansing member.

FIG. 13 exemplarily illustrates an enlarged isometric view of an embodiment of the cleansing member 103 attached to the base member 101 of the body cleansing apparatus 100 exemplarily illustrated in FIG. 2, where a flexible bristle 109 comprises a spoon section 111 that defines a reservoir 110 for collecting and retaining a cleansing agent 1001 dispensed from a cavity 107 in the stem 104 of the cleansing member 103. In this embodiment, a flexible bristle 109 that is in the wide generally concave configuration comprises the spoon section 111 that defines the reservoir 110. When the user's body part contacts and pushes against the central flexible bristle 106*a* of the cleansing member 103, the cleansing agent 1001 dispenses from the cavity 107 through the apertures 106*e* and 106*f* of the central flexible bristle 106*a* and collects in the reservoir 110 defined by the spoon section 111. The cleansing agent 1001, for example, soap settles in the spoon section 111, thereby retaining the cleansing agent 1001 within the cluster 105 as exemplarily illustrated in FIG. 13, for cleansing the user's body part.

Figure 14:
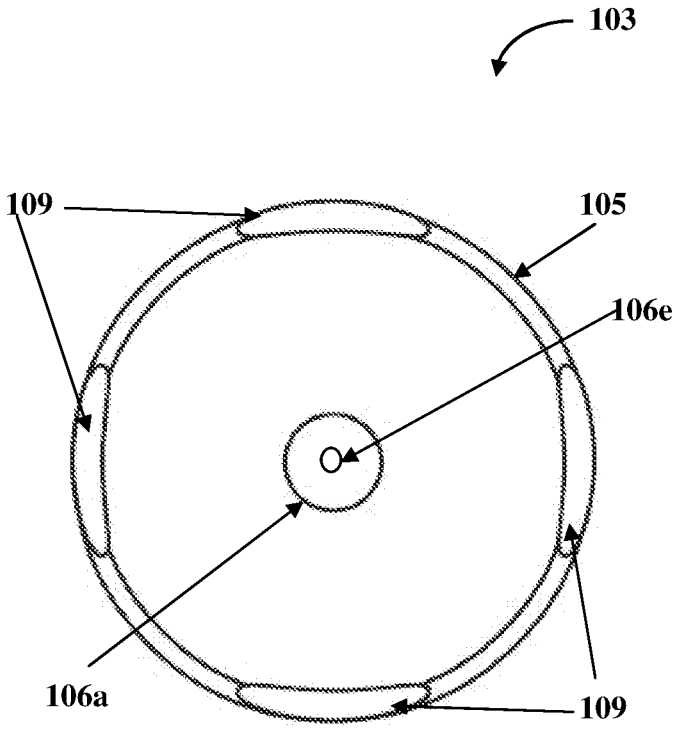
FIG. 14 exemplarily illustrates a top view of an embodiment of the cleansing member having wide generally concave shaped flexible bristles that collect and retain a cleansing agent.

FIG. 14 exemplarily illustrates a top view of an embodiment of the cleansing member 103 having wide generally concave shaped flexible bristles 109 that collect and retain a cleansing agent 1001 exemplarily illustrated in FIG. 12B and FIG. 13. In this embodiment, all the flexible bristles 109 in the clusters 105 have a wide generally concave configuration for collecting and retaining the cleansing agent 1001 within the cluster 105 of the cleansing member 103.

Figure 15:
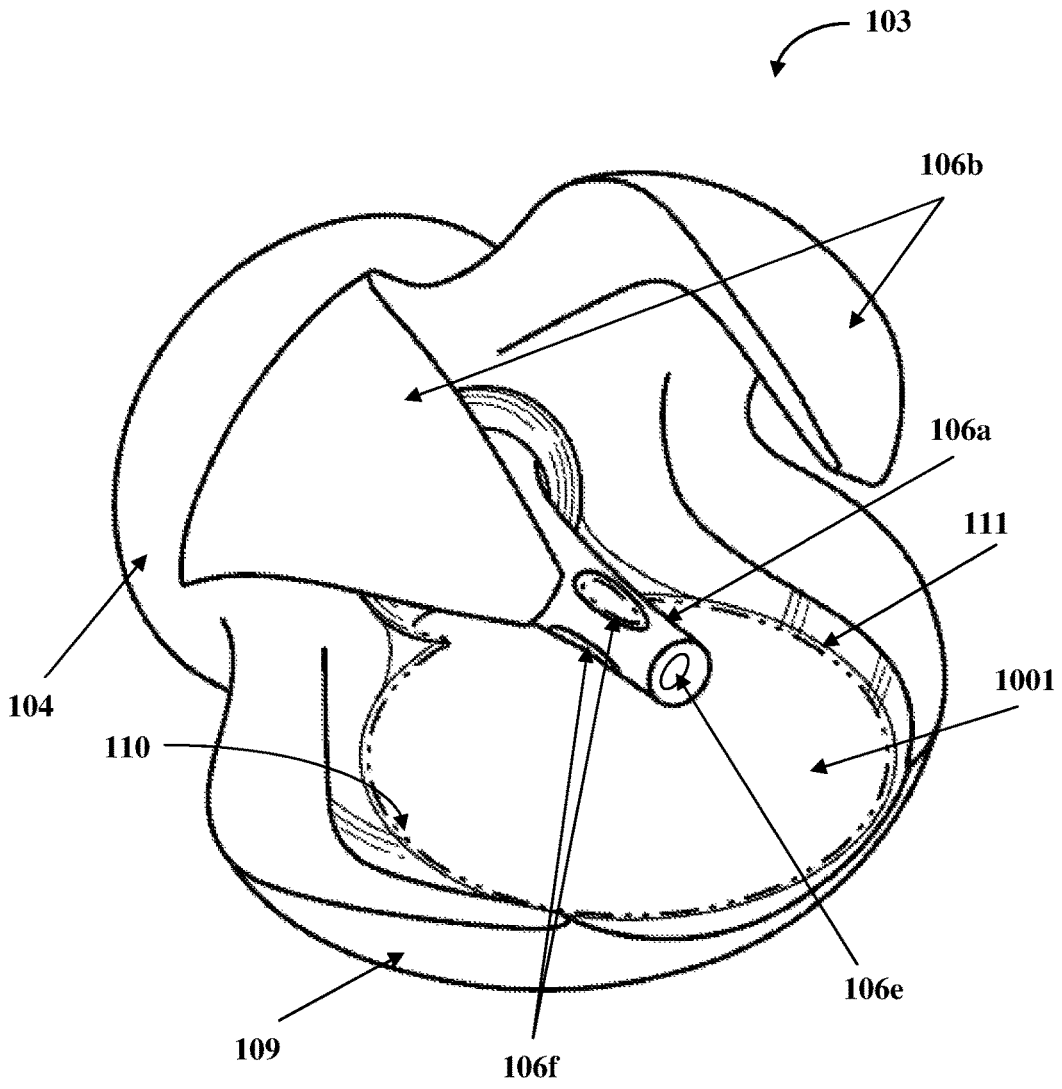
FIG. 15 exemplarily illustrates an isometric view of an embodiment of the cleansing member, where one of the flexible bristles comprises a wide spoon section that defines a reservoir for collecting and retaining a cleansing agent.

FIG. 15 exemplarily illustrates an isometric view of an embodiment of the cleansing member 103, where a flexible bristle 109 comprises a wide spoon section 111 that defines a reservoir 110 for collecting and retaining a cleansing agent 1001. The cleansing agent 1001 may, for example, be introduced into the wide spoon section 111 by the user or dispensed from a cavity 107 in the stem 104 exemplarily illustrated in FIGS. 12A-12B and FIG. 13, through the apertures 106*e* and 106*f*, for example, in the central flexible bristle 106*a* and into the wide spoon section 111 for cleansing the user's body part.

Figure 16:
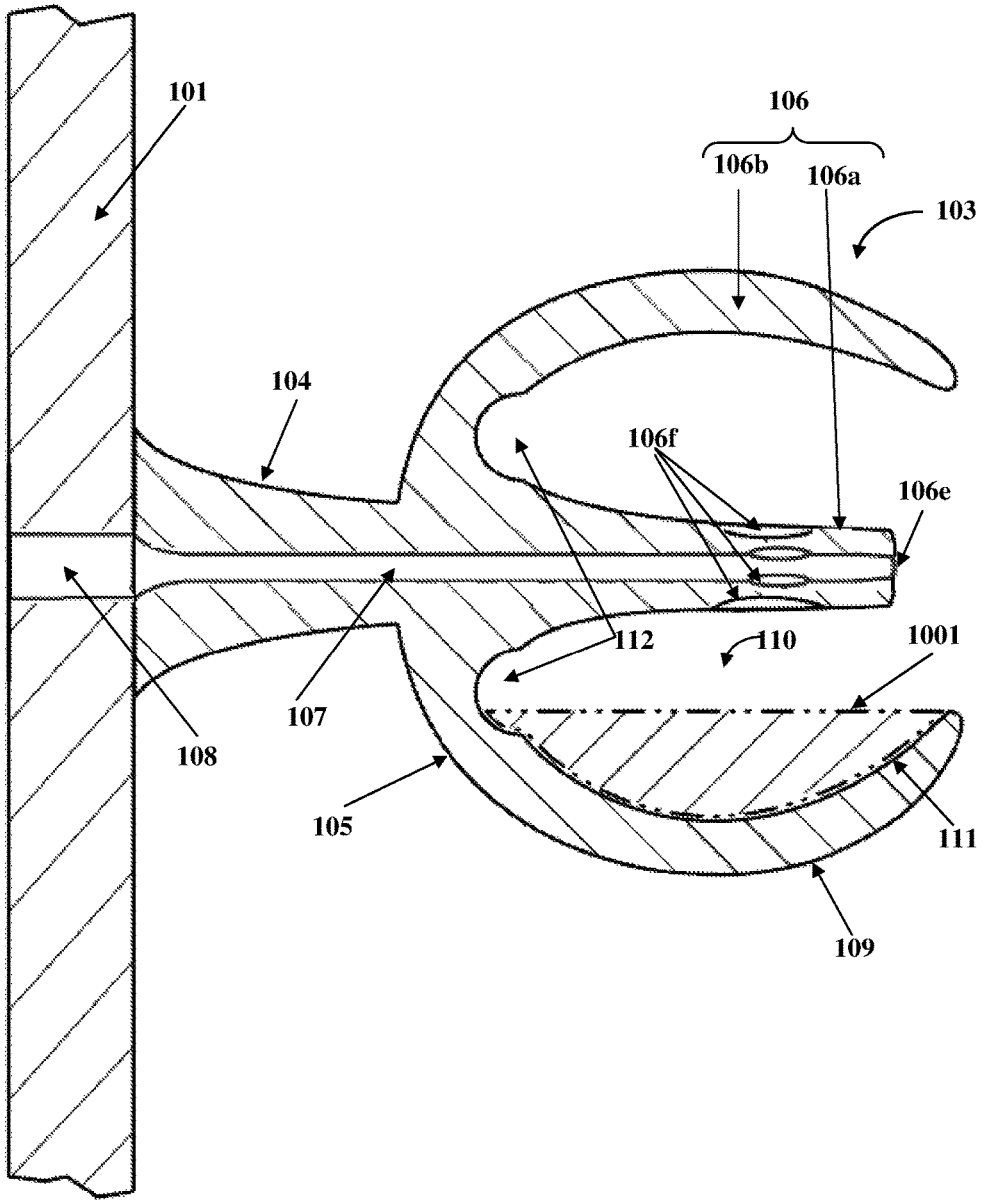
FIG. 16 exemplarily illustrates an enlarged sectional view of an embodiment of the cleansing member, where the flexible bristles comprise generally concave troughs positioned at a base of each of the flexible bristles.

FIG. 16 exemplarily illustrates an enlarged sectional view of an embodiment of the cleansing member 103, where the flexible bristles 106 and 109 comprise generally concave troughs 112 positioned at a base of each of the flexible bristles 106 and 109. The generally concave troughs 112 are positioned at the base of each of the flexible bristles 106 and 109 in the cluster 105 where each of the flexible bristles 106 and 109 meets the stem 104 of the cleansing member 103. The generally concave troughs 112 are circular, channel shaped around the central flexible bristle 106*a*. The generally concave troughs 112 are configured to contain the cleansing agent 1001. The cleansing agent 1001 is dispensed from the generally concave troughs 112 on application of a pressure on the flexible bristles 106 and 109 by the user's body part, for example, the user's back. FIG. 16 also shows the spoon section 111 in the flexible bristle 109 having a wide generally concave configuration that defines the reservoir 110 for collecting and retaining the cleansing agent 1001. As exemplarily illustrated in FIG. 16, the generally concave trough 112 provided at the base of the flexible bristle 109 is in communication with the concave spoon section 111 of the flexible bristle 109 to contain the cleansing agent 1001. The spoon section 111 in the flexible bristle 109 having a wide generally concave configuration and the generally concave troughs 112 prevent the cleansing agent 1001 from draining out when the body cleansing apparatus 100 exemplarily illustrated in FIG. 2, is attached in a vertical position against a support structure 2801 such as a wall as exemplarily illustrated in FIG. 28. The cleansing agent 1001 is dispensed from the generally concave trough 112 at the base of the flexible bristle 109 and also from the concave spoon section 111 of the flexible bristle 109 on application of a pressure on the flexible bristles 106 and 109 by the user's back.

Figure 17:
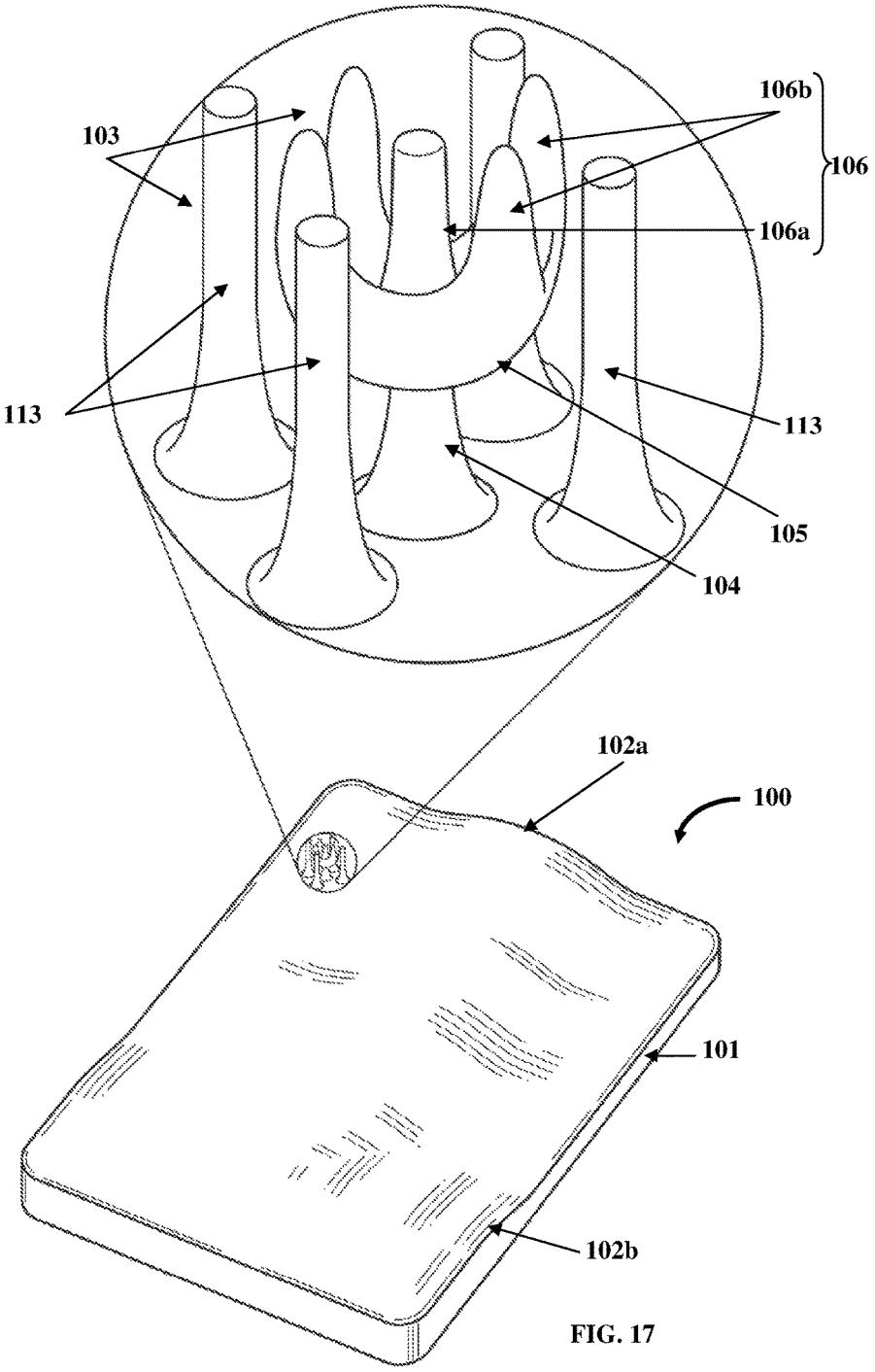
FIG. 17 exemplarily illustrates a front isometric view of an embodiment of the body cleansing apparatus, showing a projected enlarged view of a combination of two types of cleansing members positioned on the base member of the body cleansing apparatus.

FIG. 17 exemplarily illustrates a front isometric view of an embodiment of the body cleansing apparatus 100, showing a projected enlarged view of a combination of two types of cleansing members 103 positioned on the base member 101 of the body cleansing apparatus 100. In an embodiment, in addition to the cleansing members 103 having stems 104 and clusters 105 of flexible bristles 106, the body cleansing apparatus 100 further comprises single elongate flexible bristles 113. The single elongate flexible bristles 113 are attached to and extend outwardly from the base member 101. As exemplarily illustrated in FIG. 17, the single elongate flexible bristles 113 along with the clusters 105 of flexible bristles 106 are positioned and attached at multiple locations on the contoured profiles 102*a* and 102*b* of the base member 101. The flexible bristles 106 and 113 are flexible and slightly firm and are made of, for example, rubber.

For purposes of illustration, the detailed description refers to two types of cleansing members 103 positioned on the base member 101 of the body cleansing apparatus 100 as exemplarily illustrated in FIG. 17; however the scope of the body cleansing apparatus 100 disclosed herein is not limited to a combination of only these two types of cleansing members 103, but may be extended to include a combination of any of the cleansing members 103 exemplarily illustrated in FIG. 7, FIG. 10A, FIG. 11, FIG. 12A, FIGS. 13-16, and FIG. 18, and other cleansing members of different shapes, materials, and sizes.

Figure 18:
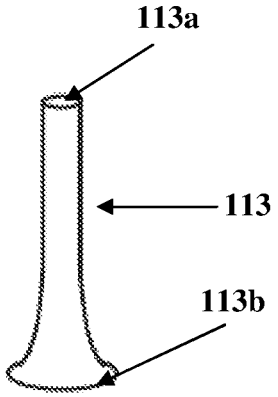
FIG. 18 exemplarily illustrates an isometric view of an embodiment of the cleansing member.
Figure 19:
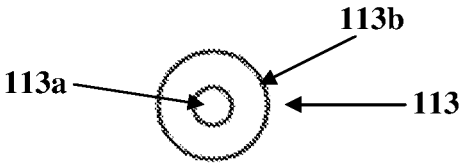
FIG. 19 exemplarily illustrates a top view of the embodiment of the cleansing member shown in FIG. 18.
Figure 20:
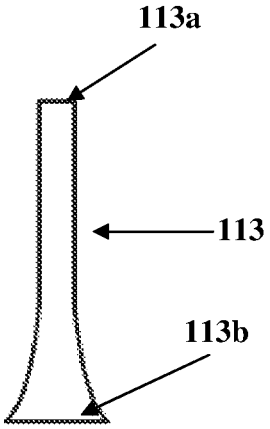
FIG. 20 exemplarily illustrates a side elevation view of the embodiment of the cleansing member shown in FIG. 18.
Figure 21:
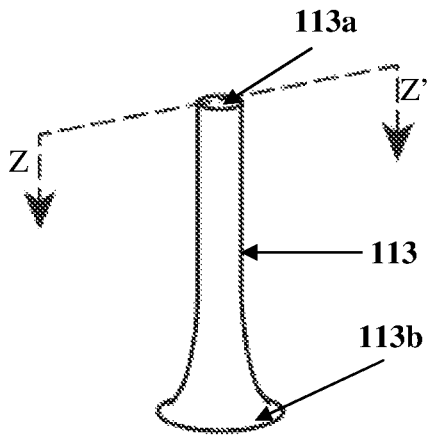
FIG. 21 exemplarily illustrates an isometric view of the embodiment of the cleansing member, showing a section Z-Z' taken along the cleansing member.
Figure 22:
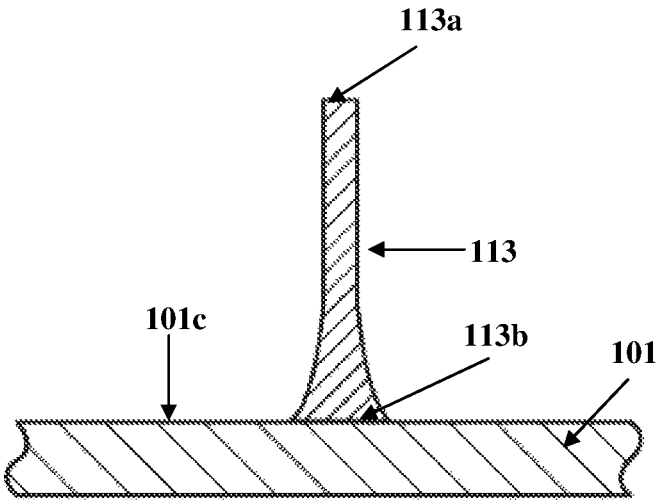
FIG. 22 exemplarily illustrates a sectional view of the embodiment of the cleansing member attached to the front surface of the base member, taken along the section Z-Z' of FIG. 21.

FIGS. 18-22 exemplarily illustrate different views of an embodiment of the cleansing member 103. In this embodiment, the cleansing member 103 is a single elongate flexible bristle 113 with a flat rounded upper end or tip 113*a* and a generally circular lower end 113*b*. FIG. 18 exemplarily illustrates an isometric view of this embodiment of the cleansing member 103. FIG. 19 exemplarily illustrates a top view of this embodiment of the cleansing member 103. FIG. 20 exemplarily illustrates a side elevation view of this embodiment of the cleansing member 103. FIG. 21 exemplarily illustrates an isometric view of this embodiment of the cleansing member 103, showing a section Z-Z' taken along the cleansing member 103. FIG. 22 exemplarily illustrates a sectional view of the embodiment of the cleansing member 103 attached to the front surface 101*c* of the base member 101, taken along section Z-Z' of FIG. 21. The single elongate flexible bristle 113 is attached to and extends outwardly from the base member 101.

Figure 23:
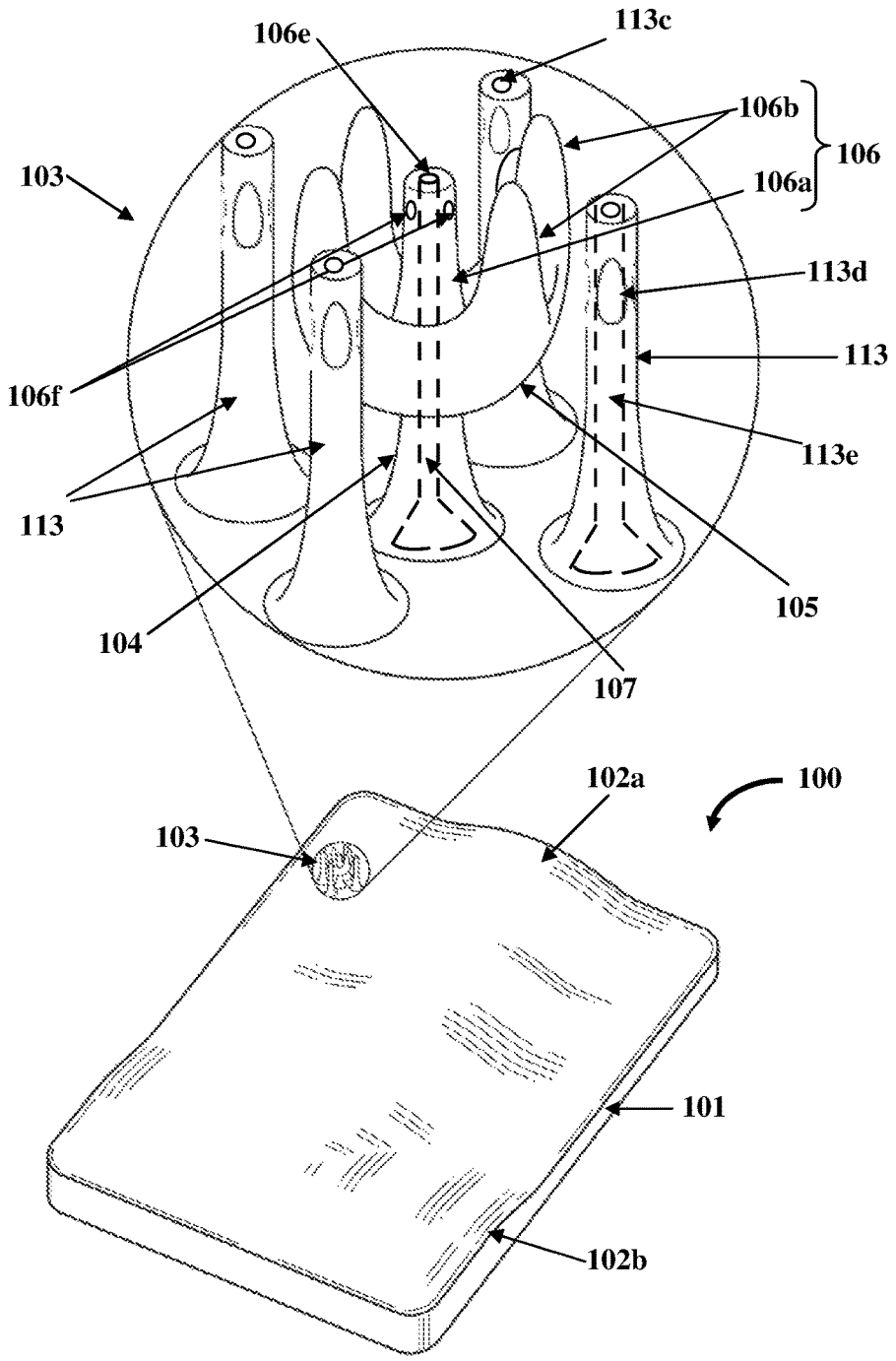
FIG. 23 exemplarily illustrates a front isometric view of an embodiment of the body cleansing apparatus, showing a projected enlarged view of a combination of two types of cleansing members positioned on the base member of the body cleansing apparatus, where each of the cleansing members comprises apertures for dispensing a cleansing agent.

FIG. 23 exemplarily illustrates a front isometric view of an embodiment of the body cleansing apparatus 100, showing a projected enlarged view of a combination of two types of cleansing members 103 positioned on the base member 101 of the body cleansing apparatus 100, where each of the cleansing members 103 comprises apertures 106*e*, 106*f* and 113*c* and 113*d* for dispensing a cleansing agent 1001 exemplarily illustrated in FIG. 10A, FIG. 10C, FIG. 11, and FIG. 13. For example, the cleansing agent 1001 is dispensed from the cavity 107 of the central flexible bristle 106*a* in the cluster 105 and out through the apertures 106*e* and 106*f* of the central flexible bristles 106*a* as disclosed in the detailed description of FIG. 10A and FIG. 11. In an embodiment, the elongate flexible bristle 113 also comprises a cavity 113*e*, in fluid communication with the bladder 108 defined within the base member 101 exemplarily illustrated in FIG. 10A, FIG. 10C, and FIG. 11, for extracting the cleansing agent 1001 stored in the bladder 108, containing, and dispensing the cleansing agent 1001 through one or more apertures 113*c* and 113*d* positioned, for example, on the elongate flexible bristle 113 for cleansing the user's body part, when the user's body part contacts and applies a pressure on the elongate flexible bristle 113.

Figure 24A:
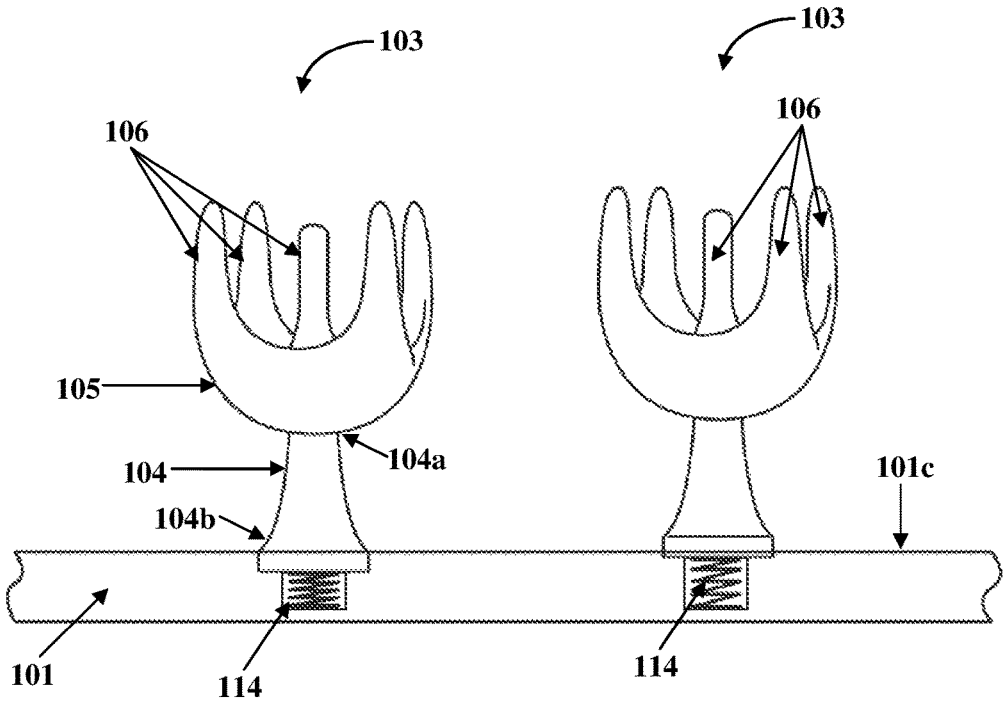
FIGS. 24A-24B exemplarily illustrate an embodiment of the body cleansing apparatus, showing a spring member operably connected to a lower end of each of the cleansing members.
Figure 24B:
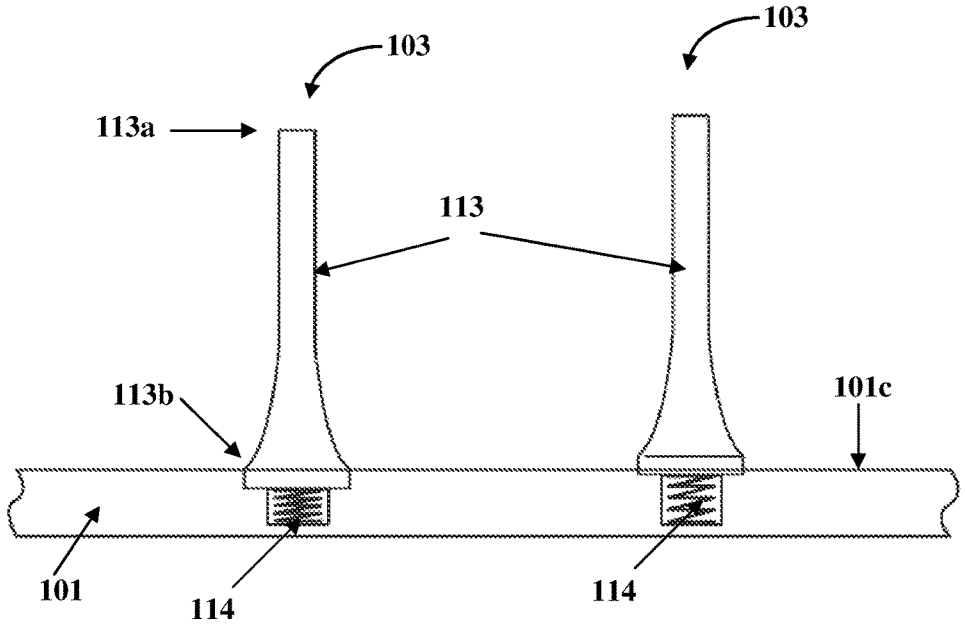

FIGS. 24A-24B exemplarily illustrate an embodiment of the body cleansing apparatus 100 exemplarily illustrated in FIG. 2, showing a spring member 114 operably connected to a lower end 104*b* or 113*b* of each of the cleansing members 103. The lower end 104*b* or 113*b* of each of the cleansing members 103 extends into the base member 101 from the front surface 101*c* of the base member 101. As exemplarily illustrated in FIG. 24A, the spring member 114 is operably connected to the lower end 104*b* of the stem 104 of each of the cleansing members 103. As exemplarily illustrated in FIG. 24B, the spring member 114 is operably connected to the lower end 113*b* of each of the single elongate flexible bristles 113. The spring member 114 enables flexible movement of each of the cleansing members 103 during cleansing of the user's body part.

Figure 25:
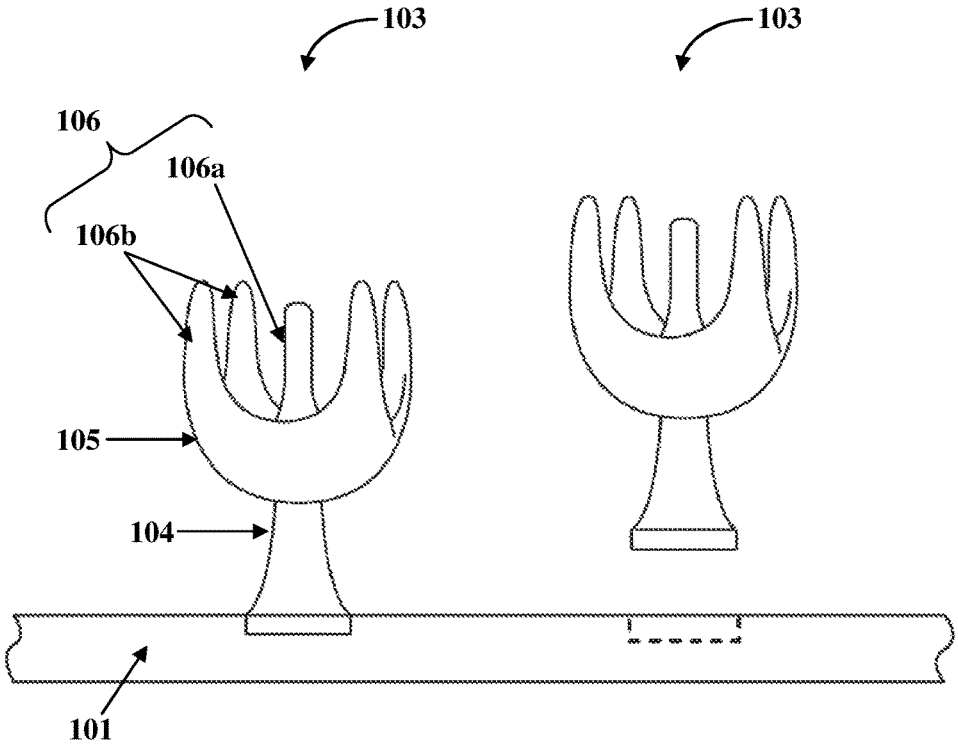
FIG. 25 exemplarily illustrates an embodiment of the body cleansing apparatus, showing a cleansing member detachably attachable to the base member.

FIG. 25 exemplarily illustrates an embodiment of the body cleansing apparatus 100 exemplarily illustrated in FIG. 2, showing a cleansing member 103 detachably attachable to the base member 101. In an embodiment, one or more of the cleansing members 103 are detachably attachable to one or more of multiple locations on one or more contoured profiles 102*a* and 102*b* of the base member 101 exemplarily illustrated in FIGS. 1-2 and FIGS. 4-6, for allowing the user to flexibly configure the cleansing members 103 on the base member 101 for the cleansing of the user's body part. For example, the user may attach multiple cleansing members 103 on the central contoured profile 102*a* to particularly clean the posterior curvature of the user's back. A user may detach one or more of the cleansing members 103 and attach them to another contoured profile 102*a* or 102*b* of the base member 101, for example, using glue, suction cups, etc.

Figure 26:
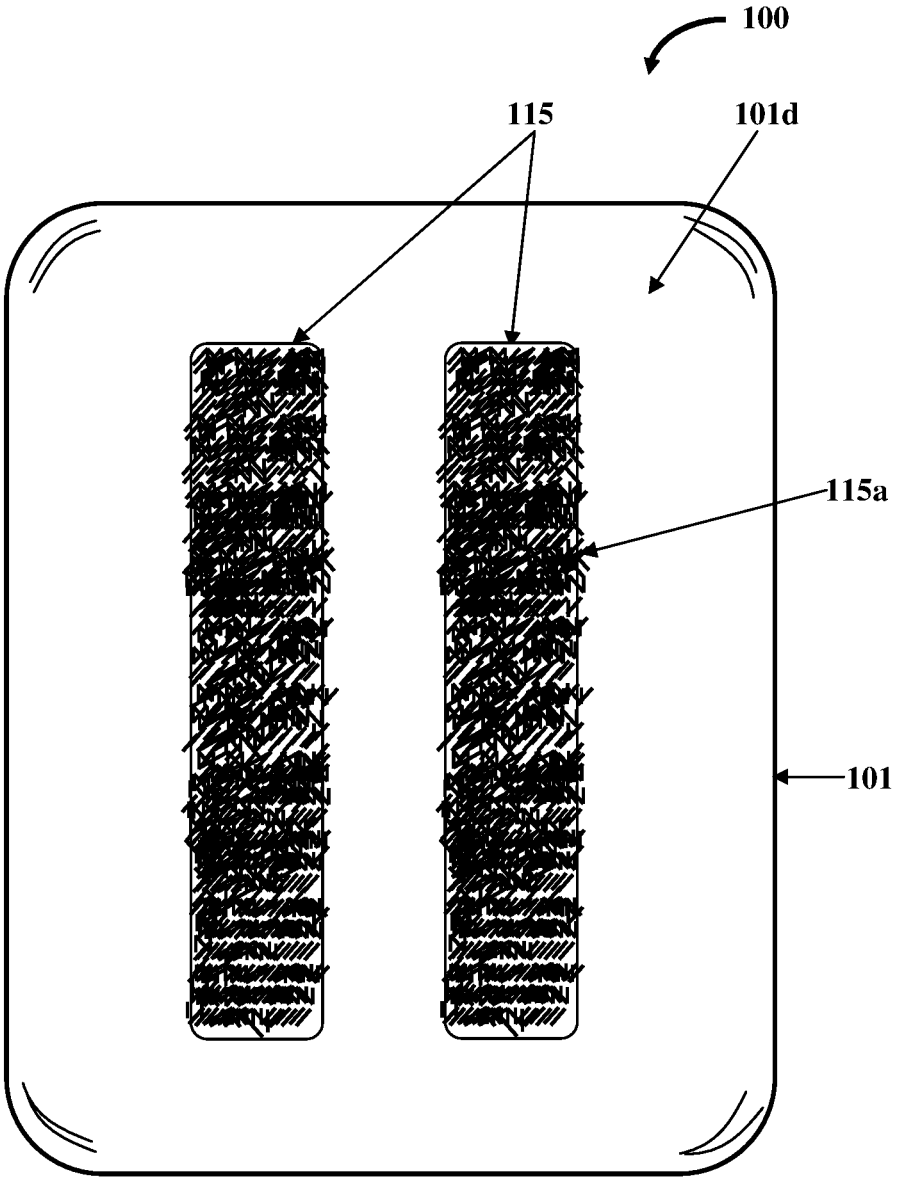
FIG. 26 exemplarily illustrates a rear elevation view of the body cleansing apparatus, showing fasteners attached to a rear surface of the base member for detachably attaching the body cleansing apparatus to a support structure.
Figure 27:
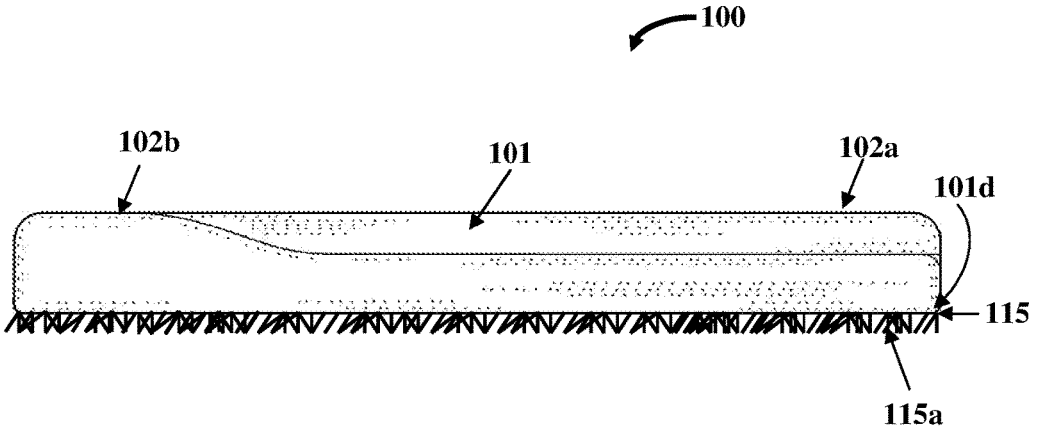
FIG. 27 exemplarily illustrates a right side elevation view of the body cleansing apparatus, showing fasteners attached to the rear surface of the base member for detachably attaching the body cleansing apparatus to a support structure.
Figure 28:
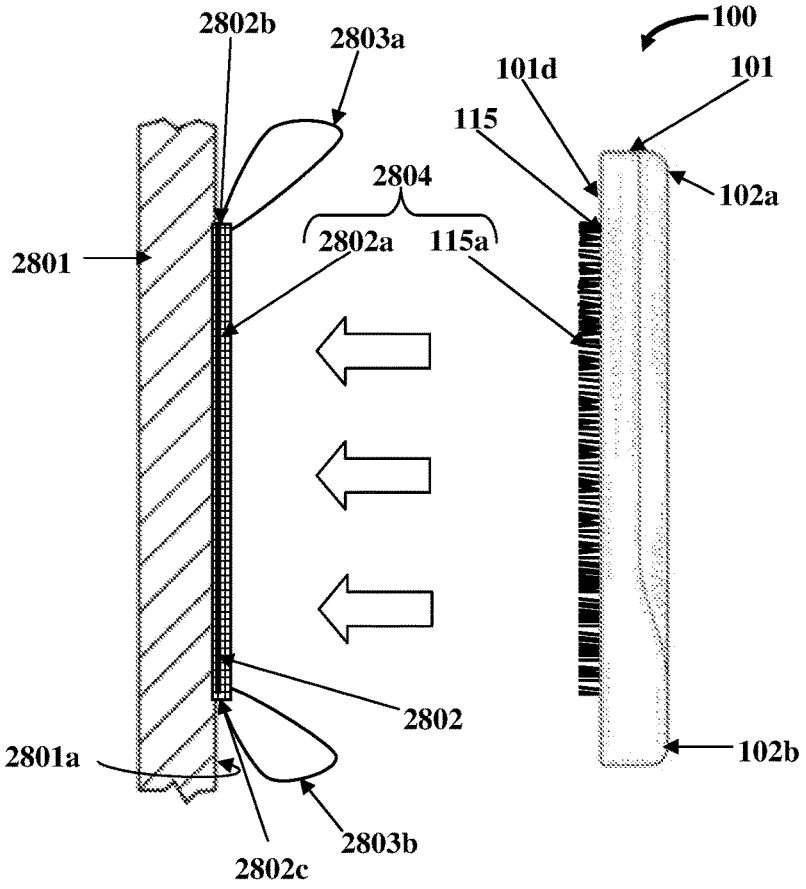
FIG. 28 exemplarily illustrates attachment of the body cleansing apparatus to a support structure using fasteners.

FIGS. 26-27 exemplarily illustrate a rear elevation view and a right side elevation view respectively, of the body cleansing apparatus 100, showing fasteners, for example, 115*a* attached to the rear surface 101*d* of the base member 101 for detachably attaching the body cleansing apparatus 100 to a support structure 2801 exemplarily illustrated in FIG. 28. In an example, strips 115 of hook sides or loop sides 115*a* of hook and loop fasteners 2804 exemplarily illustrated in FIG. 28, such as Velcro® of Velcro Industries B. V. LLC, Netherlands, are used for detachably attaching the rear surface 101*d* of the base member 101 of the body cleansing apparatus 100 to a support structure 2801, for example, a wall of a bathroom. In an embodiment, the strips 115 of the hook sides or loop sides 115*a* of the hook and loop fasteners 2804 are made of, for example, nylon, plastic, etc., with a height of, for example, about 26.5 inches, and a width of, for example, about 1.63 inches. The strips 115 are positioned, for example, at about 5.5 inches from the sides of the base member 101 with a gap of about 7.75 inches between the strips 115. The hook and loop fasteners 2804 comprise hook sides 2802*a* and loop sides 115*a* as exemplarily illustrated in FIG. 28. The hook sides 2802*a* or the loop sides 115*a* of the hook and loop fasteners 2804 are affixed on the rear surface 101*d* of the base member 101, while an opposing one of the hook sides 2802*a* or the loop sides 115*a* of the hook and loop fasteners 2804 are attached to the support structure 2801 for allowing the detachable attachment of the body cleansing apparatus 100 to the support structure 2801. For example, if the loop sides 115*a* of the hook and loop fasteners 2804 are affixed on the rear surface 101*d* of the base member 101 as exemplarily illustrated in FIGS. 26-28, the hook sides 2802*a* of the hook and loop fasteners 2804 are attached to the support structure 2801 and vice versa as exemplarily illustrated in FIG. 28. The strips 115 of the loop sides 115*a* of the hook and loop fasteners 2804 are affixed on the rear surface 101*d* of the base member 101, for example, by sewing, using adhesives, etc.

FIG. 28 exemplarily illustrates attachment of the body cleansing apparatus 100 to a support structure 2801 using fasteners 2804. As exemplarily illustrated in FIG. 28, strips 2802 of the hook sides 2802*a* of the hook and loop fasteners 2804 are attached to the support structure 2801, for example, a wall. The corresponding loop sides 115*a* of the hook and loop fasteners 2804 are attached to the rear surface 101*d* of the base member 101 of the body cleansing apparatus 100. A user may apply a pressure and push the rear surface 101*d* of the base member 101 having the loop sides 115*a* of the hook and loop fasteners 2804 against the hook sides 2802*a* of the hook and loop fasteners 2804 on the support structure 2801 to attach the body cleansing apparatus 100 to the support structure 2801. In an embodiment, the strips 2802 on the support structure 2801 further comprise opposing loop extensions 2803*a* and 2803*b* positioned at opposing ends 2802*b* and 2802*c* of the strips 2802 respectively. The opposing loop extensions 2803*a* and 2803*b* facilitate removal of the loop sides 115*a* of the hook and loop fasteners 2804 attached to the rear surface 101*d* of the base member 101 from the hook sides 2802*a* of the hook and loop fasteners 2804 attached to the front surface 2801*a* of the support structure 2801, that is, to allow a user to grasp the opposing loop extensions 2803*a* and 2802*b* and detach the body cleansing apparatus 100 from the support structure 2801. The strips 2802 of the hook sides 2802*a* of the hook and loop fasteners 2804 are, for example, about ½ inch nylon strips glued to the support structure 2801. In an example, when the user wants to relocate the body cleansing apparatus 100, the user can easily remove the strips 2802 from the support structure 2801, for example, a bathroom wall, without removing any tiles or without damaging the support structure 2801. The user may insert a screw driver through each of the opposing loops 2803 to remove the strips 2802 from the support structure 2801.

In an embodiment, fasteners, for example, vacuum chucks, suction cups, etc., are also used for detachably attaching the body cleansing apparatus 100 to the support structure 2801. The fasteners, for example, suction cups, on the rear surface 101*d* of the base member 101 of the body cleansing apparatus 100 engage the support structure 2801 and create suction between the suction cups and the support structure 2801 to mount the body cleansing apparatus 100 to the support structure 2801. In an example, four suction cups positioned proximal to the four corners of the base member 101 detachably attach the base member 101 of the body cleansing apparatus 100 to a bathroom wall. The suction cups hold the body cleansing apparatus 100 rigidly against the wall of the bathroom.

Figure 29:
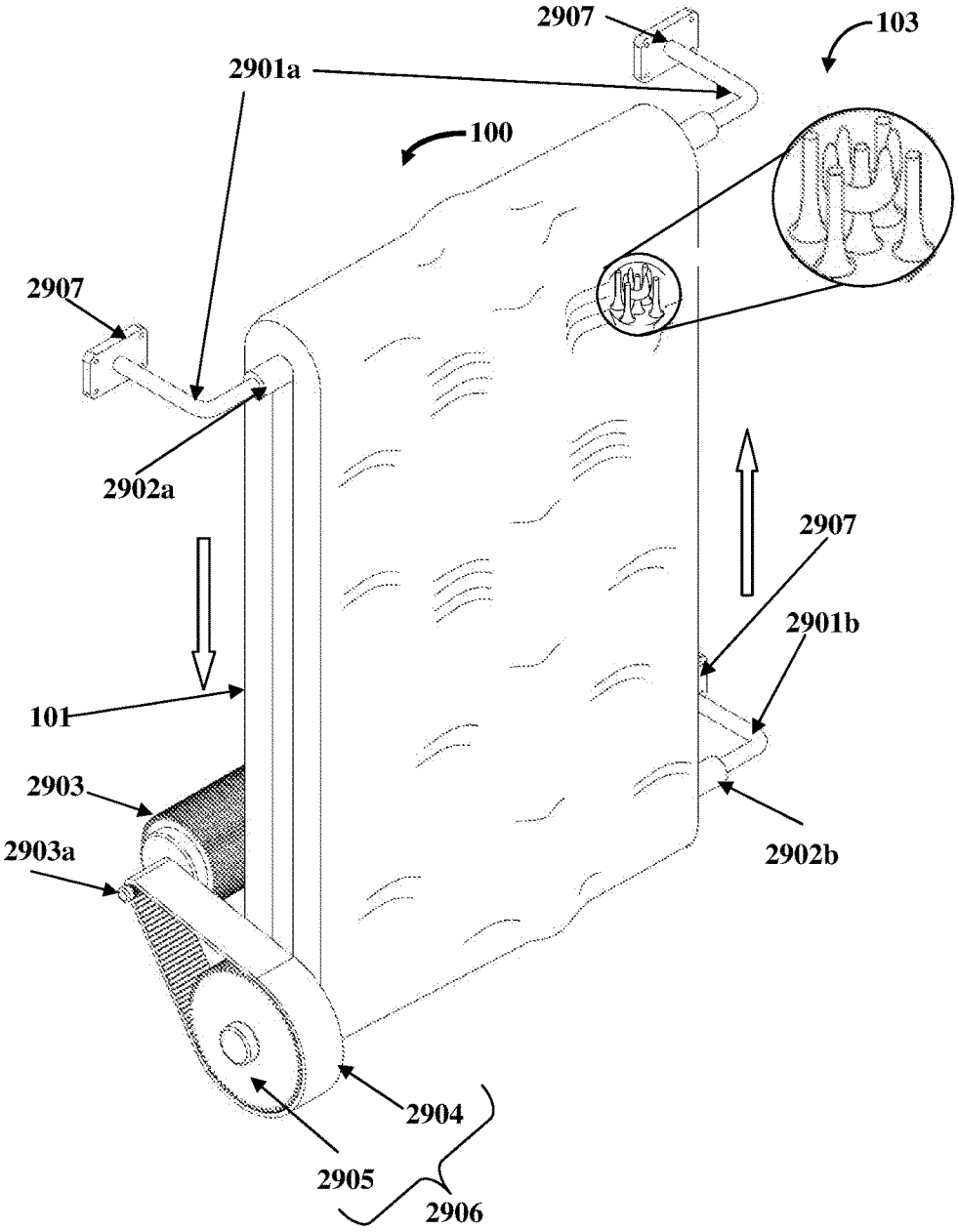
FIG. 29 exemplarily illustrates an embodiment of the body cleansing apparatus, showing the body cleansing apparatus rollably wrapped around spaced apart elongate rods.

FIG. 29 exemplarily illustrates an embodiment of the body cleansing apparatus 100, showing the body cleansing apparatus 100 rollably wrapped around spaced apart elongate rods 2901*a* and 2901*b*. In an embodiment, the elongate rods 2901*a* and 2901*b* are spaced apart and horizontally attached to a support structure 2801, for example, a wall exemplarily illustrated in FIG. 28, using fasteners 2907. In this embodiment, elongate rollers 2902*a* and 2902*b* are coaxially disposed around the elongate rods 2901*a* and 2901*b* respectively. The body cleansing apparatus 100 is configured to slidably roll over the elongate rollers 2902*a* and 2902*b*. A motor 2903 and a belt driven wheel assembly 2906 are also provided in this embodiment. The belt driven wheel assembly 2906 is operably connected to one of the elongate rollers 2902*a* and 2902*b*, for example, the lower elongate roller 2902*b* for rolling the body cleansing apparatus 100 over the elongate rollers 2902*a* and 2902*b* and enhancing the cleansing of the user's body part. The belt driven wheel assembly 2906 comprises a reduction gear wheel 2905 and a belt drive 2904. A shaft 2903*a* of the motor 2903 is operably connected to the belt drive 2904 that is disposed around the reduction gear wheel 2905. The reduction gear wheel 2905 is operably connected to one of the elongate rollers 2902*a* and 2902*b*, for example, the lower elongate roller 2902*b*. When the motor 2903 is activated or powered on, the shaft 2903*a* of the motor 2903 rotates and transmits a torque to the reduction gear wheel 2905 through the belt drive 2904. The reduction gear wheel 2905 transmits the torque to the lower elongate roller 2902*b*, which rolls and causes the body cleansing apparatus 100 to slidably roll over the elongate rollers 2902*a* and 2902*b*. In an embodiment, a control unit (not shown) operably connected to the motor 2903 and the belt driven wheel assembly 2906 is used to control and change the direction of rolling of the body cleansing apparatus 100 to create a timed upward and downward rolling motion of the body cleansing apparatus 100. The upward and downward rolling motion of the body cleansing apparatus 100 allows the user to stand still and clean his/her back without any effort. A switch (not shown) is provided to operate the motor 2903 to produce a driving torque that rolls the body cleansing apparatus 100.

Figure 30:
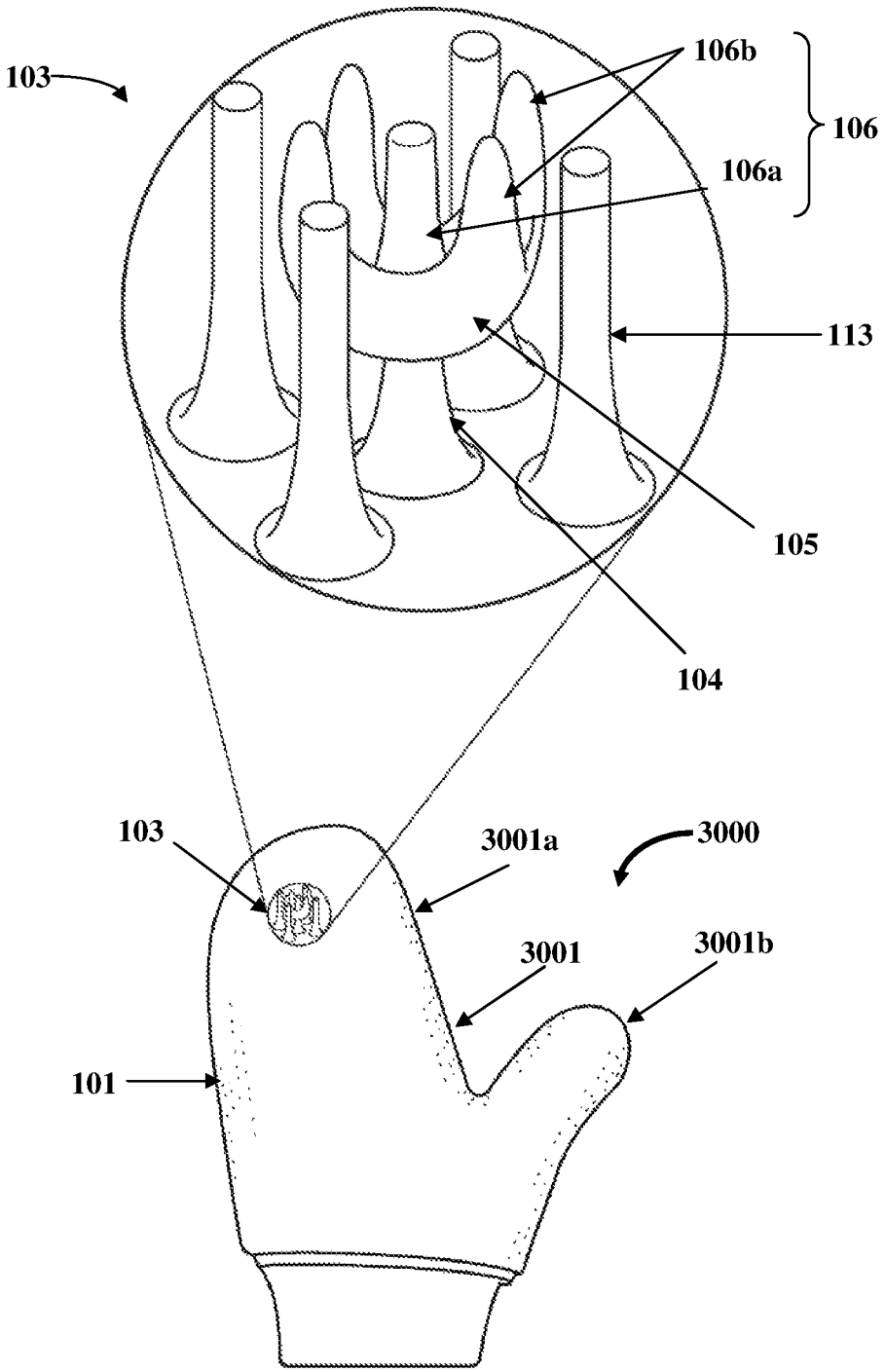
FIG. 30 exemplarily illustrates an embodiment of the body cleansing apparatus, showing the base member configured as a wearable unit that conforms to a hand of a user.

FIG. 30 exemplarily illustrates an embodiment of the body cleansing apparatus 3000, showing the base member 101 configured as a wearable unit 3001 that conforms to a hand of a user. The wearable unit 3001 is shaped, for example, as a mitten or a glove. In this embodiment, the wearable unit 3001 comprises a chamber 3002 exemplarily illustrated in FIG. 31, for accommodating the user's hand. In an embodiment, the wearable unit 3001 comprises a single sheath 3001*a* for enclosing the user's fingers and a thumb sheath 3001*b* for enclosing the user's thumb. In another embodiment, the wearable unit 3001 comprises individual finger sheaths (not shown) for enclosing the user's fingers, and a thumb sheath 3001*b* for enclosing the user's thumb. In an embodiment, the wearable unit 3001 comprises a selectively textured surface with varying levels of texture. For example, the wearable unit 3001 may have a roughened texture to aid in exfoliation during cleansing of a user's body part, a medium texture for comfortable use during cleansing of the user's body part, a smooth texture for providing a smooth feel to the user, etc., depending upon the skin characteristics of the user. As exemplarily illustrated in FIG. 30, different cleansing members 103, for example, the single elongate flexible bristles 113 along with the clusters 105 of flexible bristles 106 are positioned and attached at multiple locations on the wearable unit 3001. The wearable unit 3001 allows the user to clean accessible parts of the user's body.

In an embodiment, the wearable unit 3001 comprises a loop element (not shown) for suspending or hanging the wearable unit 3001, for example, on a hook (not shown) on a support structure 2801, for example, a wall of a bathroom exemplarily illustrated in FIG. 28, when the wearable unit 3001 is not in use. In an embodiment, the loop element is stitched on the wearable unit 3001 or detachably attached to the wearable unit 3001.

Figure 31:
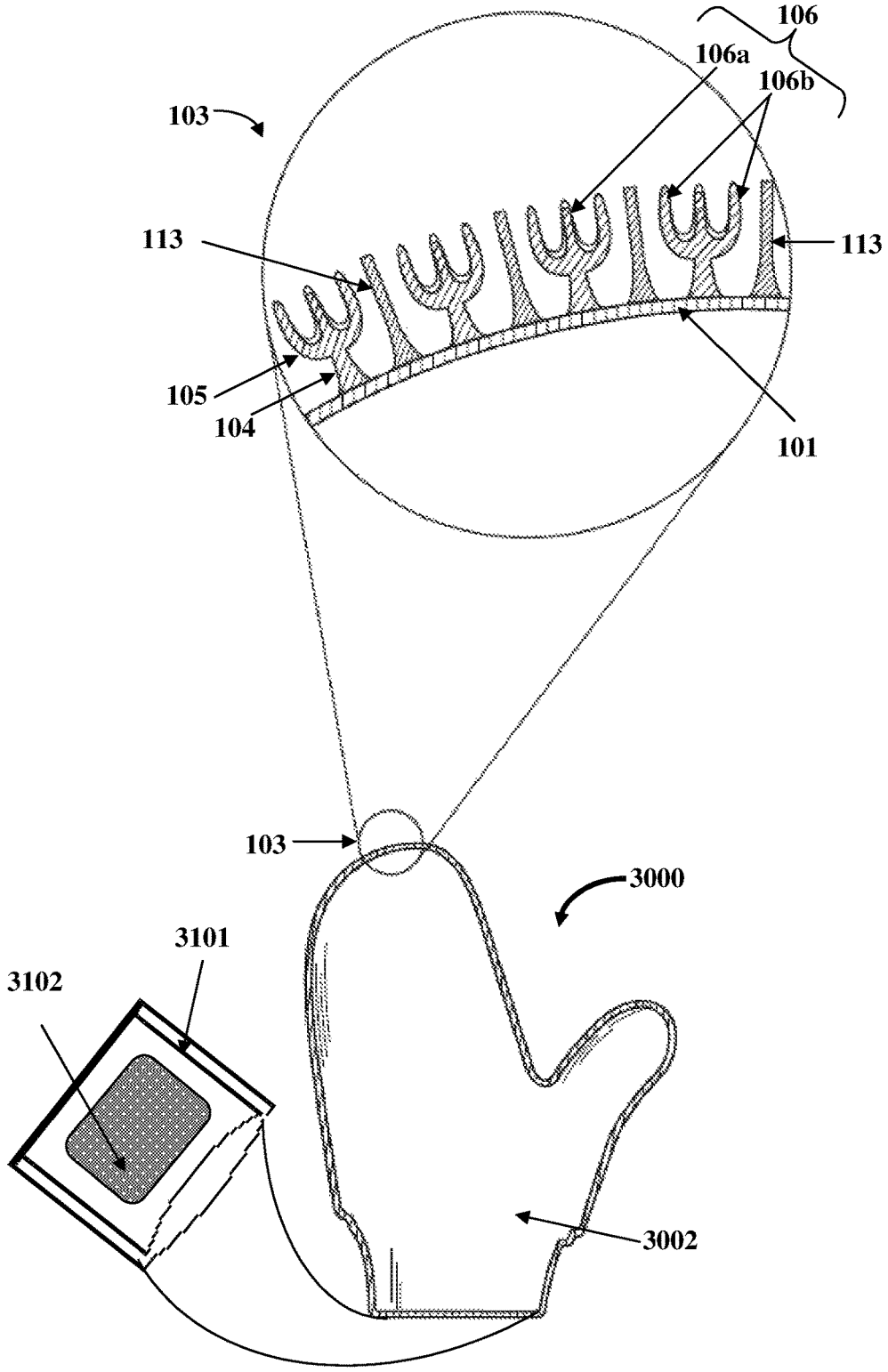
FIG. 31 exemplarily illustrates a sectional view of the embodiment of the body cleansing apparatus shown in FIG. 30, showing an insert member extending outwardly from the wearable unit and containing a cleansing agent.

FIG. 31 exemplarily illustrates a sectional view of the embodiment of the body cleansing apparatus 3000 shown in FIG. 30, showing an insert member 3101 extending outwardly from the wearable unit 3001 and containing a cleansing agent 3102, for example, soap. The insert member 3101 is made of, for example, a breathable fabric. The insert member 3101 containing the cleansing agent 3102 is foldable into the chamber 3002 of the wearable unit 3001. The insert member 3101 is configured for right handed users and left handed users. The user inserts a hand into the chamber 3002 of the wearable unit 3001 and folds the insert member 3101 containing the cleansing agent 3102 into the chamber 3002 of the wearable unit 3001 for cleansing the user's body by release of the cleansing agent 3102 through the wearable unit 3001. In an embodiment, the wearable unit 3001 is selectively composed of a scrubbing material, for example, a spongy foam material. The cleansing agent 3102 permeates through the scrubbing material of the wearable unit 3001 for cleansing the user's body.

Figure 32:
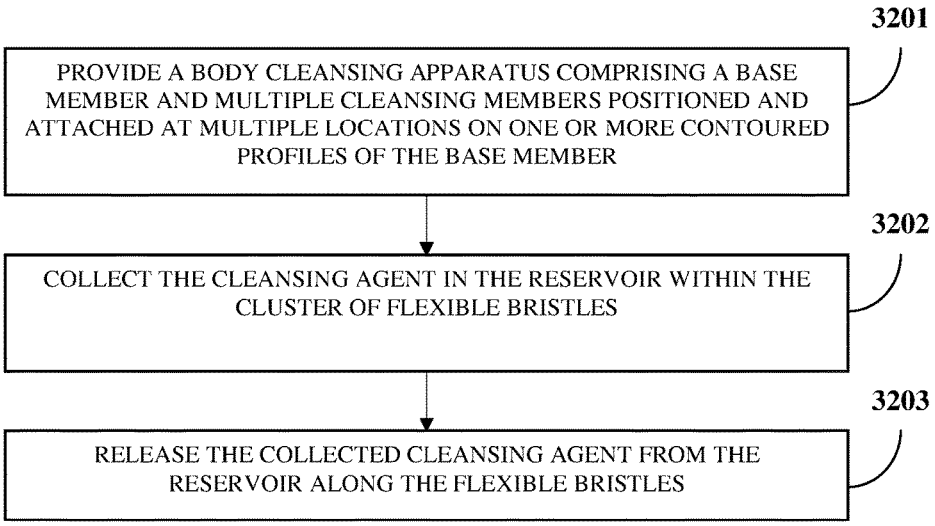
FIG. 32 exemplarily illustrates a method for cleansing a body part of a user.

FIG. 32 exemplarily illustrates a method for cleansing a body part of a user. A body cleansing apparatus 100 or 3000 comprising a base member 101 and cleansing members 103, for example, a combination of single elongate flexible bristles 113 and clusters 105 of flexible bristles 106 positioned and attached at multiple locations on one or more contoured profiles 102*a* and 102*b* of the base member 101 as exemplarily illustrated and as disclosed in the detailed description of FIGS. 1-31 is provided 3201. A cleansing agent 1001 is collected 3202 in the reservoir 110, exemplarily illustrated in FIGS. 12A-12B, FIG. 13, and FIGS. 15-16, within the cluster 105 of flexible bristles 106 and 113. The collected cleansing agent 1001 is released 3203 from the reservoir 110 along the flexible bristles 106 and 113, when the user's body part contacts and applies a pressure on the stems 104 of the cleansing members 103 for cleansing the body part. The flexible bristles 106 and 113 coated with the contained cleansing agent 1001 cleanse the user's body part when the user's body part contacts and applies a pressure on the flexible bristles 106 and 113.

The flexibility and firmness of the flexible bristles 106 and 113 are controlled by the length of entasis or the contoured profiles 102*a* and 102*b* of the base member 101. The body cleansing apparatus 100 or 3000 is manufactured, for example, by an injection molding process. The thickness of the lower ends 104*b* and 113*b* of the stems 104 and the single elongate flexible bristles 113 and at the tips 106*c*, 106*d* and 113*a* of the flexible bristles 106 and 113 respectively, is controlled by controlling temperature of the dies and the characteristics of rubber or other flexible materials used in manufacturing the flexible bristles 106 and 113. To expedite the process of manufacturing the body cleansing apparatus 100 or 3000, refrigerated dies driven by hydraulics and a programmable controller (not shown) are used, thereby enabling manufacture of at least one body cleansing apparatus 100 or 3000 every three seconds. In an embodiment, a manufacturing apparatus (not shown) is provided for manufacturing the body cleansing apparatus 100 or 3000 disclosed herein.

The body cleansing apparatus 100 or 3000 is cleaned, for example, using a dishwasher, a washing machine, etc. In an example, the body cleansing apparatus 100 can be detached from the support structure 2801 exemplarily illustrated in FIG. 28, rolled, and then placed in the dishwasher. The body cleansing apparatus 100 or 3000 may also be cleaned using a brush and hot water, while being attached to the support structure 2801.

In an embodiment, the body cleansing apparatuses 100 and 3000 exemplarily illustrated in FIG. 1 and FIG. 30 respectively are provided in a cleansing kit. The cleansing kit disclosed herein comprises supplementary elements, for example, a non-slippage mat (not shown) having a matt surface, cleansing agents 1001 and 3102, etc. The non-slippage mat provides grip to the user during cleansing. The non-slippage mat is positioned directly in front of the wall attached body cleansing apparatus 100 on a surface, for example, a base of a bath tub, where the user stands to prevent slippage during cleansing. The non-slippage mat is made of a slip resistant material and can be adhered to the base of the bath tub. The non-slippage mat prevents slippage of the user's feet during bathing. The user stands on the non-slippage mat with the user's back against the body cleansing apparatus 100 and performs an upward and downward movement against the flexible bristles 106 and 113 of the body cleansing apparatus 100 that branch outwardly from the base member 101. In embodiments where the body cleansing apparatus 100 is automated as exemplarily illustrated in FIG. 29 and FIGS. 48-60B, the user can stand still on the non-slippage mat with the user's back against the body cleansing apparatus 100, while the base member 101 comprising the flexible bristles 106 and 113 automatically moves in an upward direction and a downward direction against the user's back for cleansing the user's back. The cleansing kit is provided with cleansing apparatuses 100 and 3000 of different sizes and colors to suit the physical characteristics and preferences of multiple users.

Consider an example where a user utilizes the body cleansing apparatus 100 disclosed herein for cleansing the user's rear body part, that is, the user's back. The user attaches the body cleansing apparatus 100 comprising the base member 101 and multiple clusters 105 of flexible bristles 106 and the single elongate flexible bristles 113 to a support structure 2801, for example, a wall of a bathroom, for example, using hook and loop fasteners 2804 as disclosed in the detailed description of FIG. 28. The rear surface 101*d* of the base member 101 detachably attaches to the wall, while the front surface 101*c* of the base member 101 with the outwardly extending flexible bristles 106 and 113 is exposed for cleansing the user's back. The user applies a cleansing agent 1001, for example, soap lather to the flexible bristles 106 and 113 that extend outwardly from the base member 101 of the body cleansing apparatus 100. The user may also push his/her back against the flexible bristles 106 and 113 to dispense the cleansing agent 1001 from the cavities 107 and 113*e* of each cleansing member 103 through the apertures 106*e*, 106*f* and 113*c*, 113*d* respectively, exemplarily illustrated in FIG. 23. The user then leans the user's back against the flexible bristles 106 and 113 such that the contoured profiles 102*a* and 102*b* of the base member 101 that support the flexible bristles 106 and 113 conform to the posterior curvature of the user's back. When the user applies a pressure on the flexible bristles 106, the cleansing agent 1001 is released from the reservoir 110 defined in each of the flexible bristles 106 onto the flexible bristles 106. On making contact with the flexible bristles 106 and 113, the user performs an upward movement and a downward movement of the user's back against the flexible bristles 106 and 113 coated with the released cleansing agent 1001 for cleansing the user's back. The user may also power the motor 2903 and trigger the rolling motion of the body cleansing apparatus 100 as disclosed in the detailed description of FIG. 29.

The user may also insert a hand into the chamber 3002 of the wearable unit 3001 of the body cleansing apparatus 3000 exemplarily illustrated in FIGS. 30-31, and fold the insert member 3101 containing the cleansing agent 3102 into the chamber 3002 of the wearable unit 3001 for cleansing the user's body by release of the cleansing agent 3102 through the wearable unit 3001. The body cleansing apparatuses 100 and 3000 allow the user to cleanse rear body parts and other body parts that are difficult to access to avoid, for example, oil build up which leads to problems such as acne, itchiness, etc.

Figure 33:
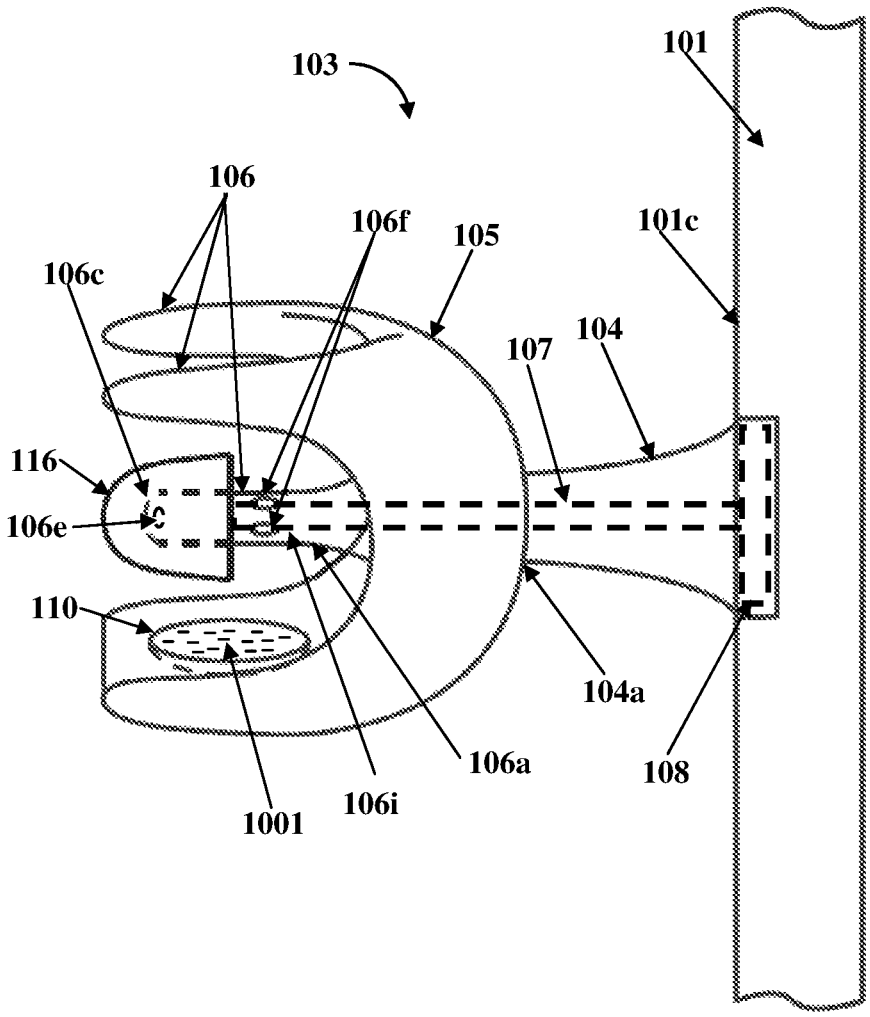
FIG. 33 exemplarily illustrates a side perspective view of an embodiment of the cleansing member attached to the front surface of the base member of the body cleansing apparatus, showing a retention member attached to one of multiple flexible bristles of the cleansing member.

FIG. 33 exemplarily illustrates a side perspective view of an embodiment of the cleansing member 103 attached to the front surface 101*c* of the base member 101 of the body cleansing apparatus 100 exemplarily illustrated in FIG. 2, showing a retention member 116 attached to one of the flexible bristles 106, for example, the central flexible bristle 106*a* of the cleansing member 103. As used herein, "retention member" refers to a porous water absorbent body made of a sponge material, for example, cellulose sponge. The retention member 116 is, for example, a generally round shaped sponge member capable of retaining water or other cleansing agents, for example, at the tip 106*c* of one of the flexible bristles 106, for example, the central flexible bristle 106*a*. As exemplarily illustrated in FIG. 33, the cleansing member 103 comprises a stem 104 and a cluster 105 of flexible bristles 106. The stem 104 is attached to and extends outwardly from the front surface 101*c* of the base member 101. The flexible bristles 106 in the cluster 105 curvedly branch outwards from an upper end 104*a* of the stem 104. In an embodiment, the flexible bristles 106 curvedly branching outwards from the upper end 104*a* of the stem 104 define a reservoir 110 within each cluster 105. The base member 101 further comprises a bladder 108 for storing and containing a cleansing agent 1001, for example, water, a cleaning solution, a cleaning gel, etc. When a body part of the user contacts and applies a pressure on the stem 104 of the cleansing member 103, the stored cleansing agent 1001 is drawn from the bladder 108 through a cavity 107 within the stem 104, that is in fluid communication with the bladder 108, and out through the apertures 106*e* and 106*f* positioned on a body portion 106*i* of, for example, the central flexible bristle 106*a* in the cluster 105.

The reservoir 110 defined by the flexible bristles 106 in the cluster 105 stores and retains the cleansing agent 1001, and releases the cleansing agent 1001 along the flexible bristles 106 when the body part contacts and applies a pressure on the stem 104 of the cleansing member 103. As exemplarily illustrated in FIG. 33, the retention member 116 is detachably attached to a tip 106*c* of the central flexible bristle 106*a* of the cluster 105. The retention member 116 retains the cleansing agent 1001 proximal to the tip 106*c* of the central flexible bristle 106*a* and cleanses the user's body part when the user's body part contacts and applies a pressure on the central flexible bristle 106*a*. Therefore, the flexible bristles 106 coated with the cleansing agent 1001, and the retention member 116 retaining the cleansing agent 1001 proximal to the tip 106*c* of the central flexible bristle 106*a* allow the user to cleanse the body part when the body part contacts and applies a pressure on the flexible bristles 106.

Figure 34:
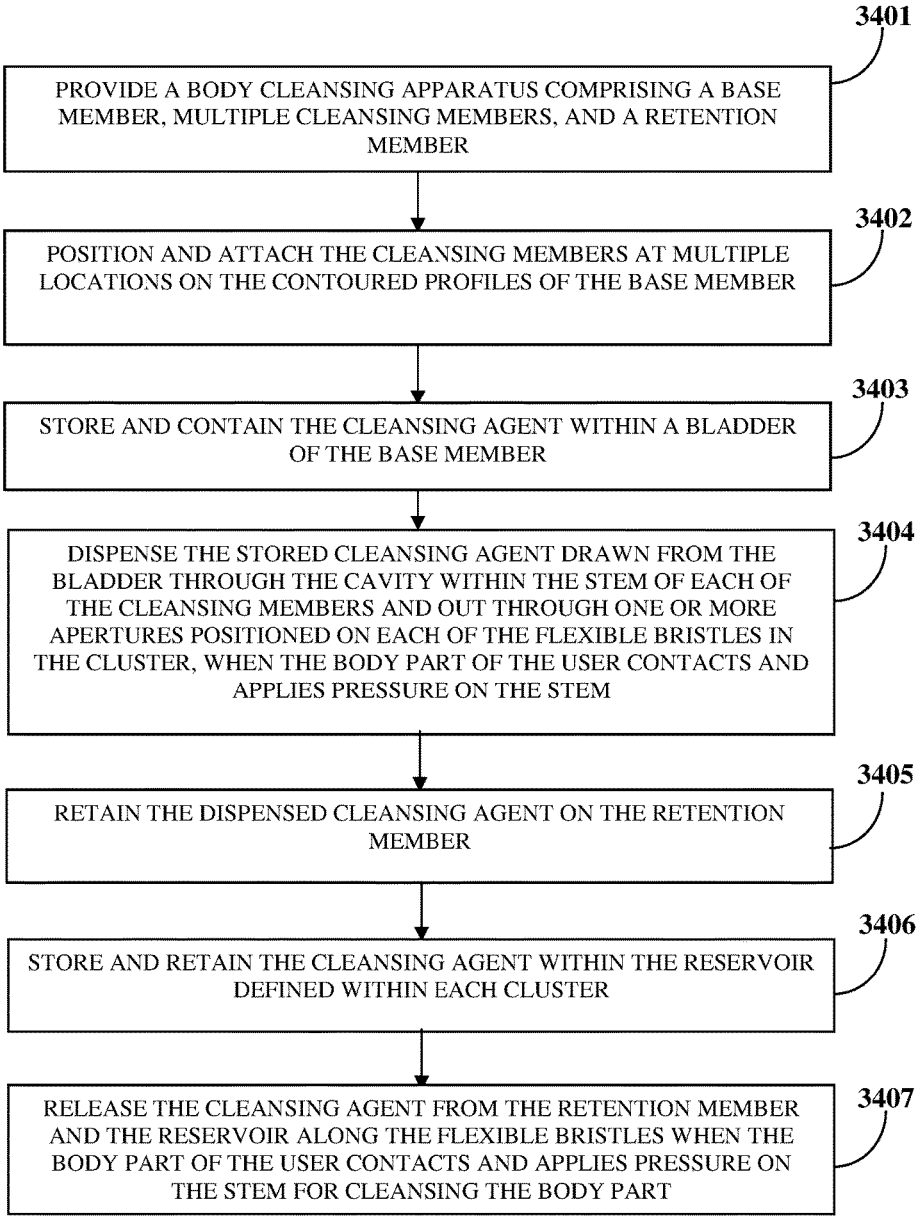
FIG. 34 exemplarily illustrates an embodiment of the method for cleansing a body part of a user.

FIG. 34 exemplarily illustrates an embodiment of the method for cleansing a body part of a user. The body cleansing apparatus 100 comprising the base member 101, multiple cleansing members 103, and the retention member 116 as exemplarily illustrated in FIG. 33 and as disclosed in the detailed description of FIG. 33, is provided in method step 3401. In method step 3402, the cleansing members 103 are positioned and attached at multiple locations on one or more of the contoured profiles 102*a* and 102*b* of the base member 101 exemplarily illustrated in FIGS. 1-2, FIGS. 3A-3B, and FIGS. 4-6. In method step 3403, the bladder 108 of the base member 101 stores and contains the cleansing agent 1001 exemplarily illustrated in FIG. 33. In method step 3404, the bladder 108 dispenses the stored cleansing agent 1001 through the cavity 107 within the stem 104 of each of the cleansing members 103, and out through the apertures 106*e* and 106*f* positioned on each of the flexible bristles 106 in the cluster 105 exemplarily illustrated in FIG. 33, when the user's body part contacts and applies a pressure on the stem 104. In method step 3405, the retention member 116 retains the dispensed cleansing agent 1001 proximal to the tip 106*c* of a flexible bristle, for example, the central flexible bristle 106*a* exemplarily illustrated in FIG. 33. In method step 3406, the reservoir 110 defined within each of the clusters 105 stores and retains the cleansing agent 1001. In method step 3407 the retention member 116 and the reservoir 110 release the cleansing agent 1001 along the flexible bristles 106 when the user's body part contacts and applies a pressure on the stem 104 for cleansing the body part.

Figure 35A:
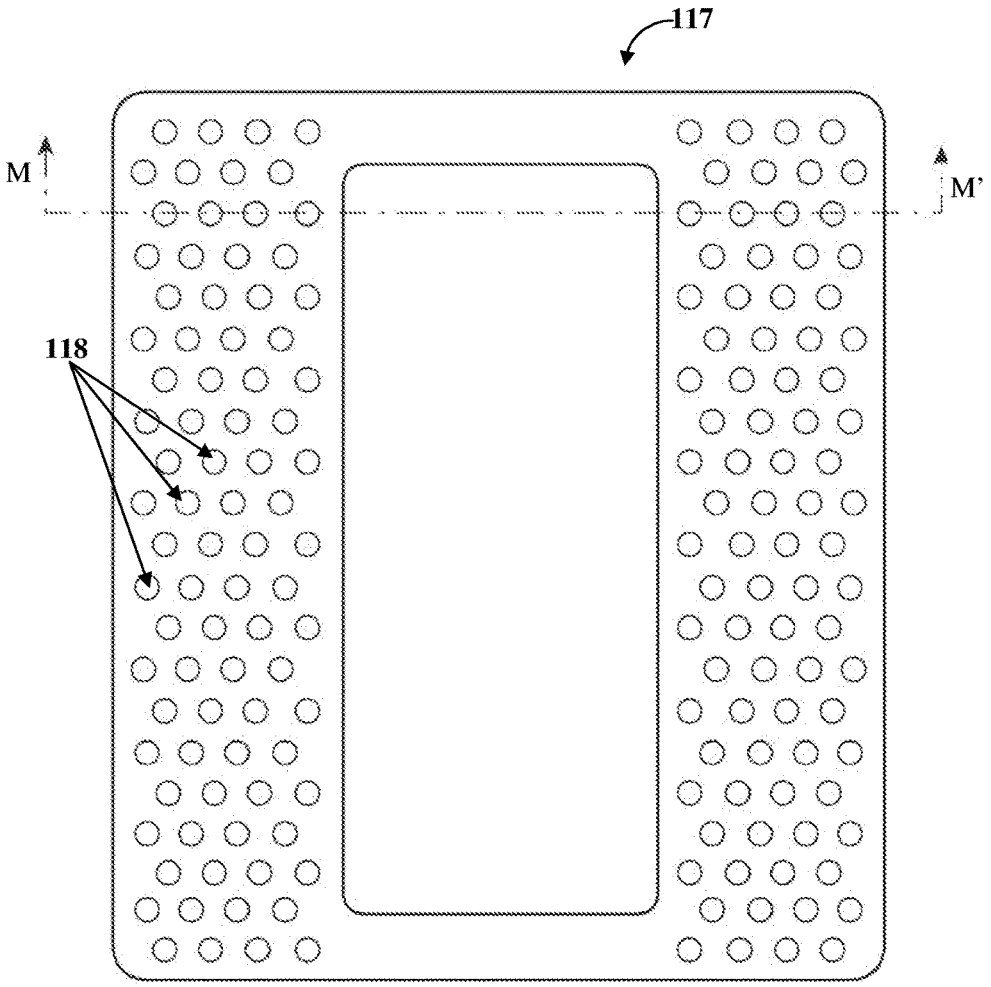
FIG. 35A exemplarily illustrates a front elevation view of a retention member of an embodiment of the cleansing member, showing multiple cavities of the retention member.
Figure 35B:
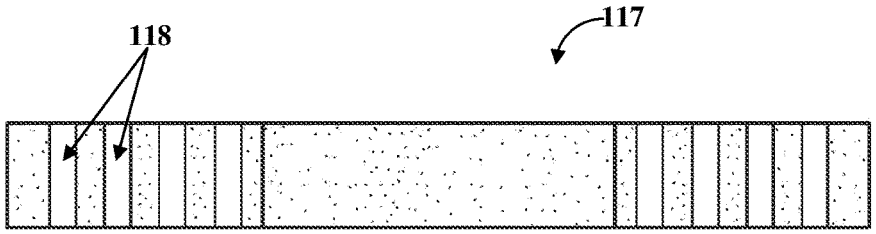
FIG. 35B exemplarily illustrates a sectional view of the retention member taken along a section M-M' of FIG. 35A, showing multiple cavities of the retention member.
Figure 35C:
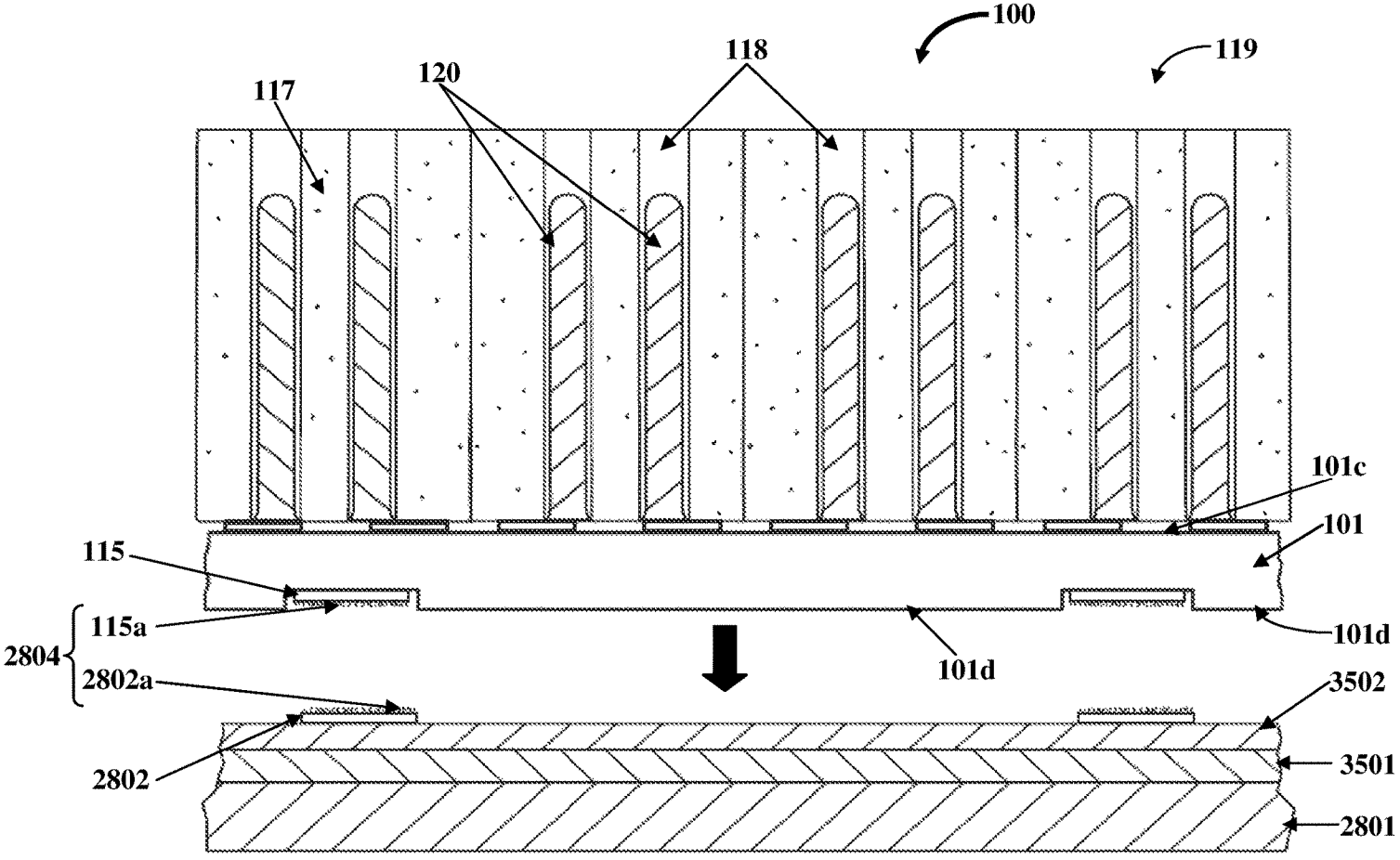
FIG. 35C exemplarily illustrates a partial sectional view of an embodiment of the body cleansing apparatus detachably attachable to a support structure, showing the cleansing member comprising the retention member and multiple flexible bristles attached to the base member.

FIG. 35A exemplarily illustrates a front elevation view of a retention member 117 of an embodiment of the cleansing member 119 exemplarily illustrated in FIG. 35C, showing multiple cavities 118 of the retention member 117, and FIG. 35B exemplarily illustrates a sectional view of the retention member 117 taken along a section M-M' of FIG. 35A, showing multiple cavities 118 of the retention member 117.

FIG. 35C exemplarily illustrates a partial sectional view of an embodiment of the body cleansing apparatus 100 detachably attachable to a support structure 2801, showing the cleansing member 119 comprising the retention member 117 and multiple flexible bristles 120 attached to the base member 101. In this embodiment, the cleansing member 119 comprises the retention member 117, for example, made of a sponge material such as a silicone rubber material, and flexible bristles 120 positioned within the retention member 117. The retention member 117 is fixedly attached to the front surface 101*c* of the base member 101. The thickness of the retention member 117 is, for example, about 1 inch to about 1.25 inches. In an embodiment, the thickness of the retention member 117 is, for example, about 3 inches. The retention member 117 is configured to retain a cleansing agent 1001 exemplarily illustrated in FIG. 33, dispensed on the retention member 117. The retention member 117 comprises multiple cavities 118 for accommodating multiple flexible bristles 120. The flexible bristles 120 are fixedly attached to the front surface 101*c* of the base member 101 and positioned within the cavities 118 of the retention member 117. In an embodiment, the flexible bristles 120 are of predetermined or configurable dimensions. The flexible bristles 120 and the retention member 117 cleanse a user's body part when the body part contacts and applies a pressure on the flexible bristles 120 and the retention member 117.

The base member 101 is detachably attachable to the support structure 2801 by one or more fasteners, for example, 2804 exemplarily illustrated in FIG. 35C. The support structure 2801, for example, a bathroom wall has two outer layers comprising a green board dry wall 3501 and a tile surface 3502. In an embodiment, the fasteners are hook and loop fasteners 2804 comprising hook sides 2802*a* and loop sides 115*a*. As exemplarily illustrated in FIG. 35C, the loop sides 115*a* of the hook and loop fasteners 2804 are affixed on the rear surface 101*d* of the base member 101, while the hook sides 2802*a* of the hook and loop fasteners 2804 are attached to the support structure 2801 for allowing a detachable attachment of the body cleansing apparatus 100 to the support structure 2801. In an embodiment, the hook sides 2802*a* and the loop sides 115*a* of the hook and loop fasteners 2804 are configured on strips 2802 and 115 respectively. The hook and loop fasteners 2804 have a width of, for example, about 2 inches.

Figure 36A:
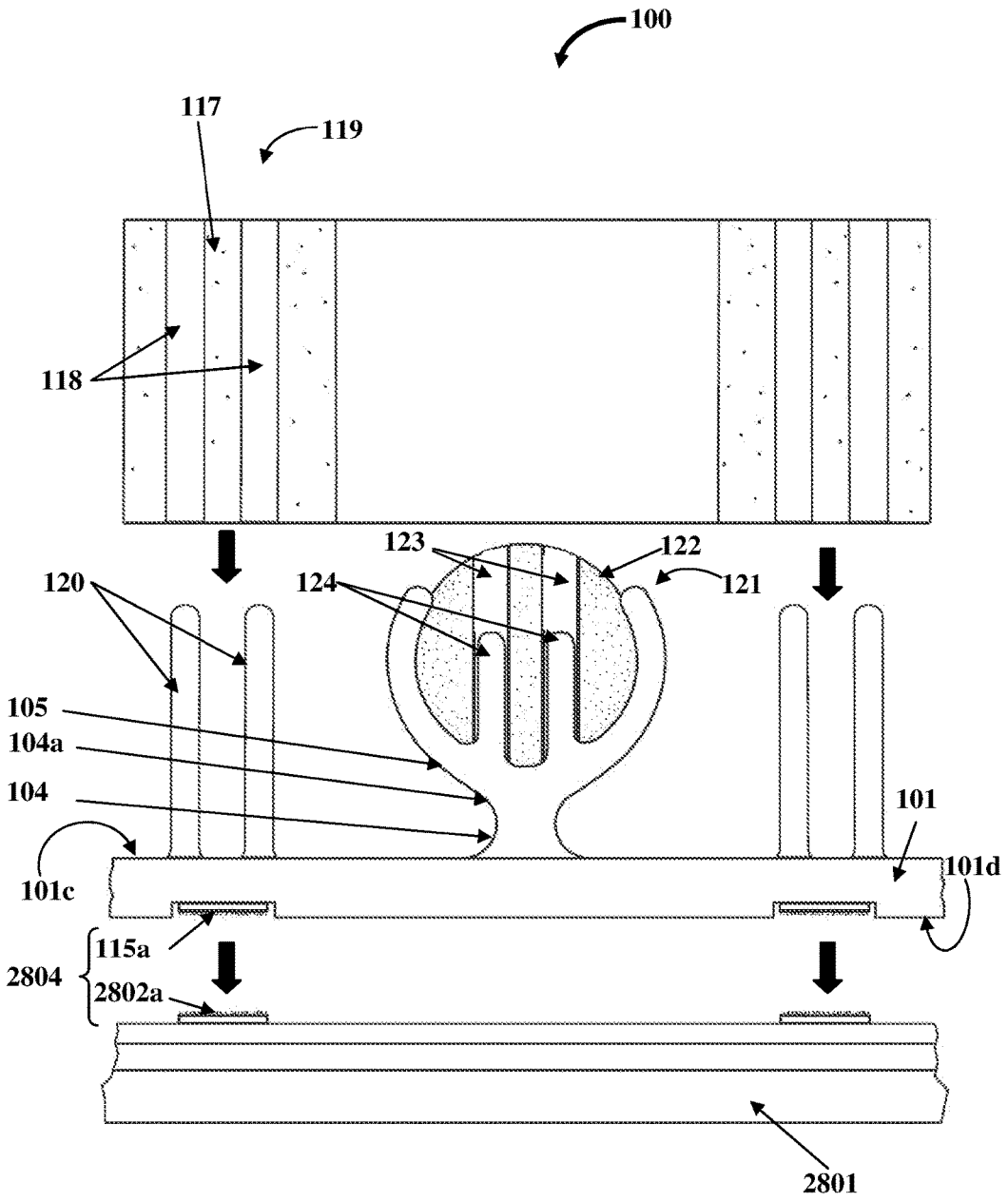
FIG. 36A exemplarily illustrates a disassembled, partial sectional view of an embodiment of the body cleansing apparatus detachably attachable to a support structure, showing a combination of cleansing members attachable to the base member.

FIG. 36A exemplarily illustrates a disassembled, partial sectional view of an embodiment of the body cleansing apparatus 100 detachably attachable to a support structure 2801, showing a combination of cleansing members 119 and 121 attachable to the base member 101. In this embodiment, the body cleansing apparatus 100 comprises a first cleansing member 119 and a second cleansing member 121. The first cleansing member 119 comprises the retention member 117 with cavities 118 therewithin for receiving the flexible bristles 120 affixed on the front surface 101*c* of the base member 101. The retention member 117 of the first cleansing member 119 is, for example, of a rectangular shape. The second cleansing member 121 comprises a retention member 122 comprising one or more cavities 123 configured to receive the central flexible bristles 124 of the second cleansing member 121 as disclosed in the detailed description of FIG. 38. The retention member 122 of the second cleansing member 121 is, for example, of a substantially spherical shape.

Figure 36B:
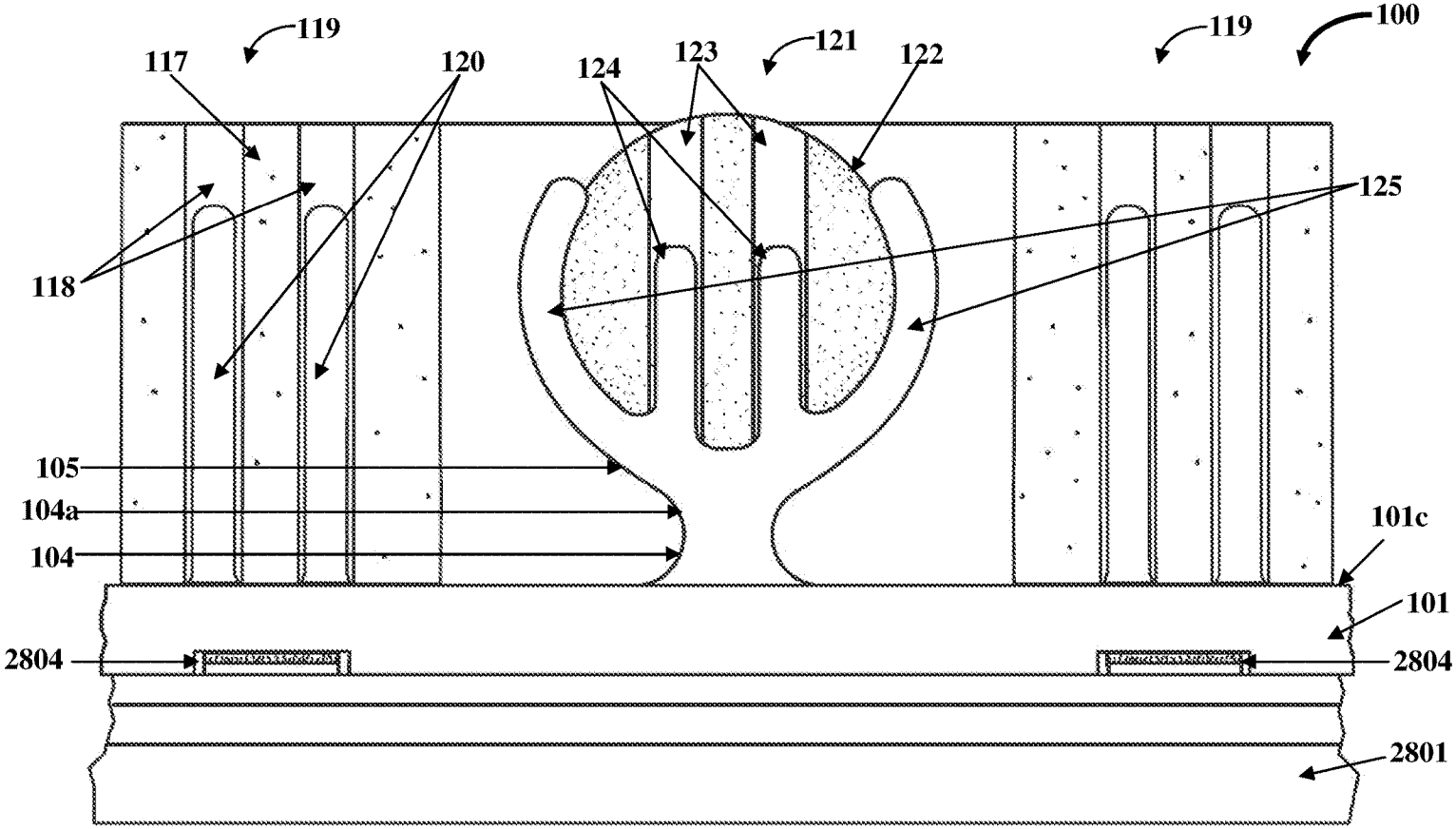
FIG. 36B exemplarily illustrates a partial sectional view of an assembled body cleansing apparatus comprising the combination of cleansing members and detachably attached to a support structure.

FIG. 36B exemplarily illustrates a partial sectional view of an assembled body cleansing apparatus 100 comprising the combination of cleansing members 119 and 121 and detachably attached to a support structure 2801. As exemplarily illustrated in FIG. 36B, the body cleansing apparatus 100 disclosed herein comprises the base member 101 and multiple cleansing members 119 and 121. The base member 101 is attached to the support structure 2801, for example, using hook and loop fasteners 2804. Individual flexible bristles 120 separated at predetermined intervals are attached to the front surface 101*c* of the base member 101. The individual flexible bristles 120 are single elongate flexible bristles that extend outwardly from the front surface 101*c* of the base member 101. The cleansing members 121 are positioned and attached at multiple locations on the base member 101. In an embodiment, the cleansing members 121 are positioned between sets of individual flexible bristles 120. As exemplarily illustrated in FIG. 36B, each cleansing member 121 comprises a stem 104, a cluster 105 of flexible bristles 124 and 125, and a retention member 122. The stem 104 is attached to and extends outwardly from the front surface 101*c* of the base member 101. The cluster 105 of flexible bristles 124 and 125 comprises, for example, the central flexible bristles 124 and radial flexible bristles 125. The radial flexible bristles 125 curvedly branch outwards from the upper end 104*a* of the stem 104. The retention member 122 is detachably attached to the flexible bristles 124 and 125. The retention member 122 is made of a porous material of a generally spherical shape. The retention member 122 retains a cleansing agent 1001 exemplarily illustrated in FIG. 33, dispensed on the retention member 122 and cleanses the body part when the body part contacts the flexible bristles 124 and 125 with the retention member 122.

Figure 37:
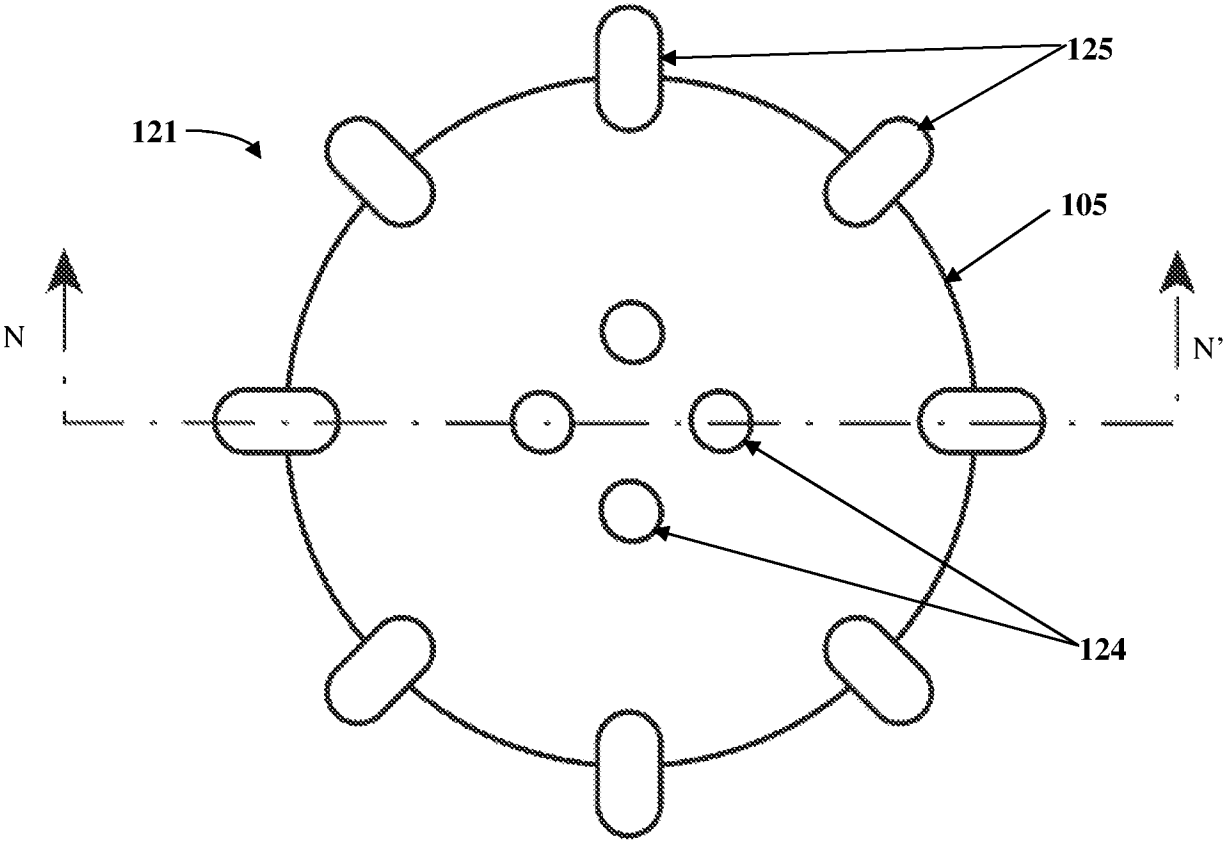
FIG. 37 exemplarily illustrates a top plan view of an embodiment of the cleansing member of the body cleansing apparatus, showing an arrangement of central flexible bristles and radial flexible bristles.

FIG. 37 exemplarily illustrates a top plan view of an embodiment of the cleansing member 121 of the body cleansing apparatus 100 exemplarily illustrated in FIG. 2, showing an arrangement of central flexible bristles 124 and radial flexible bristles 125. The cluster 105 of flexible bristles 124 and 125 exemplarily illustrated in FIG. 37, comprises multiple central flexible bristles 124 extending from the upper end 104*a* of the stem 104 of the cleansing member 121, and multiple radial flexible bristles 125 surrounding the central flexible bristles 124. As exemplarily illustrated in FIG. 37, the cluster 105 of flexible bristles 124 and 125 comprises eight radial flexible bristles 125 surrounding four central flexible bristles 124. The top plan view shows a generally circular geometry of the arrangement of the cluster 105 of flexible bristles 124 and 125. The central flexible bristles 124 are centrally positioned within the radial flexible bristles 125.

Figure 38:
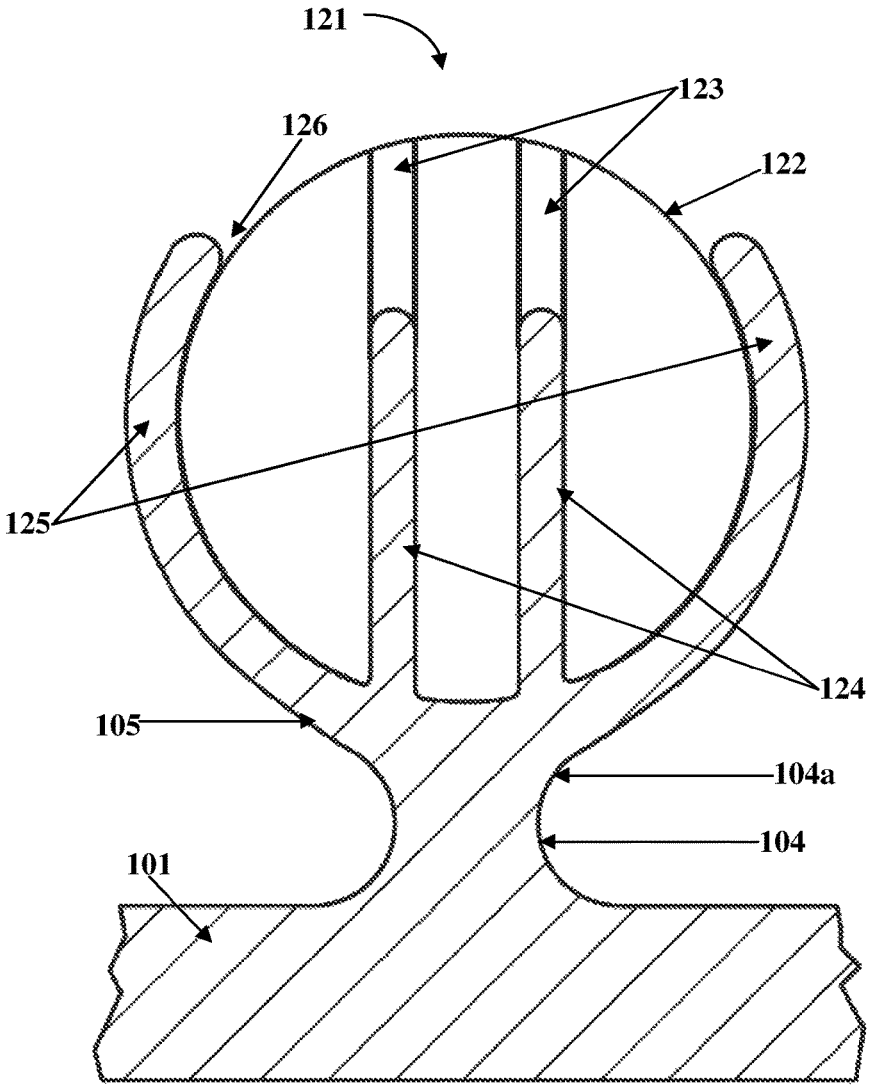
FIG. 38 exemplarily illustrates a sectional view of an embodiment of the cleansing member of the body cleansing apparatus taken along a section N-N' of FIG. 37.

FIG. 38 exemplarily illustrates a sectional view of an embodiment of the cleansing member 121 of the body cleansing apparatus 100 exemplarily illustrated in FIG. 2, taken along a section N-N' of FIG. 37. In this embodiment, each of the radial flexible bristles 125 curvedly branch outwards from the upper end 104*a* of the stem 104 of the cleansing member 121 to define a substantially spherical space 126 above the upper end 104*a* of the stem 104. The spherical space 126 receives the retention member 122 of, for example, a spherical shape, made, for example, of a sponge material. In this embodiment, the retention member 122 comprises one or more cavities 123 for receiving the central flexible bristles 124 when the retention member 122 is inserted into the spherical space 126 defined by the radial flexible bristles 125.

In an embodiment, the central flexible bristles 124 are exposed through the cavities 123 of the retention member 122 to scrub the user's body part after the retention member 122 collapses under a substantial increase in pressure from the body part on the retention member 122. The central flexible bristles 124 are, for example, stiff bristles, attached to and extending outwardly from the upper end 104*a* of the stem 104. In an embodiment, the retention member 122 retains the cleansing agent 1001 exemplarily illustrated in FIG. 33, within the cleansing member 121 and collapses under pressure from the body part to release the cleansing agent 1001 for cleansing the body part.

The cavities 123 in the retention member 122 are, for example, about ⅛ inches larger than the diameter of the central flexible bristles 124. In an embodiment, the central flexible bristles 124 are stiffer and thicker in diameter and shorter than the radial flexible bristles 125 by, for example, about ⅛ inches. The radial flexible bristles 125 are, for example, longer compared to the central flexible bristles 124. The retention member 122 absorbs and retains the cleansing agent 1001 exemplarily illustrated in FIG. 10A, FIG. 10C, and FIG. 33, for example, soap mixed with water. When a user applies a pressure on the retention member 122 with a body part, the body part first contacts the retention member 122. When the pressure on the retention member 122 is increased, the retention member 122 collapses and dispenses the cleansing agent 1001 on the user's body part and the cluster 105 of flexible bristles 124 and 125 makes contact with the user's body part to cleanse the user's body part. When the user applies more pressure on the retention member 122, the retention member 122 collapses further and releases more cleansing agent 1001 on the user's body part, and the central flexible bristles 124 of the cleansing members 121 make contact with the user's body part to scrub the body part, for example, for hand scrubbing.

Figure 39A:
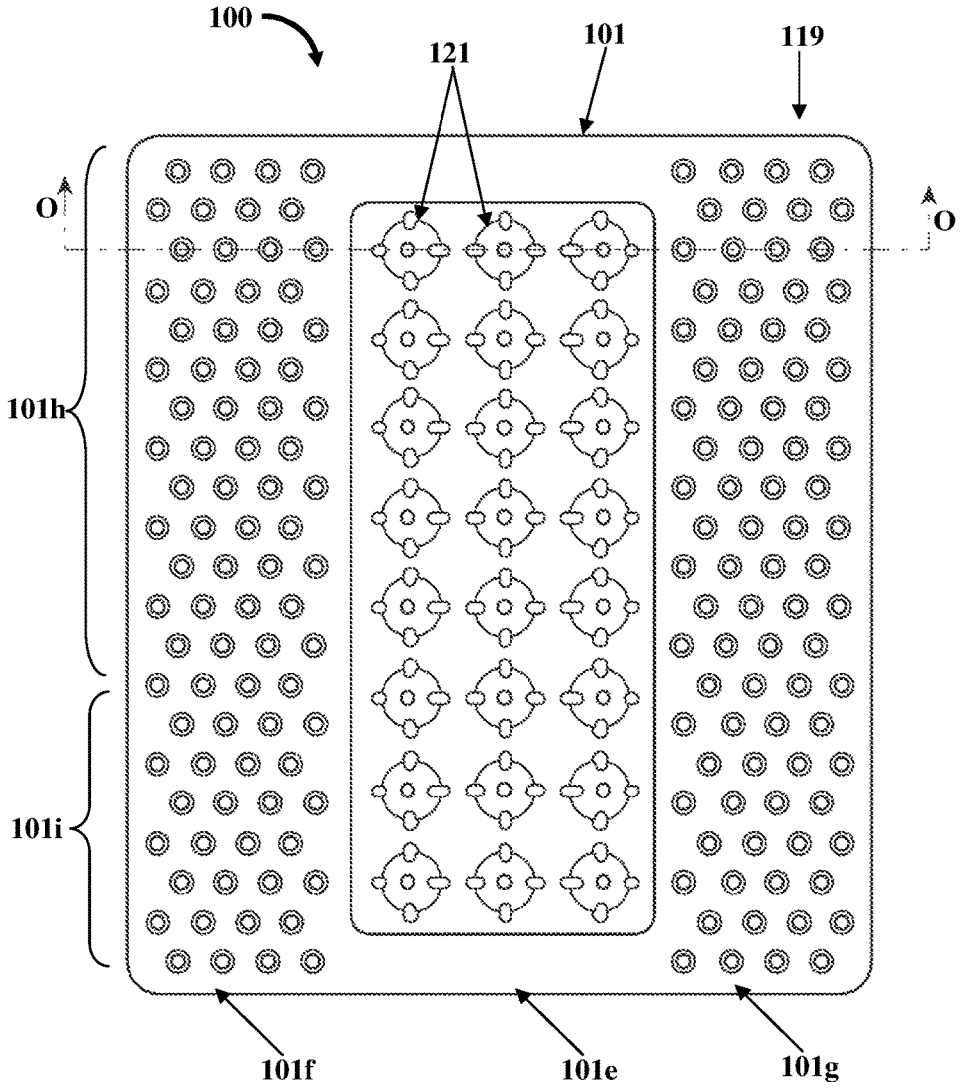
FIG. 39A exemplarily illustrates a front elevation view of an embodiment of the body cleansing apparatus, showing a combination of different cleansing members attached to the base member.
Figure 39B:
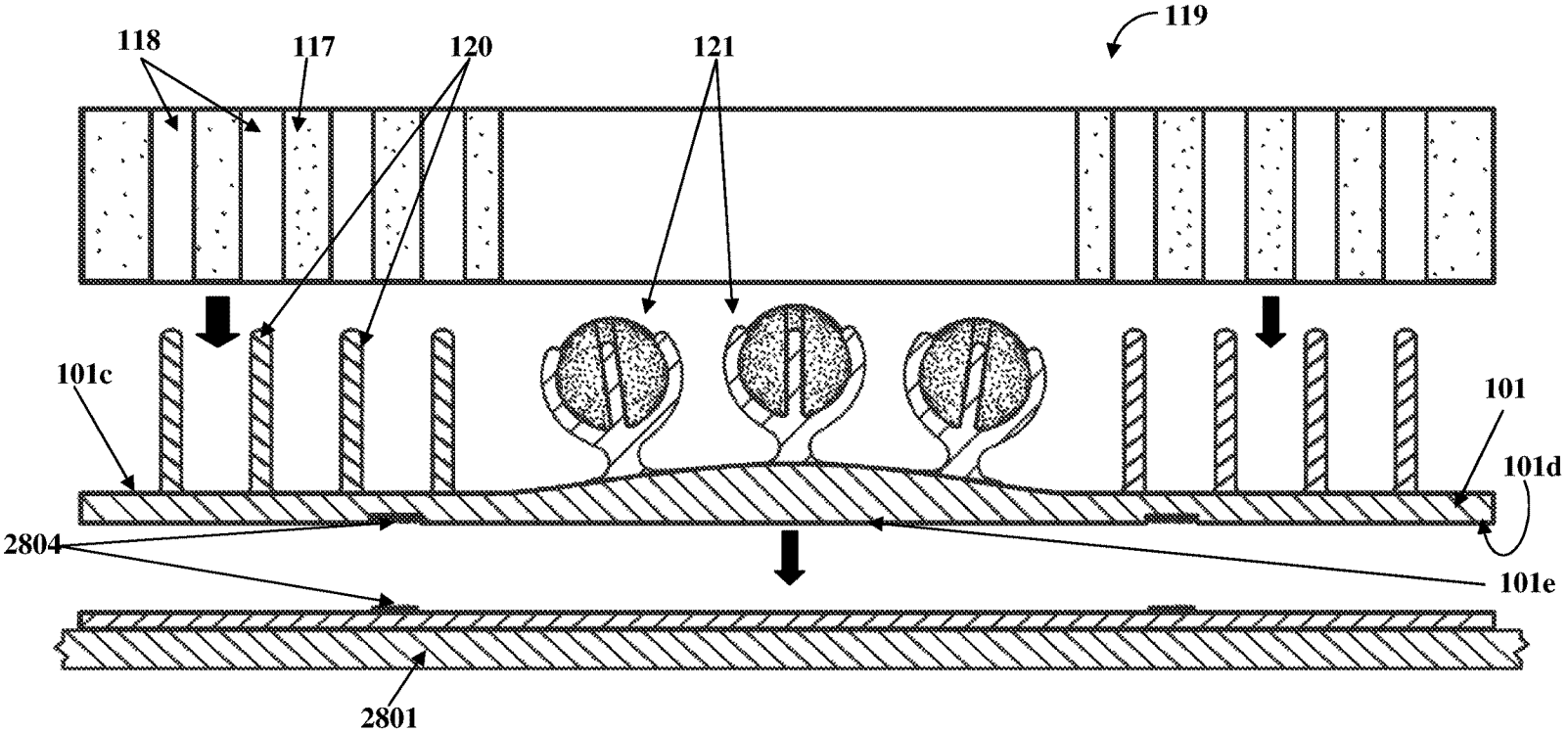
FIG. 39B exemplarily illustrates a disassembled sectional view of the embodiment of the body cleansing apparatus taken along a section O-O' of FIG. 39A.

FIG. 39A exemplarily illustrates a front elevation view of an embodiment of the body cleansing apparatus 100, showing a combination of different cleansing members 119 and 121 attached to the base member 101. FIG. 39B exemplarily illustrates a disassembled sectional view of the embodiment of the body cleansing apparatus 100 taken along a section O-O' of FIG. 39A. As exemplarily illustrated in FIG. 39A, the cleansing members 121 are centrally positioned in a mid-section 101*e* of the base member 101, and the cleansing member 119 is positioned on opposing sections 101*f* and 101*g* adjacent to the mid-section 101*e* of the base member 101. The pattern of the arrangement of the cleansing members 121 is symmetrical to compensate for any empty space above the base member 101.

The height of the body cleansing apparatus 100 is, for example, about 16 inches to about 28 inches, and the width of the body cleansing apparatus 100 is, for example, about 22 inches. A straight section 101*h* of the body cleansing apparatus 100 is, for example, about 21 inches in height and a sloped section 101*i* below the straight section 101*h* is, for example, about 7 inches in height. As exemplarily illustrated in the disassembled sectional view of the body cleansing apparatus 100 in FIG. 39B, the base member 101 is configured to be detachably attached to the support structure 2801 using, for example, hook and loop fasteners 2804. The flexible bristles 120 attached to the front surface 101*c* of the base member 101 are configured to be inserted into the cavities 118 of the retention member 117, while the cleansing members 121 are received and centrally positioned within the retention member 117. The mid-section 101*e* of the base member 101 is, for example, about 1.25 inches in thickness and 2 inches wide.

Figure 40:
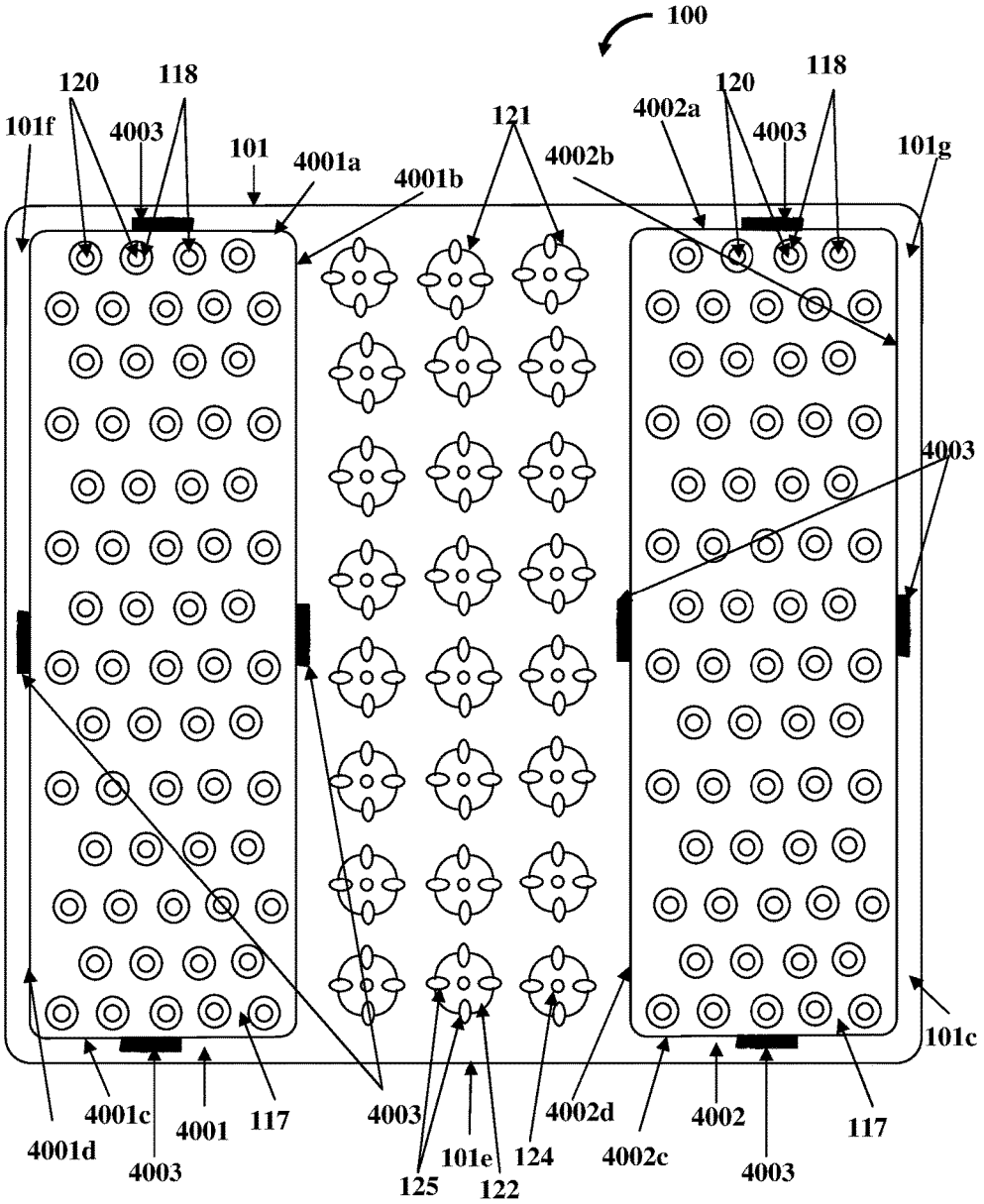
FIG. 40 exemplarily illustrates a front elevation view of an embodiment of the body cleansing apparatus, showing a combination of different cleansing members attached to the base member.

FIG. 40 exemplarily illustrates a front elevation view of an embodiment of the body cleansing apparatus 100, showing a combination of different cleansing members 4001, 4002, and 121 attached to the base member 101. In this embodiment, the body cleansing apparatus 100 comprises the base member 101 and cleansing members 4001, 4002, and 121 positioned and attached at multiple locations on the base member 101. The cleansing members 121 of the type exemplarily illustrated in FIGS. 36A-38, are positioned and attached to the mid-section 101*e* of the front surface 101*c* of the base member 101. Each of the cleansing members 121 comprises the retention member 122, for example, made of a sponge material, and flexible bristles 124 and 125 as disclosed in the detailed description of FIGS. 36A-38. Strips of cleansing members 4001 and 4002 are detachably attached to opposing sections 101*f* and 101*g* of the front surface 101*c* of the base member 101 using one or more fasteners 4003, for example, hook and loop fasteners such as Velcro® of Velcro Industries B. V. LLC, Netherlands. As exemplarily illustrated in FIG. 40, the strips of cleansing members 4001 and 4002 are detachably attached to the opposing sections 101*f* and 101*g* of the base member 101 using four fasteners 4003 attached to opposing sides 4001*a*, 4001*b*, 4001*c*, 4001*d* and 4002*a*, 4002*b*, 4002*c*, 4002*d* of each of the strips of cleansing members 4001 and 4002 respectively. In an embodiment, the strips of cleansing members 4001 and 4002 are fixedly attached to the front surface 101*c* of the base member 101, for example, using an adhesive material. In an embodiment, the cleansing members 4001 and 4002 comprise retention members 117, for example, made of a sponge material.

In an embodiment, the retention members 117 of the cleansing members 4001 and 4002 comprise multiple cavities 118 for accommodating multiple flexible bristles 120. The flexible bristles 120 of configurable dimensions are fixedly attached to and positioned within the cavities 118 of the retention members 117. In an embodiment, the flexible bristles 120 are fixedly attached to and extend from the opposing sections 101*f* and 101*g* of the front surface 101*c* of the base member 101. The flexible bristles 120 are inserted into the cavities 118 of the retention members 117 of the cleansing members 4001 and 4002. The retention members 117 and 122 and the flexible bristles 120 and 124, 125 respectively, retain a cleansing agent dispensed on them. The retention members 117 and 122 of the cleansing members 4001, 4002 and 121 respectively, release the cleansing agent along the flexible bristles 120 and 124, 125 respectively exemplarily illustrated in FIG. 38, when a user's body part, for example, the user's back, contacts and applies a pressure on the retention members 117 and 122 for cleansing the user's body part.

Figure 41:
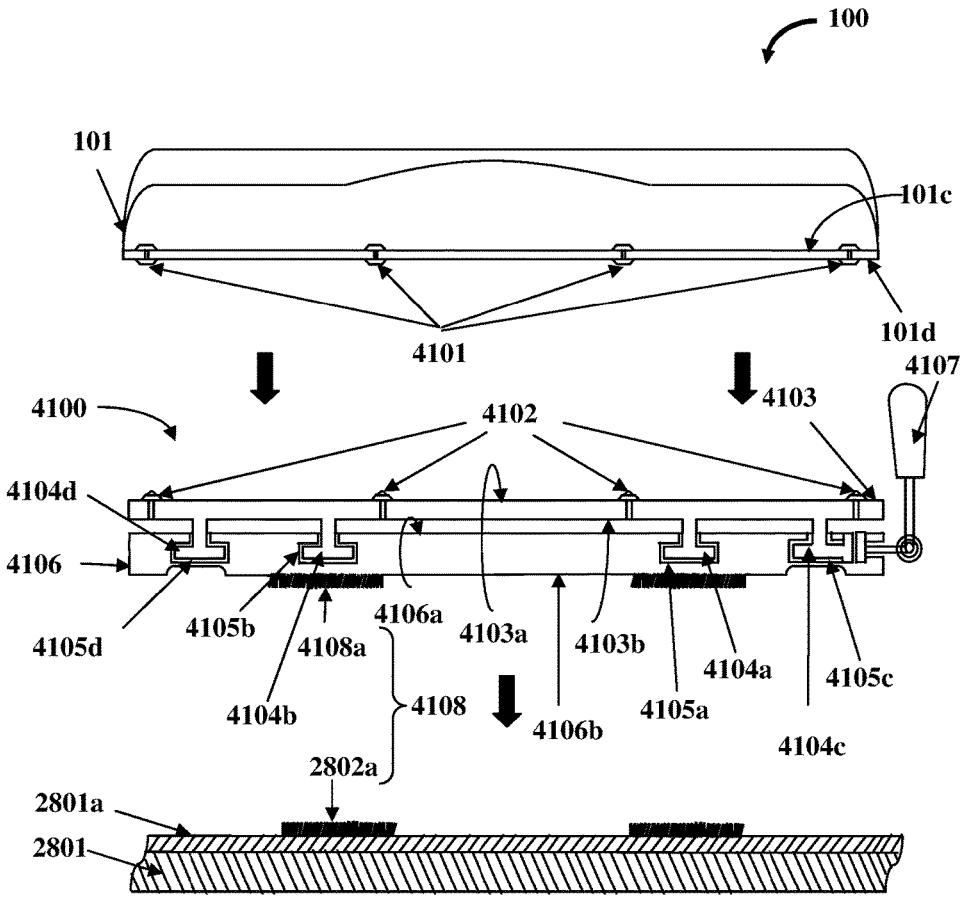
FIG. 41 exemplarily illustrates a disassembled view of an embodiment of the body cleansing apparatus, showing a position adjustment device.

FIG. 41 exemplarily illustrates a disassembled view of an embodiment of the body cleansing apparatus 100, showing a position adjustment device 4100. In an embodiment, the body cleansing apparatus 100 disclosed herein further comprises a position adjustment device 4100 detachably attached to the rear surface 101*d* of the base member 101 using fasteners 4101 and 4102, for example, snap fasteners, positioned on the rear surface 101*d* of the base member 101 and a front surface 4103*a* of the position adjustment device 4100 respectively. The position adjustment device 4100 is configured to adjust a position of the body cleansing apparatus 100 on a support structure 2801, for example, a bathroom wall, to allow users of different heights to use the body cleansing apparatus 100 without manually removing and fixing the body cleansing apparatus 100 to the support structure 2801 to suit each user's height each time. Multiple fasteners 4101 and 4102, for example, snap fasteners are positioned on the rear surface 101*d* of the base member 101 and the front surface 4103*a* of the position adjustment device 4100 respectively, for detachably attaching the base member 101 with the attached cleansing members, for example, 103, or 119, or 121 exemplarily illustrated in FIGS. 1-2, FIG. 4-6, FIG. 17, FIGS. 27-28, FIG. 35C, FIG. 36B, FIG. 39A, and FIG. 40, to the position adjustment device 4100.

As exemplarily illustrated in FIG. 41, the position adjustment device 4100 comprises a guide slide plate 4103, a base plate 4106, and a locking lever 4107. A front surface 4103*a* of the guide slide plate 4103 is detachably attached to the rear surface 101*d* of the base member 101 using the fasteners 4101 and 4102. The guide slide plate 4103 comprises multiple elongate guide projections 4104*a*, 4104*b*, 4104*c*, and 4104*d* extending from a rear surface 4103*b* of the guide slide plate 4103. The rear surface 4103*b* of the guide slide plate 4103 opposes the front surface 4103*a* of the guide slide plate 4103. The base plate 4106 comprises multiple guideways 4105*a*, 4105*b*, 4105*c*, and 4105*d* configured on the front surface 4106*a* of the base plate 4106. The elongate guide projections 4104*a*, 4104*b*, 4104*c*, and 4104*d* of the guide slide plate 4103 are configured to slide within the guideways 4105*a*, 4105*b*, 4105*c*, and 4105*d* of the base plate 4106 respectively. The thickness of the position adjustment device 4100 is, for example, about 1.75 inches.

One or more fasteners, for example, hook and loop fasteners 4108 such as Velcro® of Velcro Industries B. V. LLC, Netherlands, are positioned on the rear surface 4106*b* of the base plate 4106 and the front surface 2801*a* of the support structure 2801. The base plate 4106 is configured to be detachably attached to the support structure 2801 using the hook and loop fasteners 4108. The hook and loop fasteners 4108 comprise hook sides 2802*a* and loop sides 4108*a*. The hook sides 2802*a* or the loop sides 4108*a* of the hook and loop fasteners 4108 are affixed on the rear surface 4106*b* of the base plate 4106, while an opposing one of the hook sides 2802*a* or the loop sides 4108*a* of the hook and loop fasteners 4108 are affixed on the front surface 2801*a* of the support structure 2801 for allowing the detachable attachment of the base plate 4106 to the support structure 2801. For example, if the loop sides 4108*a* of the hook and loop fasteners 4108 are affixed on the rear surface 4106*b* of the base plate 4106, the hook sides 2802*a* of the hook and loop fasteners 4108 are attached to the front surface 2801*a* of the support structure 2801 and vice versa as exemplarily illustrated in FIG. 41. The hook and loop fasteners 4108 are affixed on the rear surface 4106*b* of the base plate 4106 and the front surface 2801*a* of the support structure 2801, for example, by sewing, using adhesives, etc. A user may apply a pressure and push the rear surface 4106*b* of the base plate 4106 of the position adjustment device 4100 having, for example, the loop sides 4108*a* of the hook and loop fasteners 4108 against the hook sides 2802*a* of the hook and loop fasteners 4108 on the front surface 2801*a* of the support structure 2801 to attach the position adjustment device 4100 to the support structure 2801. The locking lever 4107 of the position adjustment device 4100 is operably connected, for example, to the elongate guide projection 4104*c* of the guide slide plate 4103.

Figure 42:
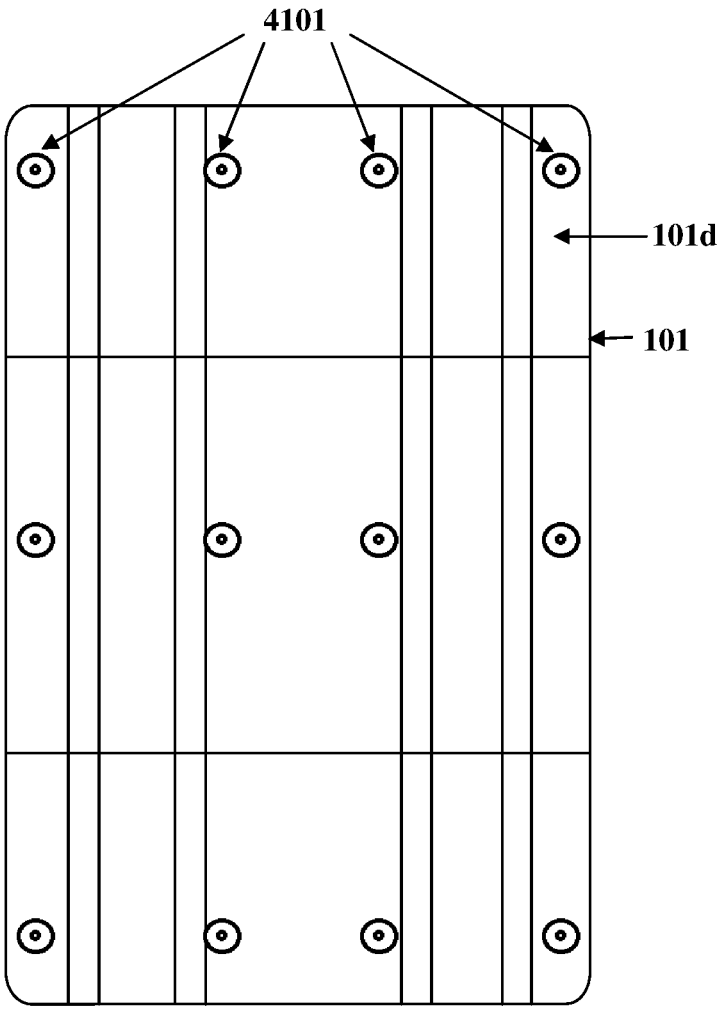
FIG. 42 exemplarily illustrates a rear elevation view of an embodiment of the base member of the body cleansing apparatus, showing multiple snap fasteners attached to the rear surface of the base member to facilitate attachment of the base member to the position adjustment device shown in FIG. 41.

FIG. 42 exemplarily illustrates a rear elevation view of an embodiment of the base member 101 of the body cleansing apparatus 100 exemplarily illustrated in FIG. 41, showing multiple fasteners 4101, for example, snap fasteners attached to the rear surface 101*d* of the base member 101 to facilitate attachment of the base member 101 to the position adjustment device 4100 shown in FIG. 41. The fasteners 4101 attach the base member 101 to the position adjustment device 4100 by interlocking with multiple second fasteners 4102 positioned on the front surface 4103*a* of the guide slide plate 4103 as exemplarily illustrated in FIG. 41 and FIG. 43.

Figure 43:
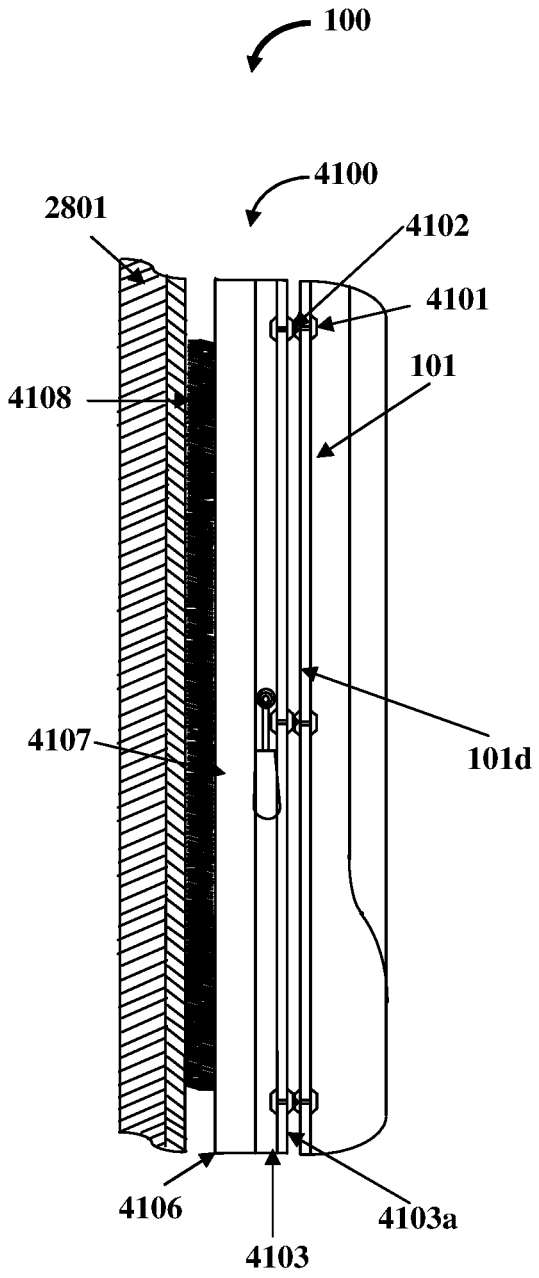
FIG. 43 exemplarily illustrates an assembled left side elevation view of an embodiment of the body cleansing apparatus, showing the position adjustment device.

FIG. 43 exemplarily illustrates an assembled left side elevation view of an embodiment of the body cleansing apparatus 100, showing the position adjustment device 4100. As exemplarily illustrated in FIG. 43, the base member 101 of the body cleansing apparatus 100 with the attached cleansing members, for example, 103, or 119, or 121 exemplarily illustrated in FIGS. 1-2, FIG. 4-6, FIG. 17, FIGS. 27-28, FIG. 35C, FIG. 36B, FIG. 39A, and FIG. 40, is attached to the position adjustment device 4100 via the fasteners 4101 and 4102, for example, snap fasteners. The fasteners 4102 positioned on the front surface 4103*a* of the guide slide plate 4103 of the position adjustment device 4100 are engageably connected to the fasteners 4101 positioned on the rear surface 101*d* of the base member 101. The base plate 4106 of the position adjustment device 4100 is detachably attached to the support structure 2801 using one or more fasteners, for example, the hook and loop fasteners 4108. The locking lever 4107 operably connected, for example, to the elongate guide projection 4104*c* of the guide slide plate 4103 exemplarily illustrated in FIG. 41, controls movement of the elongate guide projections 4104*a*, 4104*b*, 4104*c*, and 4104*d* within the guideways 4105*a*, 4105*b*, 4105*c*, and 4105*d* of the base plate 4106 respectively, exemplarily illustrated in FIG. 41.

Figure 44:
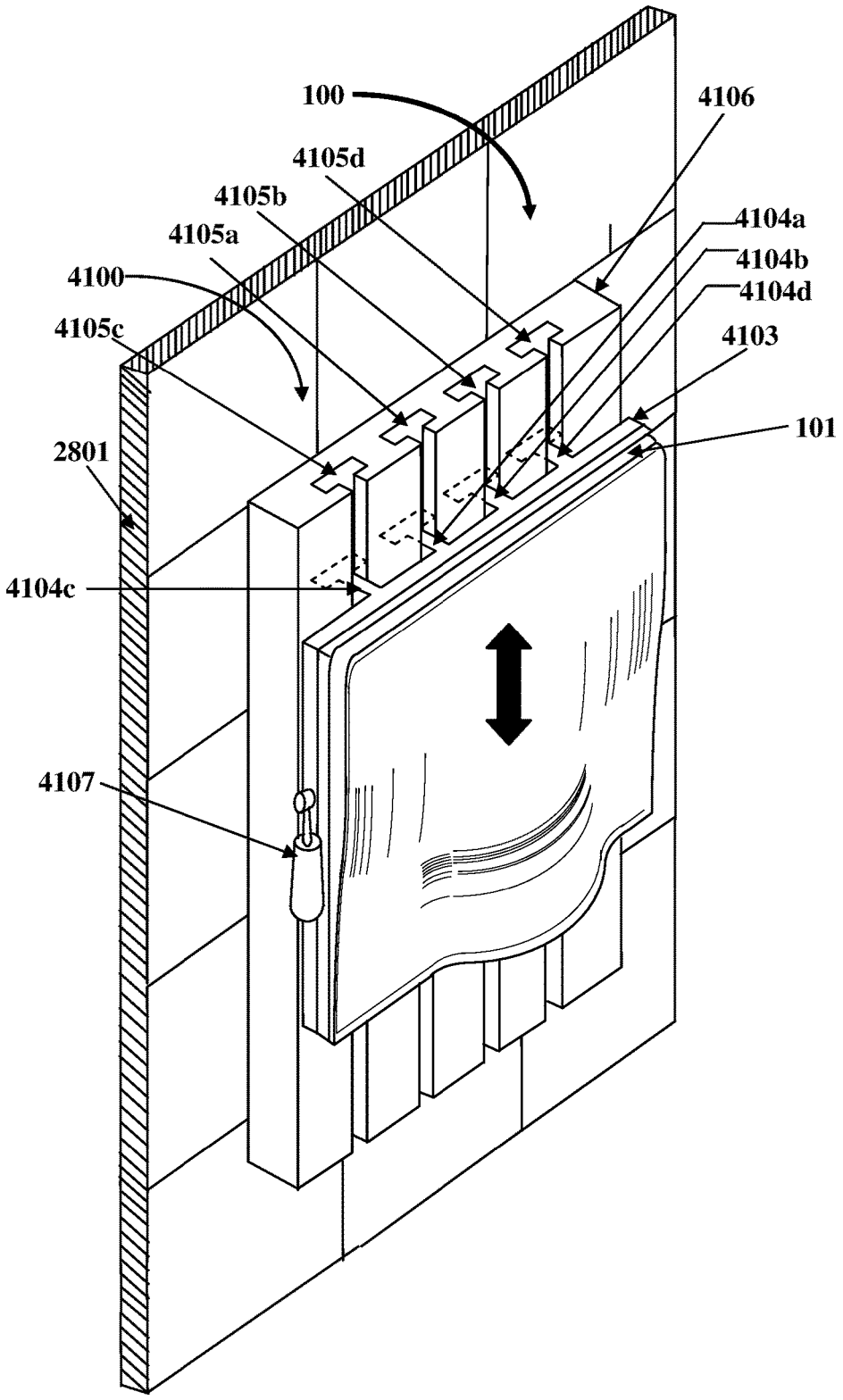
FIG. 44 exemplarily illustrates an assembled front perspective view of an embodiment of the body cleansing apparatus, showing adjustable positioning of the body cleansing apparatus using the position adjustment device.

FIG. 44 exemplarily illustrates an assembled front perspective view of an embodiment of the body cleansing apparatus 100, showing adjustable positioning of the body cleansing apparatus 100 using the position adjustment device 4100. The position adjustment device 4100 is detachably attached to a support structure 2801, for example, a wall as exemplarily illustrated in FIGS. 43-44. The elongate guide projections 4104*a*, 4104*b*, 4104*c*, and 4104*d* of the guide slide plate 4103 of the position adjustment device 4100 slide within the guideways 4105*a*, 4105*b*, 4105*c*, and 4105*d* of the base plate 4106 respectively, to position the base member 101 of the body cleansing apparatus 100 with the attached cleansing members, for example, 103, or 119, or 121 exemplarily illustrated in FIGS. 1-2, FIG. 4-6, FIG. 17, FIGS. 27-28, FIG. 35C, FIG. 36B, FIG. 39A, and FIG. 40, at a desired position in accordance with a user's height. As exemplarily illustrated in FIG. 44, the elongate guide projections 4104*a*, 4104*b*, 4104*c*, and 4104*d* are elongate T-shaped members that slide within elongate T-shaped guideways 4105*a*, 4105*b*, 4105*c*, and 4105*d* respectively. The locking lever 4107 operably connected, for example, to the elongate guide projection 4104*c* of the guide slide plate 4103, when engaged, comes in contact with the elongate guide projection 4104*c* of the guide slide plate 4103 and locks the guide slide plate 4103 in position, thereby preventing the guide slide plate 4103 from moving. When the locking lever 4107 is disengaged, the elongate guide projection 4104*c* is not in contact with the locking lever 4107 and is therefore free to slide in an upward direction or a downward direction through the guideway 4105*c* of the base plate 4106 along with the other elongate guide projections 4104*a*, 4104*b*, and 4104*d* through the guideways 4105*a*, 4105*b*, and 4105*d* of the base plate 4106 respectively. If a user finds the body cleansing apparatus 100 at a height that is either too high or too low for the user to optimally use, then the user can disengage the locking lever 4107 and slide the body cleansing apparatus 100 in an upward direction or a downward direction to an appropriate position for using the body cleansing apparatus 100. The user may then engage the locking lever 4107 to secure the body cleansing apparatus 100 firmly in the appropriate position and restrict movement.

Figure 45A:
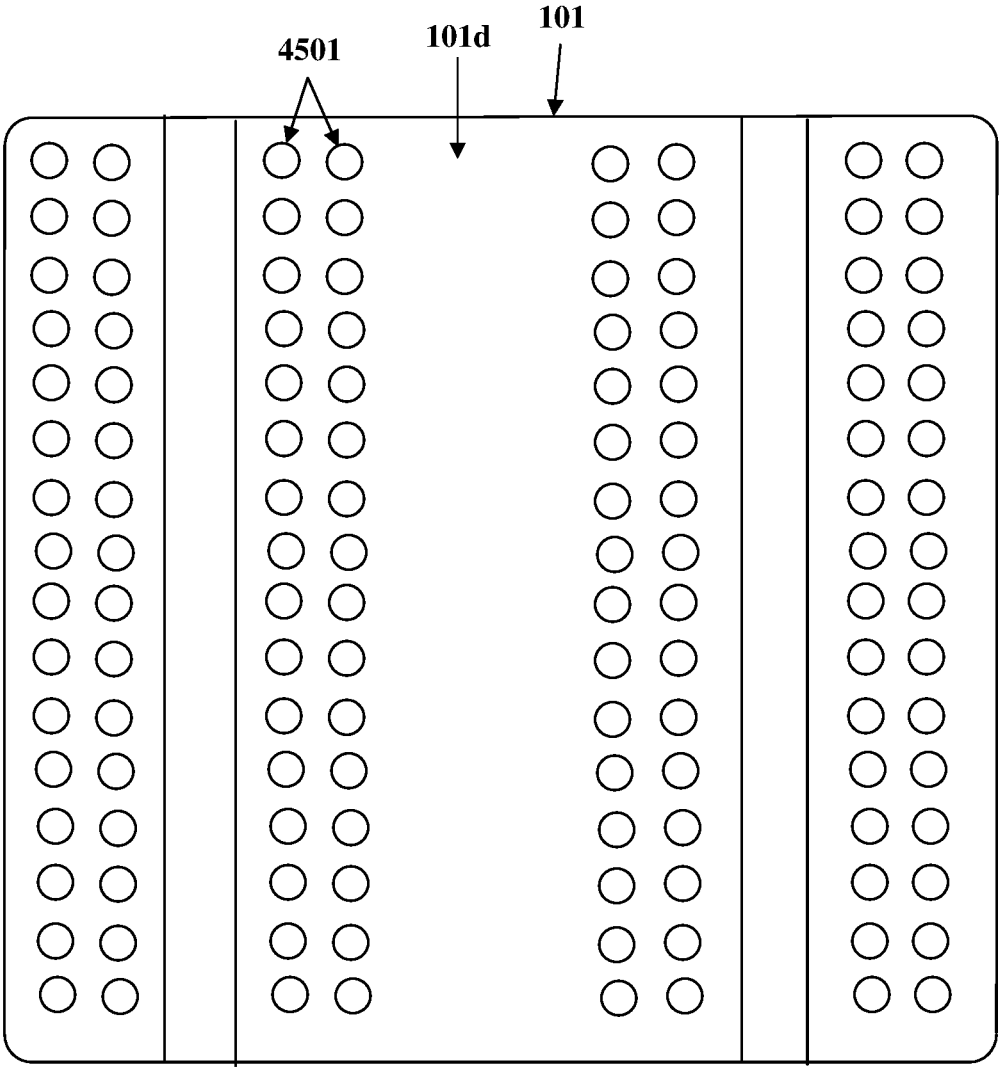
FIG. 45A exemplarily illustrates a rear elevation view of an embodiment of the base member configured as a membrane.

FIG. 45A exemplarily illustrates a rear elevation view of an embodiment of the base member 101 configured as a membrane. In this embodiment, the base member 101 is configured as a membrane with attached cleansing members, for example, 103, or 119, or 121 exemplarily illustrated in FIGS. 1-2, FIG. 4-6, FIG. 17, FIGS. 27-28, FIG. 35C, FIG. 36B, FIG. 39A, and FIG. 40. The thickness of the membrane is, for example, about 0.375 inches to about 0.625 inches. The membrane comprises drainage openings 4501 for draining fluids, for example, water, the cleansing agent 1001 exemplarily illustrated in FIG. 10A, FIG. 10C, FIG. 11, FIG. 12B, FIG. 13, and FIGS. 15-16, passing through the cleansing members, for example, 103, or 119, or 121, when a user is bathing. In this embodiment, lesser amounts of rubber silicone are used in the base member 101, thereby enabling the body cleansing apparatus 100 to be less expensive.

Figure 45B:
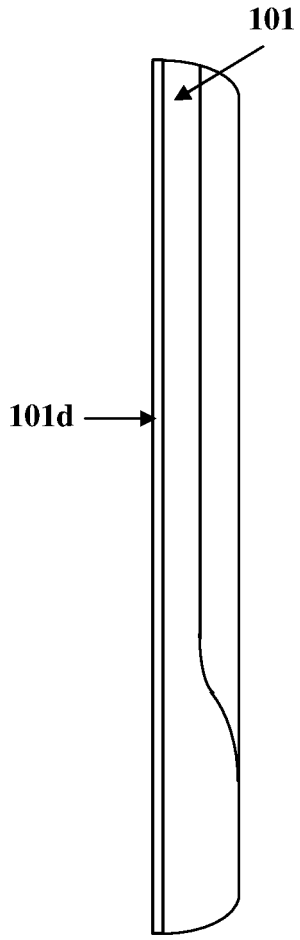
FIG. 45B exemplarily illustrates a left side elevation view of the embodiment of the base member configured as a membrane.

FIG. 45B exemplarily illustrates a left side elevation view of the embodiment of the base member 101 configured as a membrane. In this embodiment, the cleansing members, for example, 103, or 119, or 121 exemplarily illustrated in FIGS. 1-2, FIG. 4-6, FIG. 17, FIGS. 27-28, FIG. 35C, FIG. 36B, FIG. 39A, and FIG. 40, are attached to the embodiment of the base member 101 configured as a membrane as exemplarily illustrated in FIGS. 45A-45B.

Figure 46A:
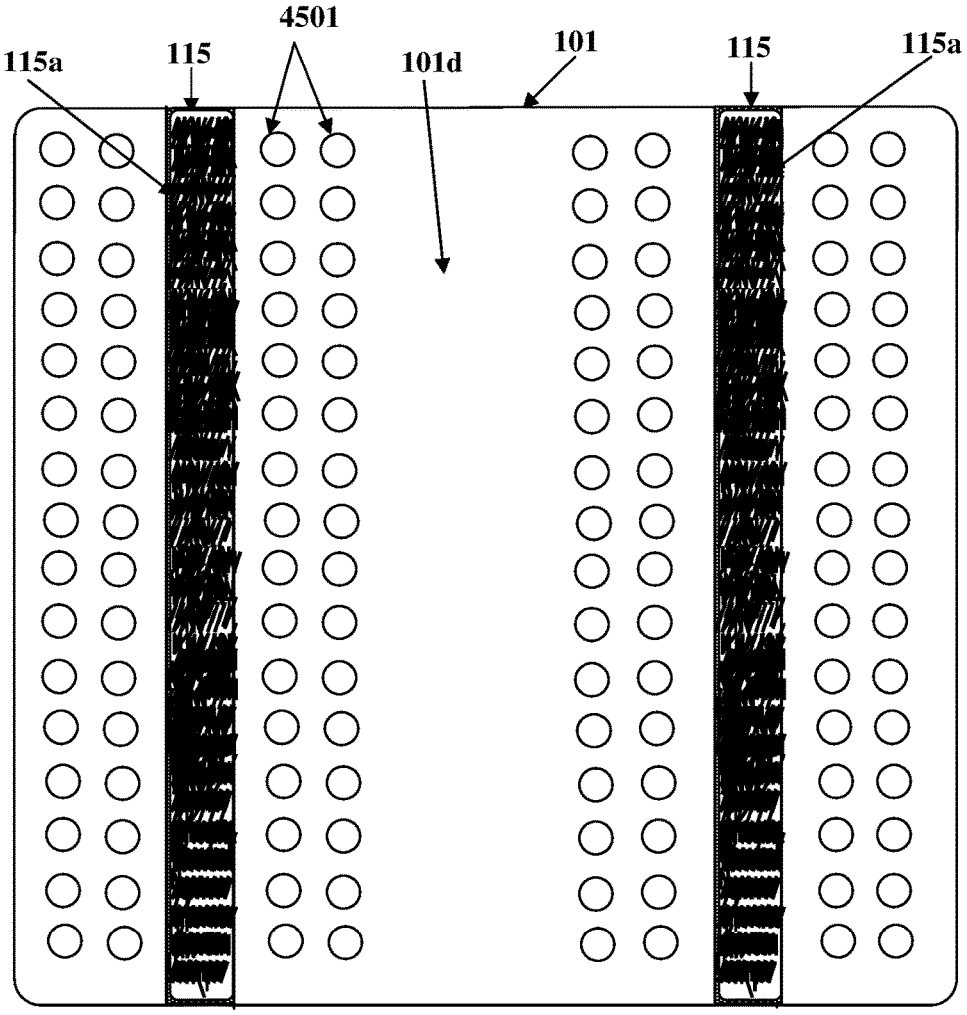
FIG. 46A exemplarily illustrates a rear elevation view of the embodiment of the base member configured as a membrane shown in FIG. 45A, showing strips of fasteners attached to the rear surface of the base member.

FIG. 46A exemplarily illustrates a rear elevation view of the embodiment of the base member 101 configured as a membrane shown in FIG. 45A, showing strips 115 of fasteners, for example, loop sides 115*a* of the hook and loop fasteners 2804 exemplarily illustrated in FIG. 28, attached to the rear surface 101*d* of the base member 101. The drainage openings 4501 in the base member 101 configured as a membrane are exemplarily illustrated in FIG. 46A.

Figure 46B:
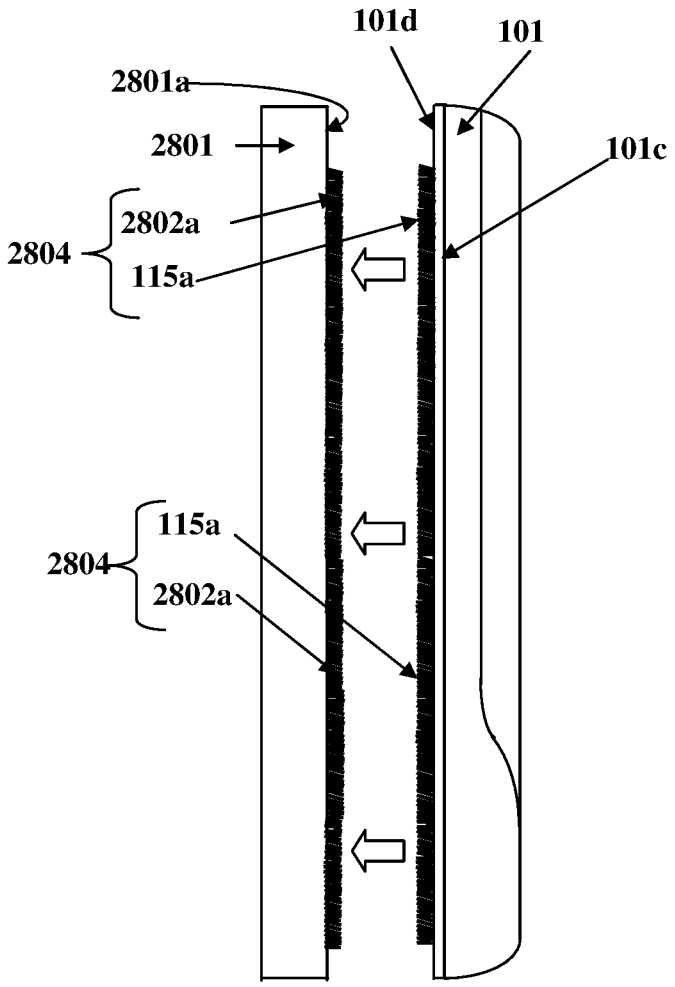
FIG. 46B exemplarily illustrates a left side elevation view of the embodiment of the base member configured as a membrane shown in FIG. 46A, showing detachable attachment of the base member to a support structure using fasteners.

FIG. 46B exemplarily illustrates a left side elevation view of the embodiment of the base member 101 configured as a membrane shown in FIG. 46A, showing detachable attachment of the base member 101 to a support structure 2801, for example, a wall using the fasteners 2804. A user may apply a pressure and push the rear surface 101*d* of the base member 101 having, for example, the loop sides 115*a* of the hook and loop fasteners 2804 against the hook sides 2802*a* of the hook and loop fasteners 2804 on the front surface 2801*a* of the support structure 2801 to attach the base member 101 to the support structure 2801. A user cleanses his/her back using the cleansing members, for example, 103, or 119, or 121 exemplarily illustrated in FIGS. 1-2, FIG. 4-6, FIG. 17, FIGS. 27-28, FIG. 35C, FIG. 36B, FIG. 39A, and FIG. 40, attached to the front surface 101*c* of the base member 101.

Figure 47:
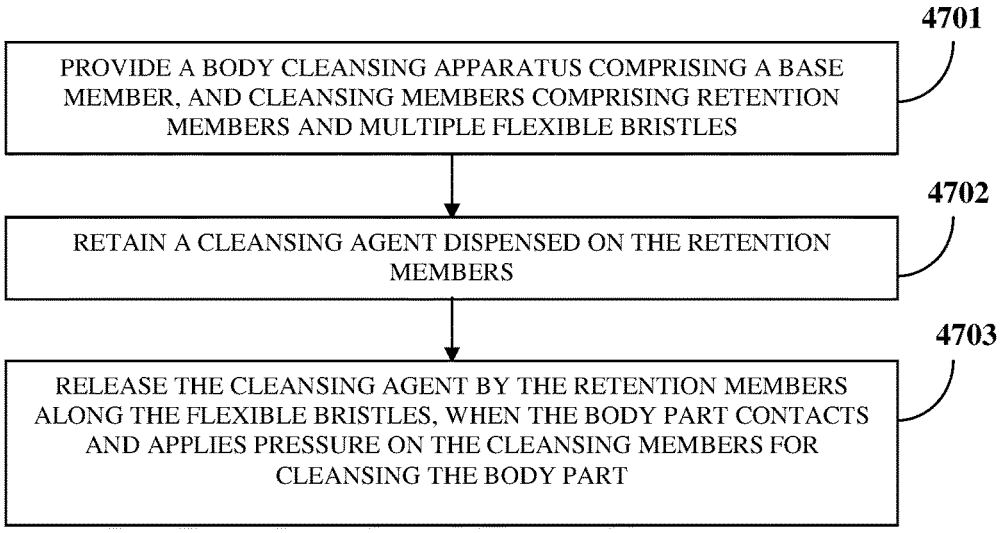
FIG. 47 exemplarily illustrates an embodiment of the method for cleansing a body part of a user.

FIG. 47 exemplarily illustrates an embodiment of the method for cleansing a body part of a user. The body cleansing apparatus 100 comprising the base member 101 and the cleansing members 119 and 121 exemplarily illustrated in FIG. 35C and FIG. 36B, is provided 4701. The retention members 117 and/or 122 exemplarily illustrated in FIG. 35C and FIG. 36B, retain 4702 a cleansing agent 1001 exemplarily illustrated in FIG. 10A, FIG. 10C, FIG. 11, FIG. 12B, FIG. 13, and FIGS. 15-16, dispensed on the retention members 117 and/or 122. The retention members 117 and/or 122 release 4703 the cleansing agent 1001 along the flexible bristles 120 and/or 124 and 125 of the body cleansing apparatus 100 exemplarily illustrated in FIG. 35C and FIG. 36B, when a user's body part contacts and applies a pressure on the cleansing members 119 and/or 121 for cleansing the user's body part.

Figure 48:
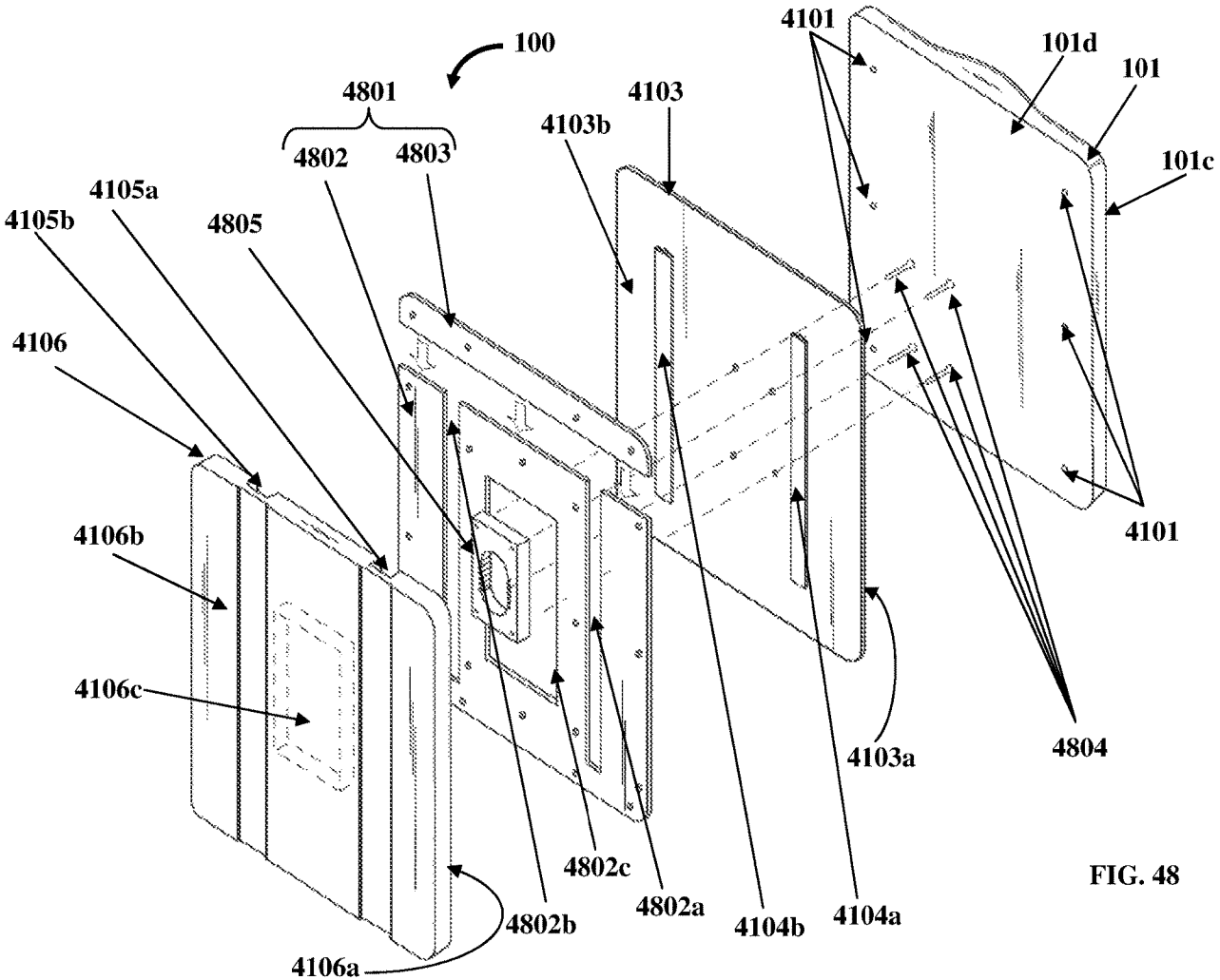
FIG. 48 exemplarily illustrates a rear exploded view of a motorized body cleansing apparatus.
Figure 49:
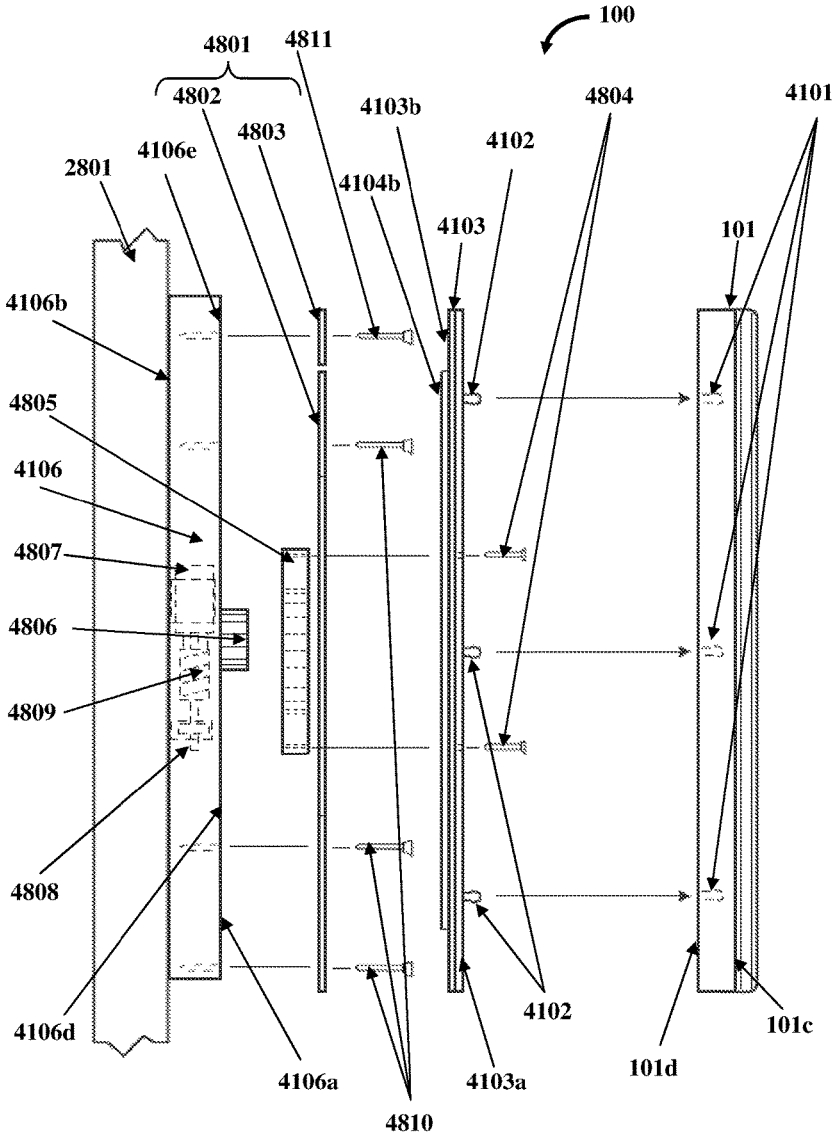
FIG. 49 exemplarily illustrates a left side exploded view of the motorized body cleansing apparatus.

FIGS. 48-49 exemplarily illustrate a rear exploded view and a left side exploded view respectively, of an embodiment of the body cleansing apparatus 100, hereafter referred to as a "motorized body cleansing apparatus" and referenced by the numeral 100. The motorized body cleansing apparatus 100 is, for example, about 16 inches long and 22 inches wide. The motorized body cleansing apparatus 100 disclosed herein comprises a base plate 4106, multiple rollers 4815 exemplarily illustrated in FIGS. 50-51, a guide slide plate 4103, a split cover plate 4801, a motion transmission assembly 4820 exemplarily illustrated in FIGS. 52-54, and the base member 101. The base member 101 is detachably attached to the front surface 4103*a* of the guide slide plate 4103 by fasteners 4101 and 4102, for example, snap fasteners, positioned on the rear surface 101*d* of the base member 101 and the front surface 4103*a* of the guide slide plate 4103 respectively. The motorized body cleansing apparatus 100 allows automated movement of the base member 101 with the attached cleansing members, for example, 103, or 119, or 121 exemplarily illustrated in FIGS. 1-2, FIG. 4-6, FIG. 17, FIGS. 27-28, FIG. 35C, FIG. 36B, FIG. 39A, and FIG. 40, by the motion transmission assembly 4820 as disclosed in the detailed description of FIGS. 52-54. The motorized body cleaning apparatus 100 is detachably attached to a support structure 2801, for example, a wall.

The base plate 4106 of the motorized body cleansing apparatus 100 comprises a front surface 4106*a* and a rear surface 4106*b*. The base plate 4106 is detachably attached to the support structure 2801 using fasteners, for example, hook and loop fasteners 4108 such as Velcro® of Velcro Industries B. V. LLC, Netherlands, positioned on the rear surface 4106*b* of the base plate 4106 and the front surface 2801*a* of the support structure 2801 as disclosed in the detailed description of FIGS. 59A-59B. The base plate 4106 is made of, for example, plastic, the Darlyn® coated fabric material of Chemical Fabrics Corporation, Vermont, etc. The base plate 4106 comprises guideways 4105*a* and 4105*b* positioned on the front surface 4106*a* of the base plate 4106. The guideways 4105*a* and 4105*b* are, for example, of an elongate rectangular shape. The base plate 4106 further comprises a cavity 4106*c* configured between the guideways 4105*a* and 4105*b* on the front surface 4106*a* of the base plate 4106. The cavity 4106*c* of the base plate 4106 is, for example, a rectangular space configured in the base plate 4106. The cavity 4106*c* of the base plate 4106 accommodates the motion transmission assembly 4820 comprising a motor 4807, a worm gear 4809, transmission members, for example, 4805, 4806, 4812, 4813, etc., exemplarily illustrated in FIGS. 52-54 and as disclosed in the detailed description of FIGS. 52-54. The motor 4807, the motor shaft 4808, the worm gear 4809, and the transmissions members 4805 and 4806 of the motion transmission assembly 4820 are exemplarily illustrated in FIG. 49. The guideways 4105*a* and 4105*b* of the base plate 4106 accommodate the rollers 4815 as disclosed in the detailed description of FIGS. 50-51. The thickness of the base plate 4106 is, for example, about 1.5 inches to about 2 inches. The guideways 4105*a* and 4105*b* of the base plate 4106 are sufficiently wide, for example, about 1 inch to about 1.44 inches to accommodate the rollers 4815.

The transmission member 4805 of the motion transmission assembly 4820 is fixedly attached to the rear surface 4103*b* of the guide slide plate 4103 using fasteners 4804, for example, screws. The transmission member 4805 is, for example, an inverted gear block of a rectangular shape. The guide slide plate 4103 of the motorized body cleansing apparatus 100 is positioned at the front surface 4106*a* of the base plate 4106. The thickness of the guide slide plate 4103 is, for example, about 0.2 inches to about 0.3 inches. The guide slide plate 4103 comprises multiple elongate guide projections 4104*a* and 4104*b* extending from the rear surface 4103*b* of the guide slide plate 4103. The rear surface 4103*b* of the guide slide plate 4103 opposes the front surface 4103*a* of the guide slide plate 4103. The elongate guide projections 4104*a* and 4104*b* of the guide slide plate 4103 are configured to slide on the rollers 4815 at the front surface 4106*a* of the base plate 4106 as disclosed in the detailed description of FIGS. 50-51. The width of the elongate guide projections 4104*a* and 4104*b* of the guide slide plate 4103 is, for example, about 1.4 inches to about 1.5 inches.

The split cover plate 4801 is positioned between the base plate 4106 and the guide slide plate 4103 as exemplarily illustrated in FIGS. 48-49. The thickness of the split cover plate 4801 is, for example, about 0.2 inches to about 0.3 inches. The split cover plate 4801 comprises a securing element 4802 and a cap element 4803. The securing element 4802 of the split cover plate 4801 is fixedly attached to a body section 4106*d* of the base plate 4106 using fasteners 4810, for example, screws exemplarily illustrated in FIG. 49. The securing element 4802 comprises vertical slots 4802*a* and 4802*b* exemplarily illustrated in FIG. 48. The vertical slots 4802*a* and 4802*b* receive and accommodate the elongate guide projections 4104*a* and 4104*b* of the guide slide plate 4103. The securing element 4802 further comprises an opening 4802*c*, for example, of a rectangular shape, positioned between the vertical slots 4802*a* and 4802*b* as exemplarily illustrated in FIG. 48. The opening 4802*c* in the securing element 4802 allows the transmission member 4805 of the motion transmission assembly 4820 that is fixedly attached to the rear surface 4103*b* of the guide slide plate 4103 to pass through the securing element 4802 and be operably coupled to the transmission member 4806 exemplarily illustrated in FIG. 49. The cap element 4803 of the split cover plate 4801 is fixedly attached to an upper section 4106*e* of the base plate 4106 using a fastener 4811, for example, a screw exemplarily illustrated in FIG. 49. The cap element 4803 is made of, for example, plastic, the Darlyn® coated fabric material of Chemical Fabrics Corporation, Vermont, etc. The cap element 4803 secures the guide slide plate 4103 to the base plate 4106 to preclude the guide slide plate 4103 from sliding out of the base plate 4106. In an embodiment, other fasteners, for example, hook and loop fasteners, strong suction cup fasteners, strong glue, etc., are used for fixing the securing element 4802 and the cap element 4803 of the split cover plate 4801 to the front surface 4106*a* of the base plate 4106. The split cover plate 4801 precludes the guide slide plate 4103 from disengaging from the base plate 4106 of the motorized body cleansing apparatus 100.

The base member 101 of the motorized body cleansing apparatus 100 is detachably attached to the front surface 4103*a* of the guide slide plate 4103 by engagement of the fasteners 4101 positioned on the rear surface 101*d* of the base member 101 with the fasteners 4102 positioned on the front surface 4103*a* of the guide slide plate 4103 as disclosed in the detailed description of the FIG. 41. The thickness of the base member 101 is, for example, about 1.5 inches to about 1.7 inches. The base member 101 is configured with one or more contoured profiles 102*a* and 102*b* exemplarily illustrated in FIG. 1, to conform to a user's body part. The base member 101 further comprises one or more cleansing members, for example, 103, or 119, or 121 exemplarily illustrated in FIGS. 1-2, FIG. 4-6, FIG. 17, FIGS. 27-28, FIG. 35C, FIG. 36B, FIG. 39A, and FIG. 40, attached to the front surface 101*c* of the base member 101. In an embodiment, the base member 101 comprises a sponge material, for example, cellulose sponge. The different embodiments of the cleansing members, for example, 103, or 119, or 121 are disclosed in the detailed descriptions of FIGS. 1-25, FIG. 33, and FIGS. 35A-40. The base member 101 with the cleansing members, for example, 103, or 119, or 121 are configured with a smooth texture or a scrub type texture. The cleansing members, for example, 103, or 119, or 121 clean the user's body part when the body part contacts and applies a pressure on the cleansing members, for example, 103, or 119, or 121, while the motion transmission assembly 4820 moves the guide slide plate 4103 with the detachably attached base member 101 in an upward direction and a downward direction.

Figure 50:
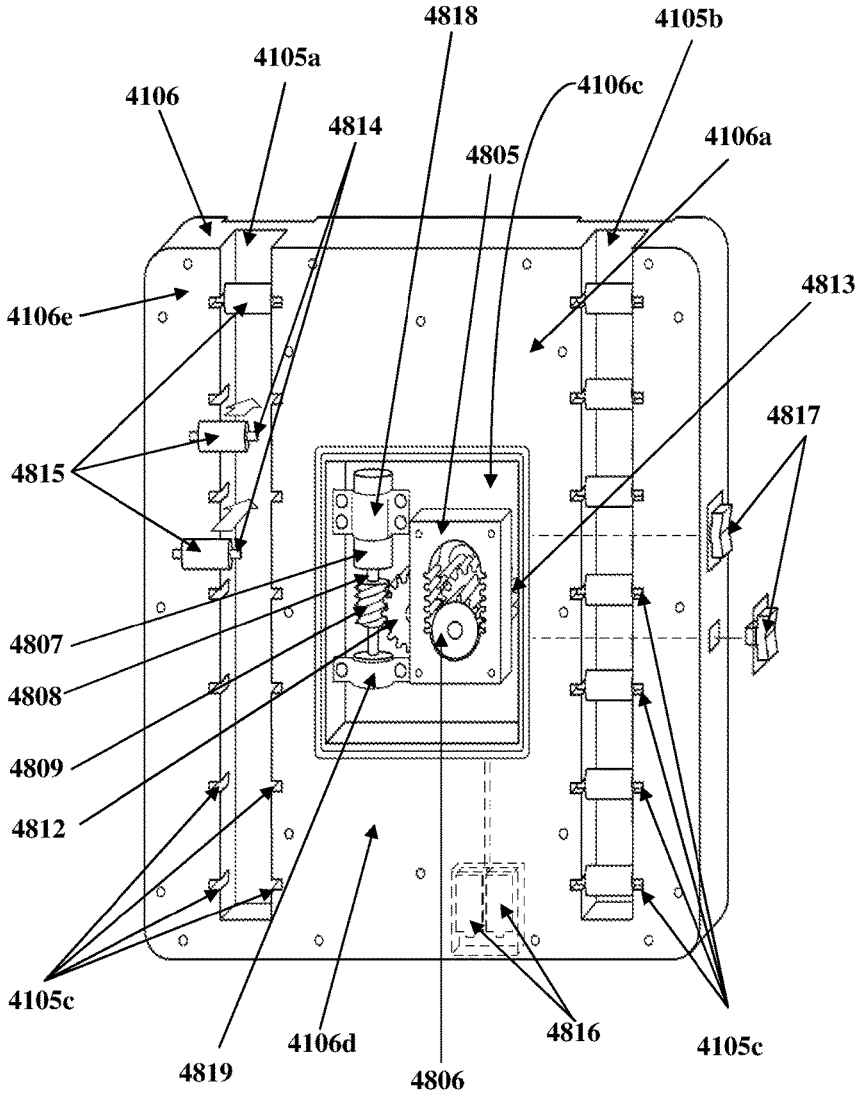
FIG. 50 exemplarily illustrates a front isometric view of a base plate of the motorized body cleansing apparatus shown in FIG. 48.
Figure 51:
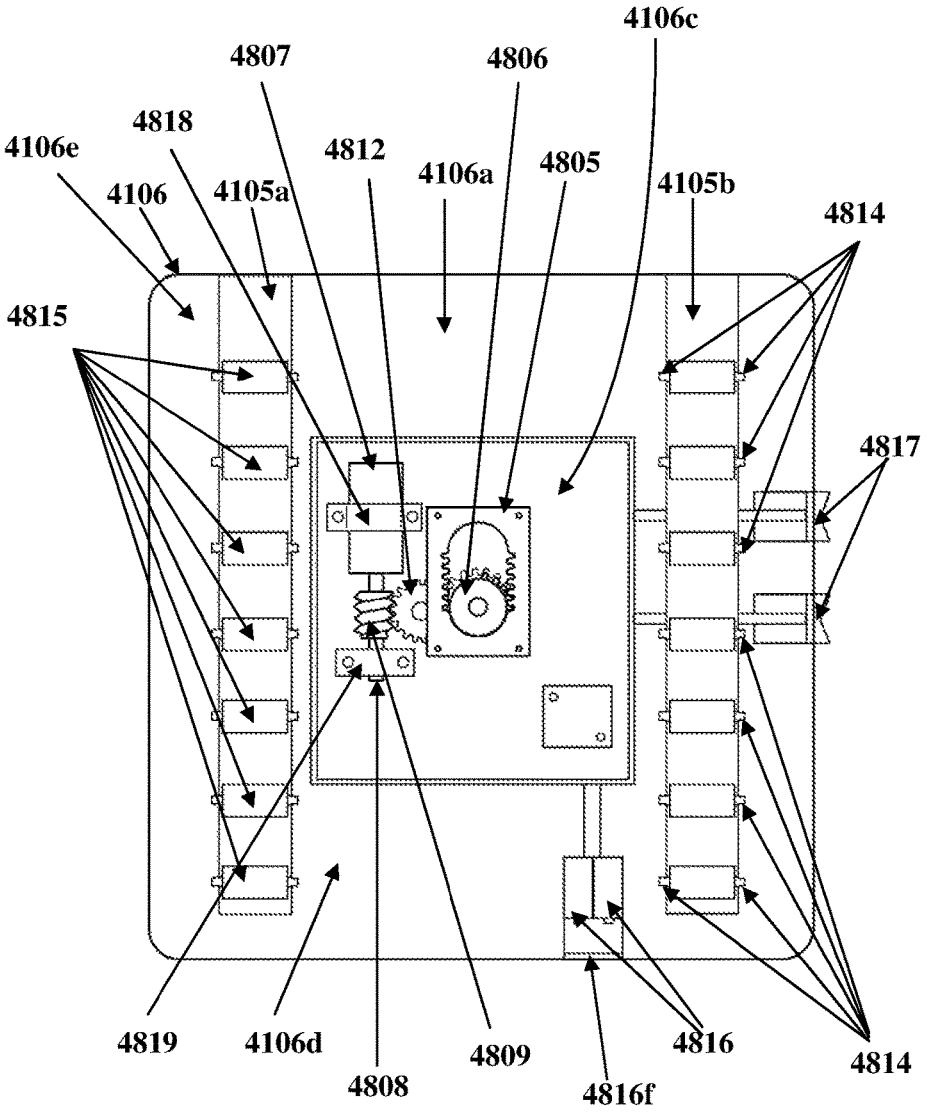
FIG. 51 exemplarily illustrates a front elevation, partial sectional view of the base plate.

FIGS. 50-51 exemplarily illustrate a front isometric view and a front elevation, partial sectional view respectively, of the base plate 4106 of the motorized body cleansing apparatus 100 shown in FIG. 48. As exemplarily illustrated in FIGS. 50-51, the guideways 4105*a* and 4105*b* are shaped in the base plate 4106 for accommodating the rollers 4815. The guideways 4105*a* and 4105*b* of the base plate 4106 comprise multiple grooves 4105*c* spaced at predefined intervals, for example, about 2.5 inches apart from each other. The width of the guideways 4105*a* and 4105*b* together with the grooves 4105*c* is, for example, about 1.6 inches to about 1.7 inches. The grooves 4105*c* are configured to accommodate shafts 4814 of the rollers 4815. The shafts 4814 of the rollers 4815 are, for example, made of aluminum, stainless steel, etc. In an embodiment, the rollers 4815 are coated with a rubber material. The rollers 4815 are positioned in the guideways 4105*a* and 4105*b* of the base plate 4106 as follows. Each roller 4815 is mounted on its shaft 4814. The shafts 4814 along with the rollers 4815 are inserted into the grooves 4105*c* of the guideways 4105*a* and 4105*b* as exemplarily illustrated in FIGS. 50-51. The guide slide plate 4103 of the motorized body cleansing apparatus 100 exemplarily illustrated in FIG. 48, is positioned on the rollers 4815 at the front surface 4106*a* of the base plate 4106. The rollers 4815 are configured to roll within the guideways 4105*a* and 4105*b* of the base plate 4106. When the rollers 4815 roll during movement of the guide slide plate 4103 in an upward direction and a downward direction caused by the motion transmission assembly 4820 exemplarily illustrated in FIGS. 52-54, the shafts 4814 of the rollers 4815 roll in the grooves 4105*c* of the guideways 4105*a* and 4105*b*. The grooves 4105*c* are configured to secure the shafts 4814 with the rollers 4815 in the guideways 4105*a* and 4105*b* of the base plate 4106 during the movement of the guide slide plate 4103.

Figure 52:
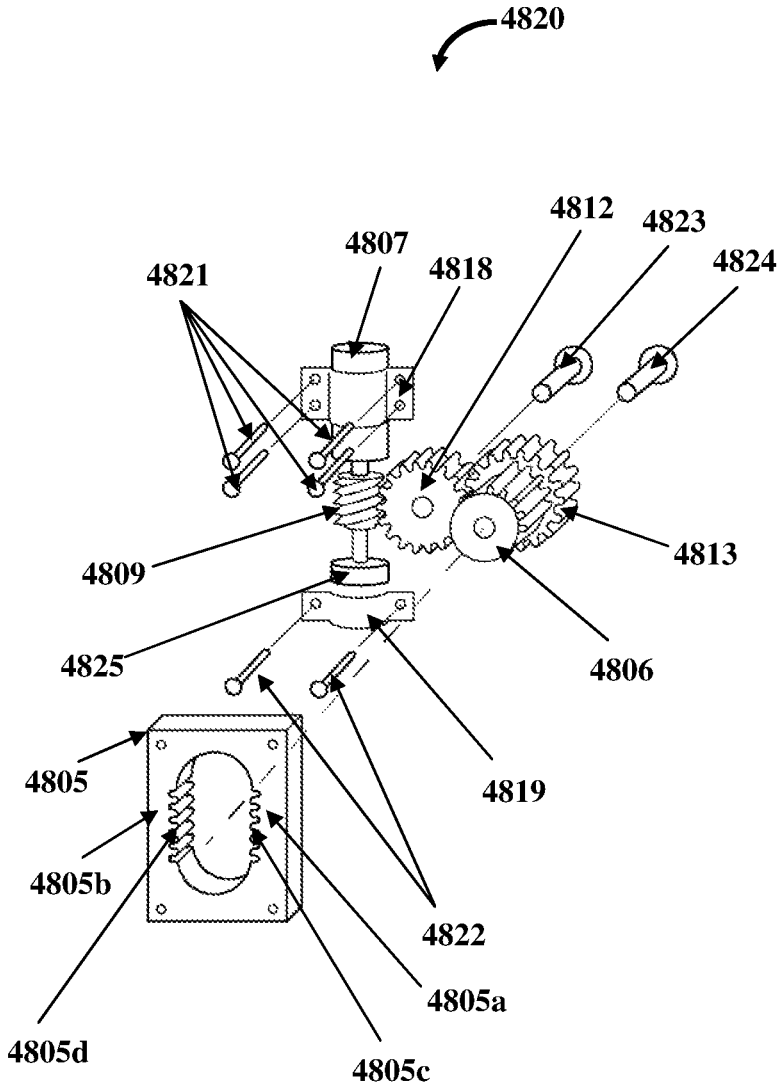
FIG. 52 exemplarily illustrates a front, partial exploded view of a motion transmission assembly of the motorized body cleansing apparatus.
Figure 53:
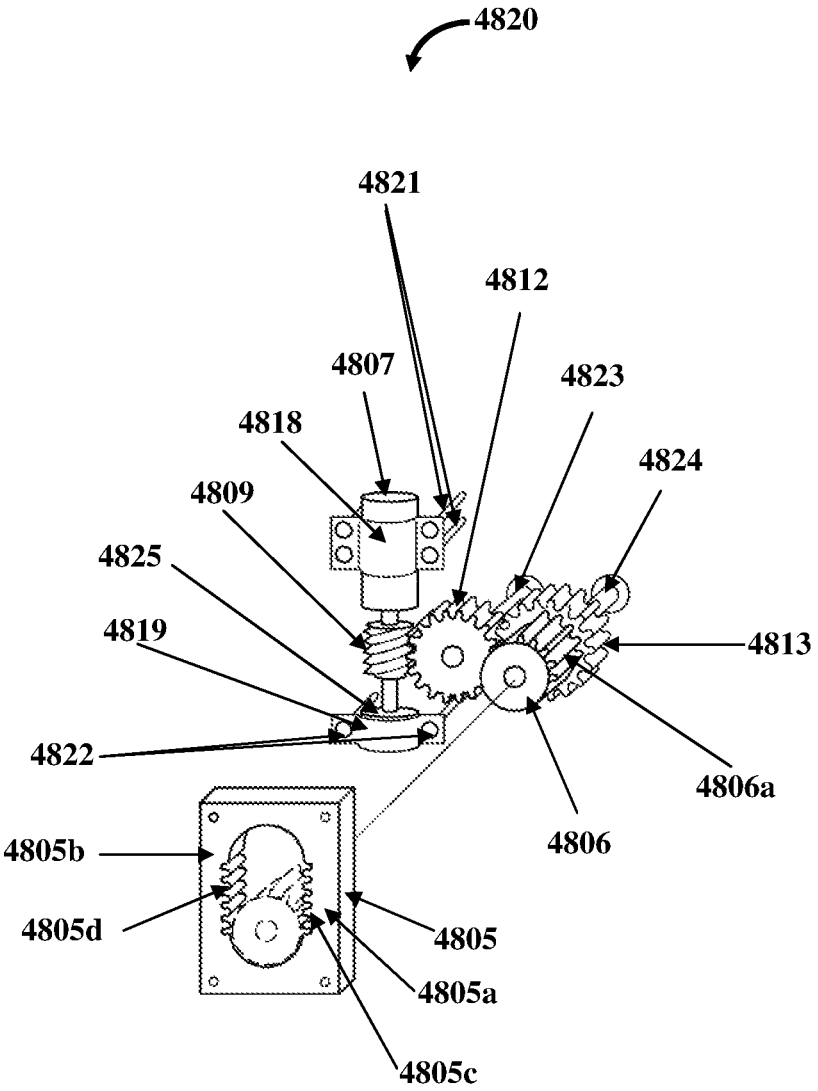
FIG. 53 exemplarily illustrates a front isometric view of the motion transmission assembly, showing alignment of transmission members of the motion transmission assembly.
Figure 54:
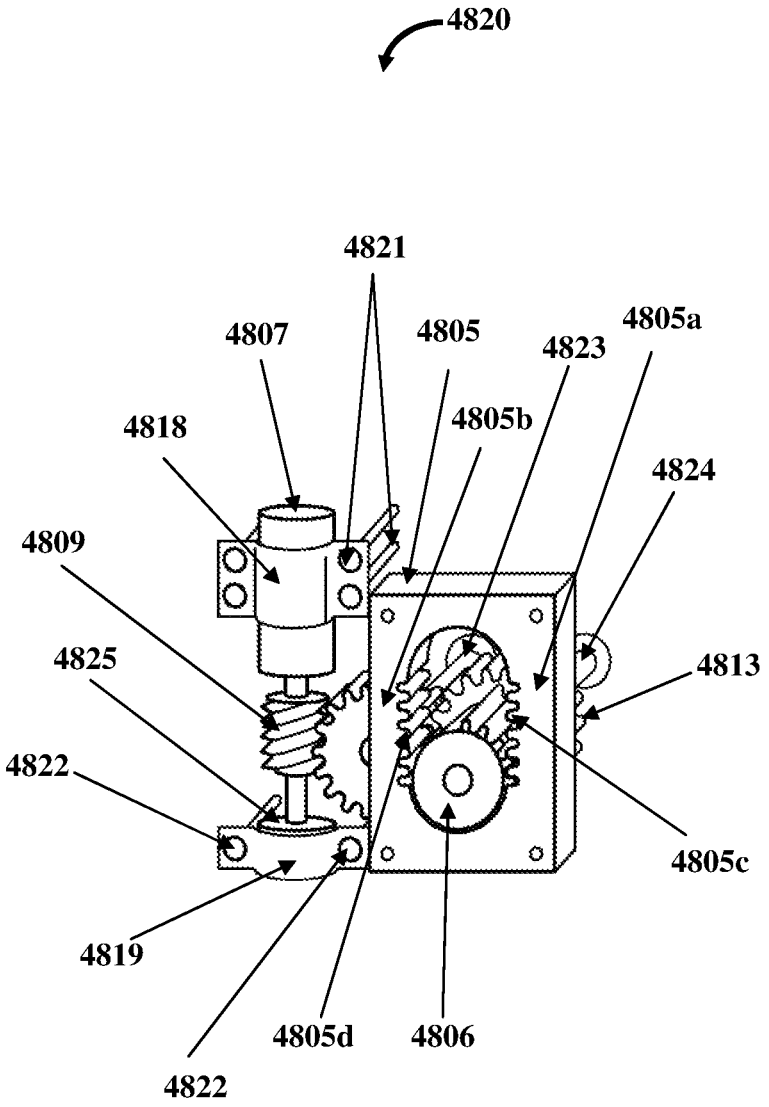
FIG. 54 exemplarily illustrates a front isometric view of the motion transmission, showing engagement of the transmission members of the motion transmission assembly.

The motor 4807, the worm gear 4809, transmission members, for example, 4805, 4806, 4812, 4813, etc., exemplarily illustrated in FIGS. 52-54, of the motion transmission assembly 4820 are positioned in the cavity 4106*c* of the base plate 4106 as exemplarily illustrated in FIGS. 50-51, and are operably coupled to each other to facilitate movement of the guide slide plate 4103 in the upward direction and the downward direction. The motor 4807 is, for example, a high torque 180 revolutions per minute (rpm) direct current (DC) motor. In an embodiment, the motor 4807 is fixedly attached to the cavity 4106*c* of the base plate 4106, for example, using a C shaped bracket 4818. A bearing 4825 is mounted on the motor shaft 4808 and protects the motor 4807 from substantially high loads generated during the operation of the motor 4807. In an embodiment, the bearing 4825 is securely fixed to the motor shaft 4808, for example, using a C shaped bracket 4819. The motorized body cleansing apparatus 100 further comprises switches 4817 positioned on the base plate 4106. The switches 4817 are in electrical communication with a power source 4816 and the motor 4807 of the motion transmission assembly 4820. The switches 4817 are used for activating the motor 4807 to move the guide slide plate 4103 in the upward direction and the downward direction. In an embodiment, the switches 4817 are encased in a rubber material for waterproofing the switches 4817. The switches 4817 are configured to operate the motor 4807 in different modes, for example, on, off, a speed control mode for increasing or decreasing speed of the motor 4807, an audio mode for hands free adjustment, etc. In an embodiment, the switches 4817 are positioned at the bottom of the motorized body cleansing apparatus 100. The power source 4816 comprising, for example, dual 9 volt (V) batteries, is integrated within the base plate 4106 as exemplarily illustrated in dashed lines in FIG. 50. A cap 4106*f* is provided at the bottom of the base plate 4106 as exemplarily illustrated in FIG. 51, to cover and protect the power source 4816 from moisture.

FIG. 52 exemplarily illustrates a front, partial exploded view of the motion transmission assembly 4820 of the motorized body cleansing apparatus 100. The motion transmission assembly 4820 is positioned in the cavity 4106*c* of the base plate 4106 as exemplarily illustrated in FIGS. 50-51, and operably coupled to the guide slide plate 4103 as exemplarily illustrated in FIGS. 48-49. The motion transmission assembly 4820 moves the guide slide plate 4103 in an upward direction and a downward direction over the rollers 4815 exemplarily illustrated in FIGS. 50-51. As exemplarily illustrated in FIG. 52, the motion transmission assembly 4820 comprises the motor 4807, the worm gear 4809, a first transmission member 4812, a second transmission member 4813, a third transmission member 4806, and a fourth transmission member 4805. The motor 4807 of the motion transmission assembly 4820 is fixedly attached in the cavity 4106*c* of the base plate 4106 as exemplarily illustrated in FIGS. 50-51. The C shaped bracket 4818 and fasteners 4821, for example, screws, fixedly attach the motor 4807 to the cavity 4106*c* of the base plate 4106. The bearing 4825 is mounted on the motor shaft 4808 for protecting the motor 4807 from substantially high loads generated during the operation of the motor 4807. The C shaped bracket 4819 and fasteners 4822, for example, screws, securely fix the bearing 4825 to the motor shaft 4808.

The worm gear 4809 of the motion transmission assembly 4820 is mounted on the motor shaft 4808. A first shaft 4823 is fixedly attached in and extends outwardly from the cavity 4106*c* of the base plate 4106. A second shaft 4824 is rotatably attached in and extends outwardly from the cavity 4106*c* of the base plate 4106, for example, via bearings. In an embodiment, the first shaft 4823 and the second shaft 4824 are provided with bushes (not shown) to prevent the first shaft 4823 and the second shaft 4824 from wear and tear. The first transmission member 4812, for example, a pinion gear, a bevel gear, etc., is mounted on the first shaft 4823 in the cavity 4106*c* of the base plate 4106. The first transmission member 4812 operably engages with the worm gear 4809. The second transmission member 4813 is mounted on the second shaft 4824 in the cavity 4106*c* of the base plate 4106. The second transmission member 4813 operably engages with the first transmission member 4812. The third transmission member 4806 is positioned in front of the second transmission member 4813 and is mounted on the second shaft 4824 extending outwardly from the cavity 4106*c* of the base plate 4106. In an embodiment, the second transmission member 4813 and the third transmission member 4806 constitute a compound gear mounted on the common second shaft 4824.

The third transmission member 4806 engages with the fourth transmission member 4805 that is fixedly attached to the rear surface 4103*b* of the guide slide plate 4103 using the fasteners 4804 exemplarily illustrated in FIGS. 48-49. The fourth transmission member 4805 is configured, for example, as a rectangular inverted gear block. The width of the fourth transmission member 4805 is, for example, about 3.4 inches to about 3.6 inches. The thickness of the fourth transmission member 4805 is, for example, about 0.15 inch to about 0.85 inches. The fourth transmission member 4805 comprises gear teeth 4805*c* and 4805*d* defined on a right inner side 4805*a* and a left inner side 4805*b* of the fourth transmission member 4805 respectively.

FIGS. 53-54 exemplarily illustrate front isometric views of the motion transmission assembly 4820, showing alignment and engagement of the transmission members, for example, 4805, 4806, 4812, and 4813 of the motion transmission assembly 4820. The third transmission member 4806 is aligned with the fourth transmission member 4805 of the motion transmission assembly 4820 as exemplarily illustrated in FIG. 53. Gear teeth 4806*a* of the third transmission member 4806 engage with the gear teeth 4805*c* on the right inner side 4805*a* of the fourth transmission member 4805 as exemplarily illustrated in FIG. 54, and with the gear teeth 4805*d* on the left inner side 4805*b* of the fourth transmission member 4805 alternately to move the guide slide plate 4103 with the base member 101 exemplarily illustrated in FIGS. 48-49, in the upward direction and the downward direction. The third transmission member 4806 is held within the fourth transmission member 4805 to allow the third transmission member 4806 to pass alternately from the right inner side 4805*a* of the fourth transmission member 4805 to the left inner side 4805*b* of the fourth transmission member 4805, thereby moving the fourth transmission member 4805 in an upward direction or a downward direction according to the side 4805*a* or 4805*b* to which the gear teeth 4806*a* of the third transmission member 4806 engages. The fourth transmission member 4805 along with the guide slide plate 4103 is configured to move in the upward direction and the downward direction by transmission of motion from the motor 4807 to the fourth transmission member 4805 via the first transmission member 4812, the second transmission member 4813, and the third transmission member 4806.

When the motor 4807 is activated by the switches 4817 exemplarily illustrated in FIGS. 50-51, the motor shaft 4808 rotates and transmits a torque to the first transmission member 4812 through the worm gear 4809 mounted on the motor shaft 4808. The first transmission member 4812 starts rotating as a result of the torque transmitted by the motor 4807 through the worm gear 4809. The first transmission member 4812 operably engages with the second transmission member 4813, thereby transmitting the torque received from the motor 4807 through the worm gear 4809 to the second transmission member 4813. The second transmission member 4813 simultaneously transmits the received torque to the second shaft 4824 and the third transmission member 4806 resulting in the rotation of the second shaft 4824 and the third transmission member 4806. The third transmission member 4806 operably engages with the fourth transmission member 4805, thereby transmitting the received torque from the second transmission member 4813, to the fourth transmission member 4805 that is fixedly attached to the rear surface 4103*b* of the guide slide plate 4103. The torque transmitted to the fourth transmission member 4805 moves the guide slide plate 4103 in the upward direction and the downward direction, since the fourth transmission member 4805 is fixedly attached to the rear surface 4103*b* of the guide slide plate 4103.

Figure 55A:
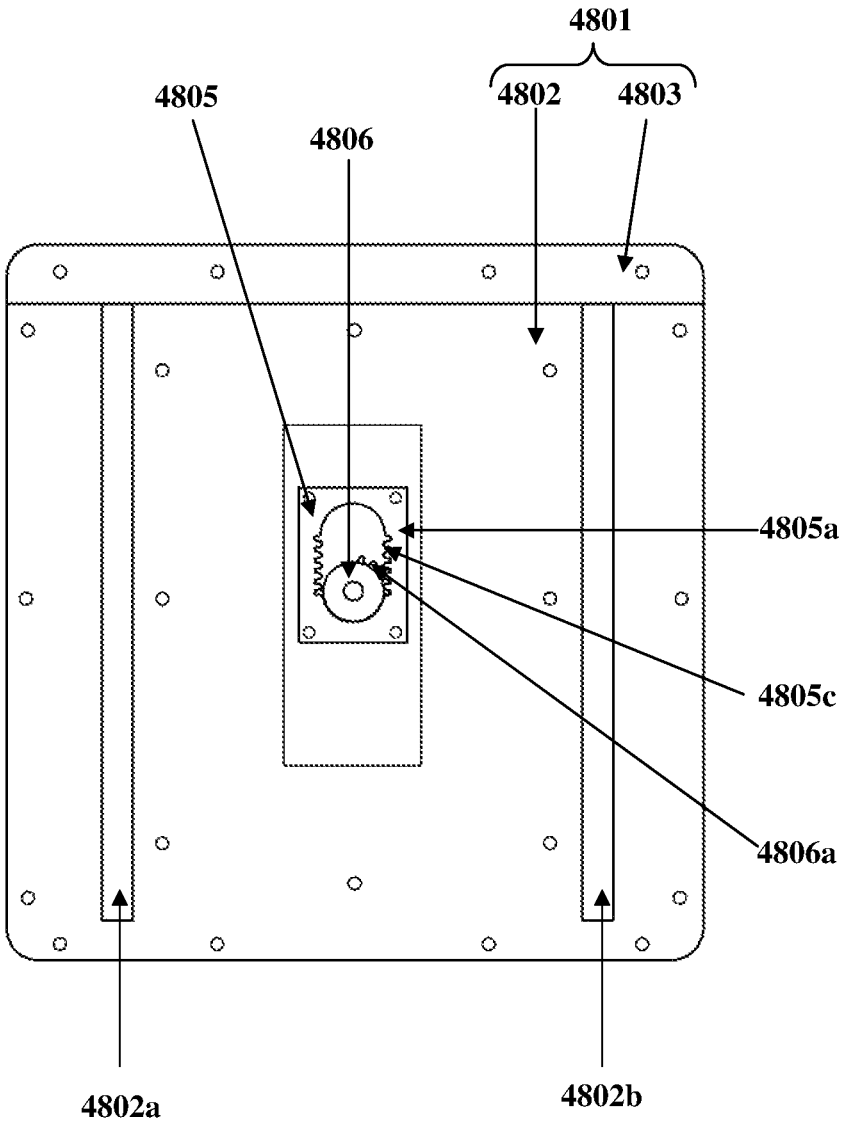
FIG. 55A exemplarily illustrates a front elevation view of a split cover plate of the motorized body cleansing apparatus shown in FIG. 48, when a guide slide plate of the motorized body cleansing apparatus positioned in front of the split cover plate is in an upward position.

FIG. 55A exemplarily illustrates a front elevation view of the split cover plate 4801 of the motorized body cleansing apparatus 100 shown in FIG. 48, when the guide slide plate 4103 of the motorized body cleansing apparatus 100 exemplarily illustrated in FIGS. 48-49, positioned in front of the split cover plate 4801 is in an upward position. The continuous rotation of the third transmission member 4806 of the motion transmission assembly 4820 exemplarily illustrated in FIGS. 52-54, results in a reciprocating motion of the fourth transmission member 4805 in an upward direction and a downward direction as disclosed in the detailed description of the FIGS. 53-54. The movement of the fourth transmission member 4805 causes the movement of the guide slide plate 4103 in the upward direction and the downward direction. When the guide slide plate 4103 is in the upward position as exemplarily illustrated in FIG. 55A, the gear teeth 4806*a* of the third transmission member 4806 engage with the gear teeth 4805*c* on the right inner side 4805*a* of the fourth transmission member 4805. When the third transmission member 4806 rotates, for example, in a clockwise direction as exemplarily illustrated in FIG. 55A, the third transmission member 4806 applies a torque on the gear teeth 4805*c* on the right inner side 4805*a* of the fourth transmission member 4805, resulting in the movement of the fourth transmission member 4805 in the downward direction, thereby moving the guide slide plate 4103 in the downward direction.

Figure 55B:
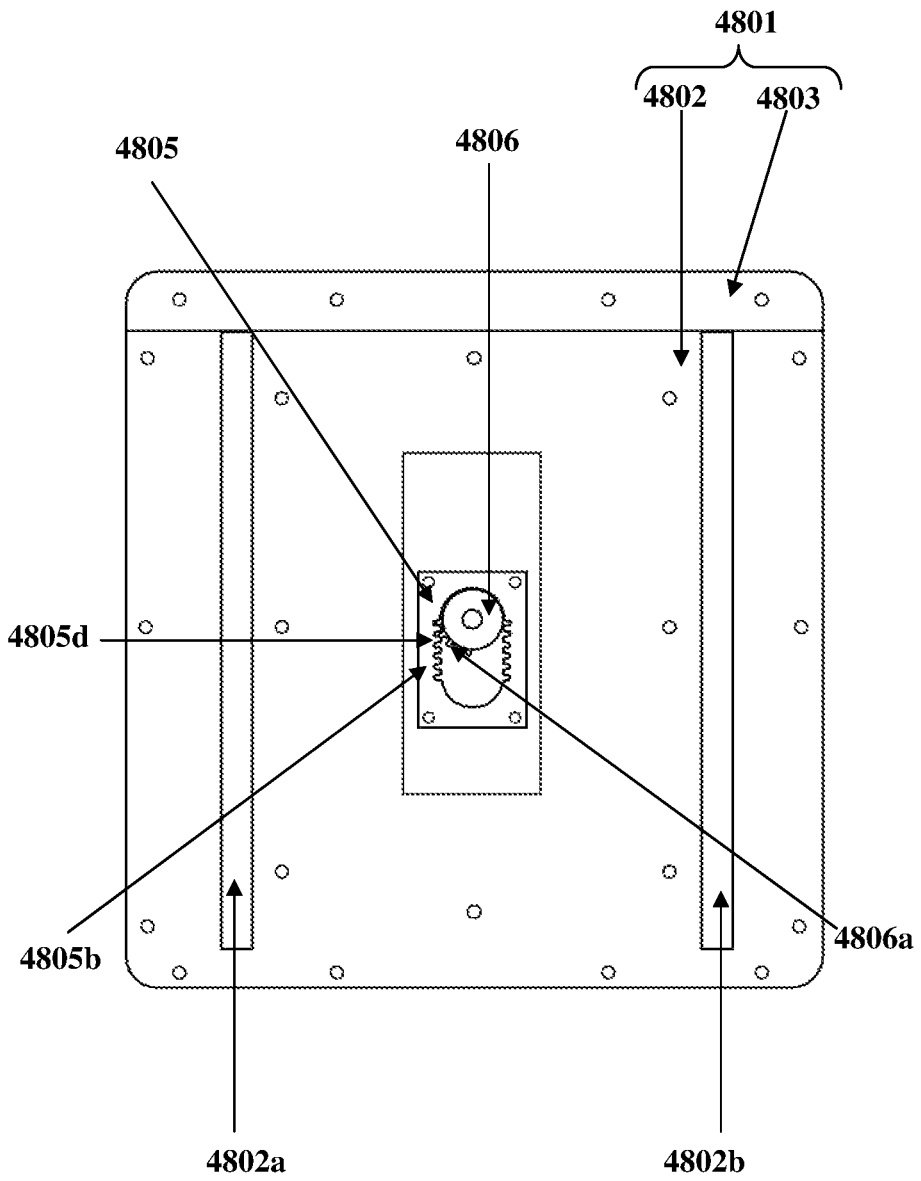
FIG. 55B exemplarily illustrates a front elevation view of the split cover plate when the guide slide plate positioned in front of the split cover plate is in a downward position.

FIG. 55B exemplarily illustrates a front elevation view of the split cover plate 4801 when the guide slide plate 4103 exemplarily illustrated in FIGS. 48-49, positioned in front of the split cover plate 4801 is in a downward position. When the guide slide plate 4103 is in the downward position as exemplarily illustrated in FIG. 55B, the gear teeth 4806*a* of the third transmission member 4806 engages with the gear teeth 4805*d* on the left inner side 4805*b* of the fourth transmission member 4805. When the third transmission member 4806 rotates, for example, in the clockwise direction as exemplarily illustrate in FIG. 55B, the third transmission member 4806 applies a torque on the gear teeth 4805*d* on the left inner side 4805*b* of the fourth transmission member 4805, resulting in the movement of the fourth transmission member 4805 in the upward direction, thereby moving the guide slide plate 4103 in the upward direction.

Figure 56:
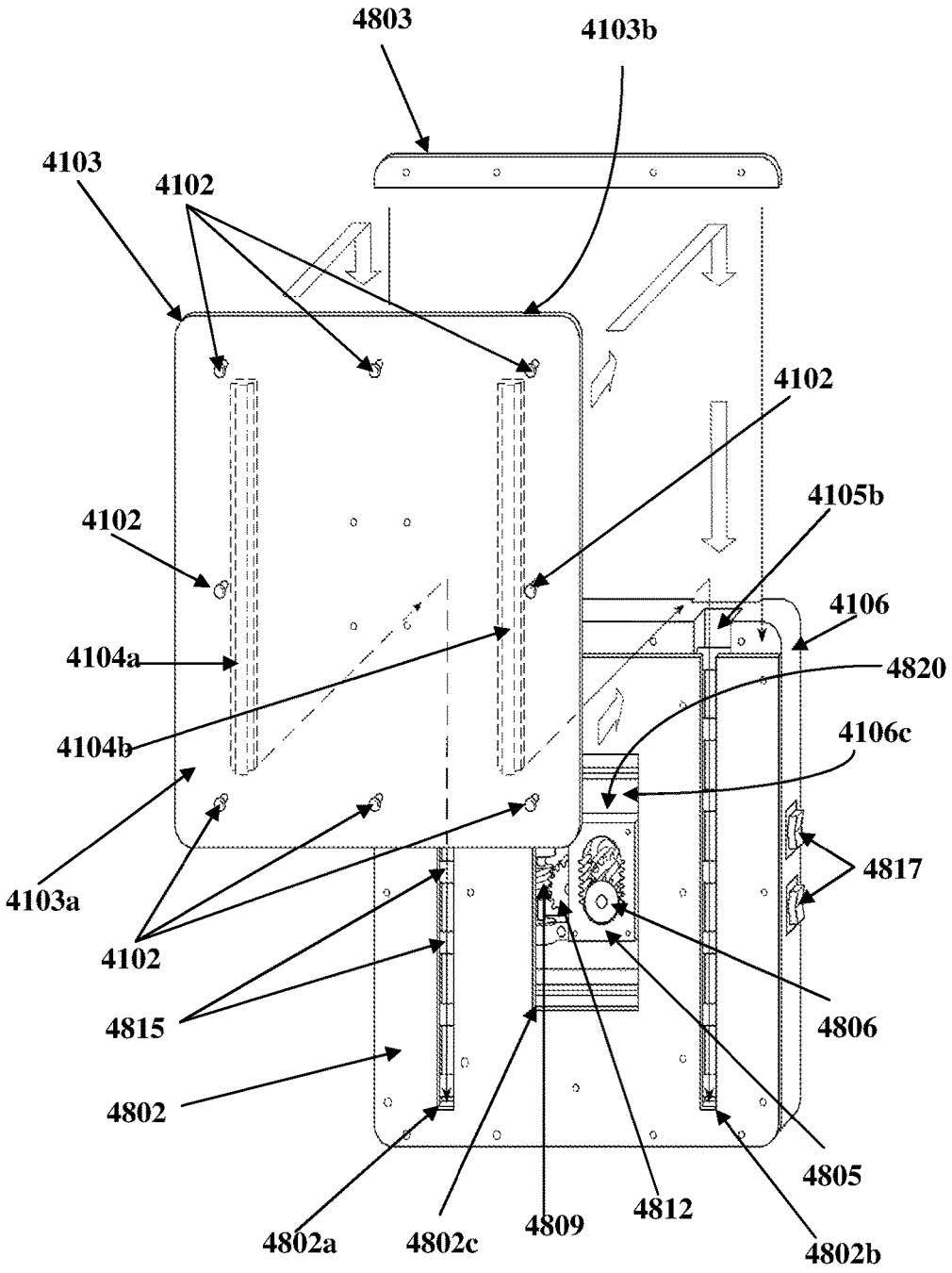
FIG. 56 exemplarily illustrates a front perspective, partial dissembled view, showing positioning of elongate guide projections of the guide slide plate in vertical slots of a securing element of the split cover plate.

FIG. 56 exemplarily illustrates a front perspective, partial dissembled view, showing positioning of the elongate guide projections 4104*a* and 4104*b* of the guide slide plate 4103 in the vertical slots 4802*a* and 4802*b* of the securing element 4802 of the split cover plate 4801. After the motion transmission assembly 4820 is fixed in the cavity 4106*c* of the base plate 4106, the securing element 4802 of the split cover plate 4801 is fixedly attached to the base plate 4106. The elongate guide projections 4104*a* and 4104*b* of the guide slide plate 4103 are inserted into the vertical slots 4802*a* and 4802*b* of the securing element 4802. The cap element 4803 of the split cover plate 4801 is fixed to the base plate 4106 after positioning the guide slide plate 4103 in the vertical slots 4802*a* and 4802*b* of the securing element 4802 to preclude sliding of the guide slide plate 4103 from the base plate 4106. The elongate guide projections 4104*a* and 4104*b* of the guide slide plate 4103 slide on the rollers 4815 positioned in the guideways 4105*a* and 4105*b* of the base plate 4106 exemplarily illustrated in FIGS. 50-51.

Figure 57:
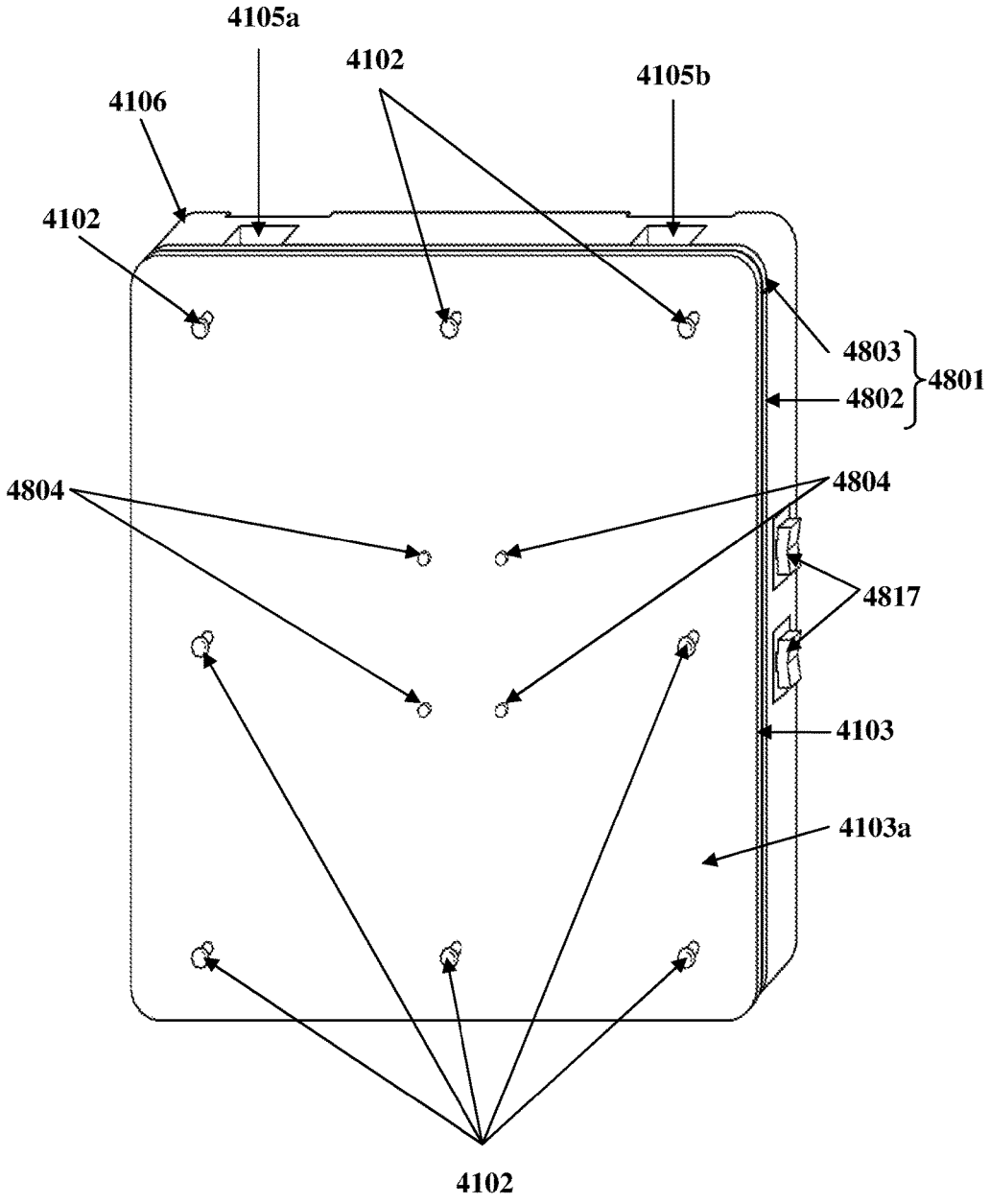
FIG. 57 exemplarily illustrates a front isometric view of the guide slide plate secured to the base plate via the split cover plate.

FIG. 57 exemplarily illustrates front isometric view of the guide slide plate 4103 secured to the base plate 4106 via the split cover plate 4801. The front surface 4103*a* of the guide slide plate 4103 is provided with the fasteners 4102 configured to engage with the fasteners 4101 provided on the rear surface 101*d* of the base member 101 exemplarily illustrated in FIG. 48.

Figure 58:
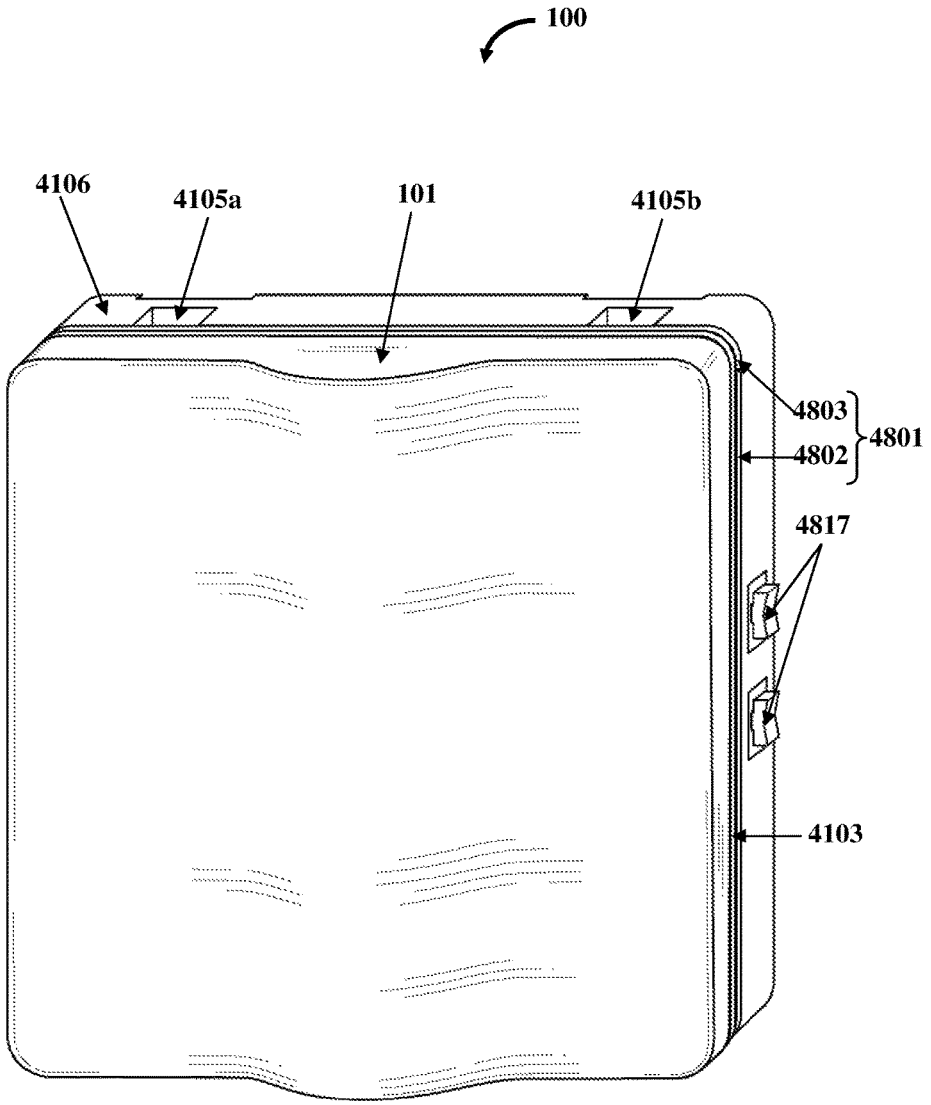
FIG. 58 exemplarily illustrates a front isometric view of the motorized body cleansing apparatus, showing the base member attached to the guide slide plate.

FIG. 58 exemplarily illustrates a front isometric view of the motorized body cleansing apparatus 100, showing the base member 101 attached to the guide slide plate 4103. The base member 101 is detachably attached to the guide slide plate 4103 by engagement of the fasteners 4101 positioned on the rear surface 101*d* of the base member 101 exemplarily illustrated in FIG. 48, with the fasteners 4102 positioned on the front surface 4103*a* of the guide slide plate 4103 exemplarily illustrated in FIG. 57.

Figure 59A:
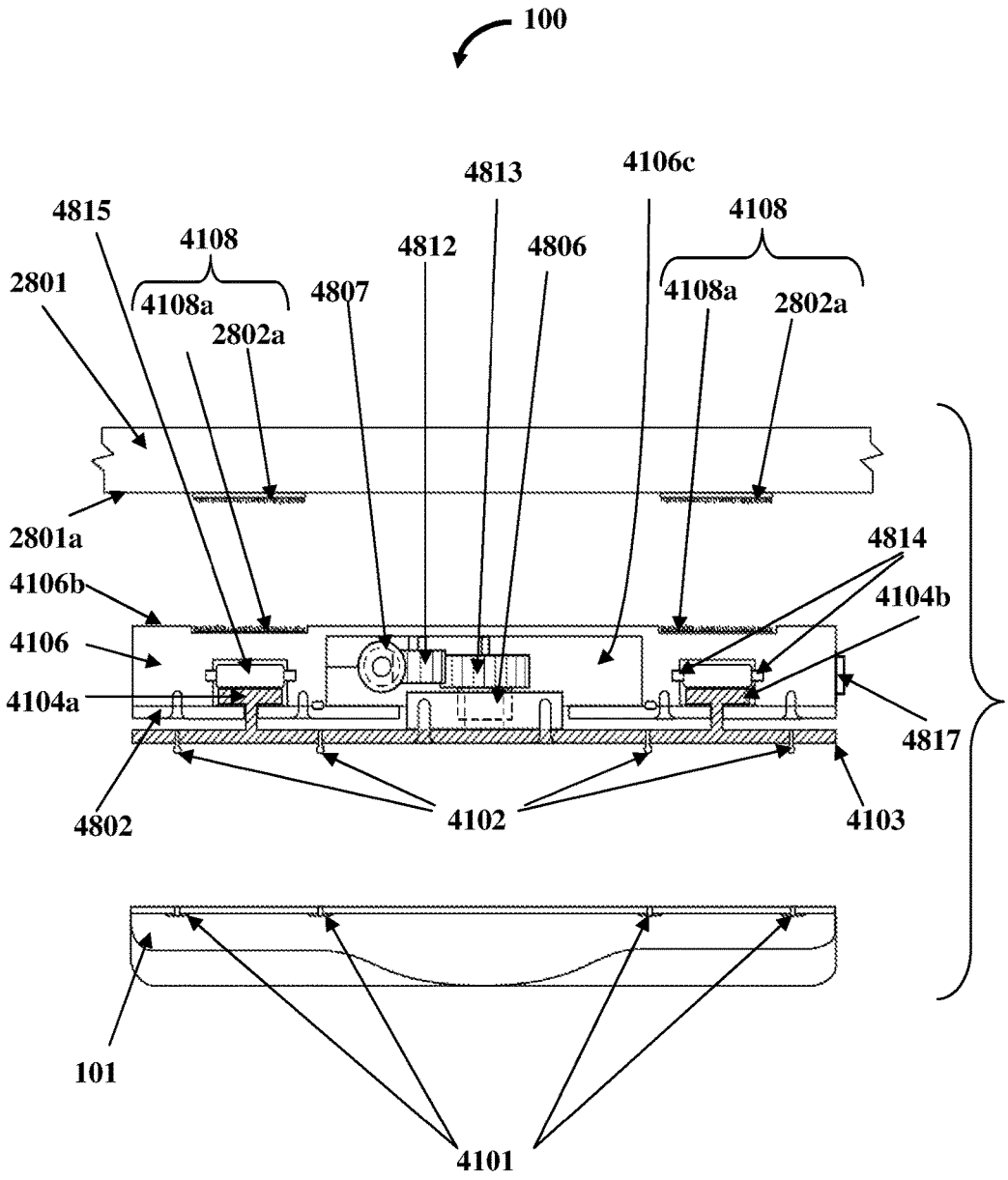
FIG. 59A exemplarily illustrates a top plan, partial disassembled view of the motorized body cleansing apparatus detachably attachable to a support structure.

FIG. 59A exemplarily illustrates a top plan, partial disassembled view of the motorized body cleansing apparatus 100 detachably attachable to a support structure 2801, for example, a wall. The fasteners, for example, hook and loop fasteners 4108 are positioned on the front surface 2801*a* of the support structure 2801 and the rear surface 4106*b* of the base plate 4106 for allowing detachable attachment of the motorized body cleansing apparatus 100 to the support structure 2801. In an example, the hook sides 2802*a* of the hook and loop fasteners 4108 positioned on the front surface 2801*a* of the support structure 2801 are configured to engage with the loop sides 4108*a* of the hook and loop fasteners 4108 positioned on the rear surface 4106*b* of the base plate 4106.

Figure 59B:
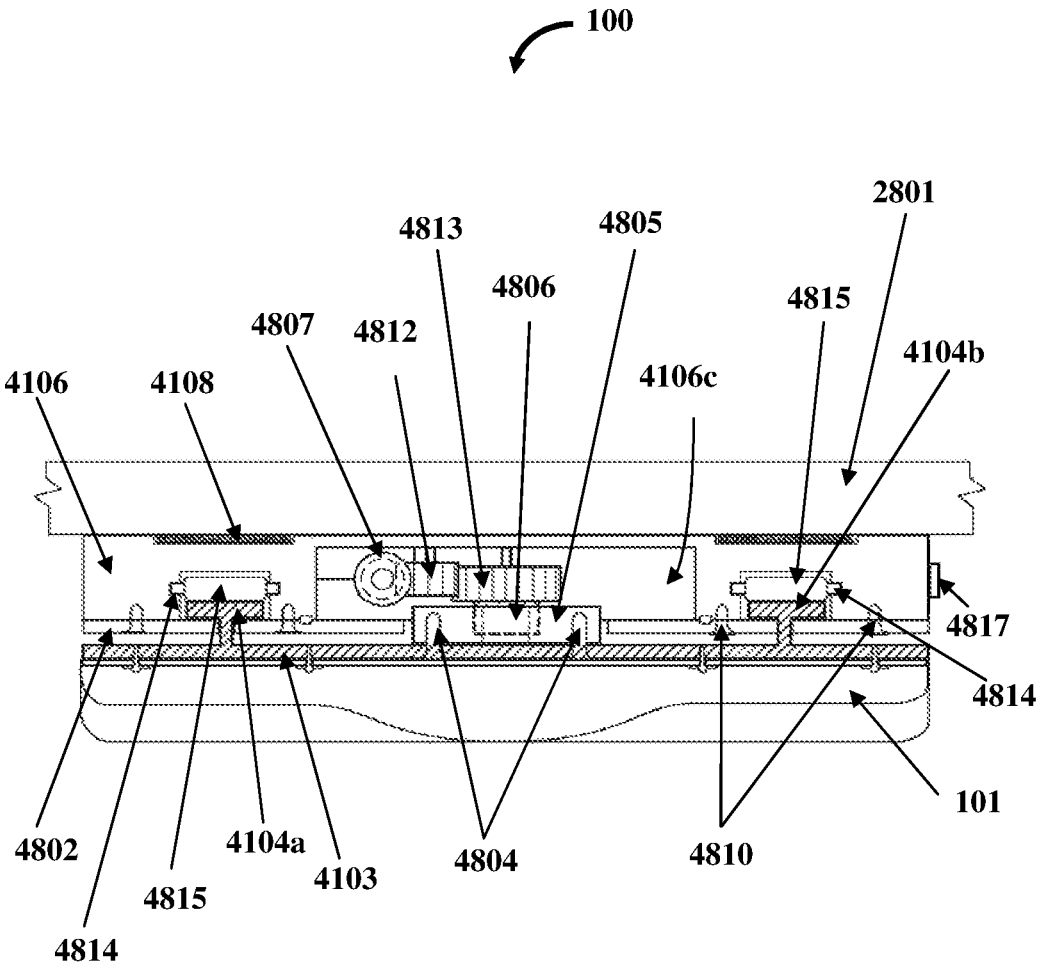
FIG. 59B exemplarily illustrates a top plan view of the assembled motorized body cleansing apparatus detachably attached to the support structure.

FIG. 59B exemplarily illustrates top plan view of the assembled motorized body cleansing apparatus 100 detachably attached to the support structure 2801. The base plate 4106 of the motorized body cleansing apparatus 100 is detachably attached to the support structure 2801 using the fasteners, for example, the hook and loop fasteners 4108 as disclosed in the detailed description of FIG. 41.

Figure 60A:
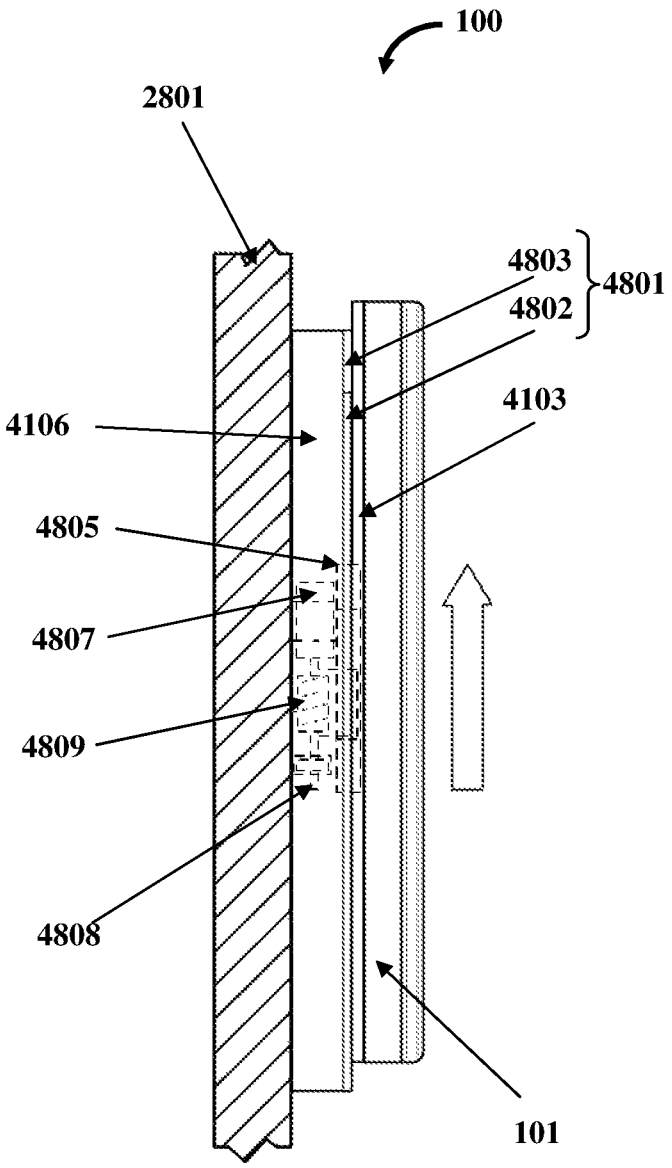
FIG. 60A exemplarily illustrates a left side elevation view of the motorized body cleansing apparatus, showing movement of the guide slide plate with the base member in an upward direction.

FIG. 60A exemplarily illustrates a left side elevation view of the motorized body cleansing apparatus 100, showing movement of the guide slide plate 4103 with the base member 101 in an upward direction. The third transmission member 4806 of the motion transmission assembly 4820 exemplarily illustrated in FIGS. 52-54, engages with the fourth transmission member 4805 to move the guide slide plate 4103 in the upward direction as disclosed in the detailed description of the FIG. 55B. When the motor 4807 is activated or powered on, the motor 4807 transmits the torque to the fourth transmission member 4805 through the first transmission member 4812, the second transmission member 4813, and the third transmission member 4806 as disclosed in the detailed description of the FIGS. 53-54. The third transmission member 4806 applies the torque on the fourth transmission member 4805. The torque results in the movement of the fourth transmission member 4805, since the upward movement of the third transmission member 4806 is constrained by the second shaft 4824 exemplarily illustrated in FIGS. 52-54. The second shaft 4824 on which the third transmission member 4806 is mounted only rolls and cannot move in the upward direction.

Figure 60B:
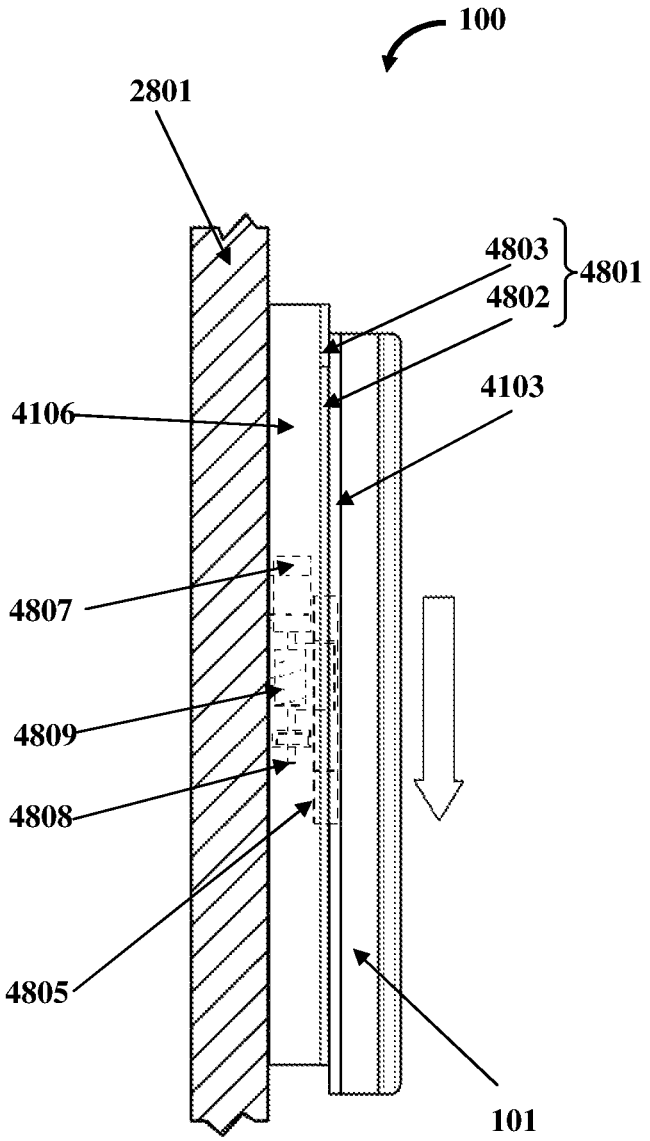
FIG. 60B exemplarily illustrates a left side elevation view of the motorized body cleansing apparatus, showing movement of the guide slide plate with the base member in a downward direction.

FIG. 60B exemplarily illustrates a left side elevation view of the motorized body cleansing apparatus 100, showing movement of the guide slide plate 4103 with the base member 101 in a downward direction. The third transmission member 4806 of the motion transmission assembly 4820 exemplarily illustrated in FIGS. 52-54, engages with the fourth transmission member 4805 to move the guide slide plate 4103 in the downward direction as disclosed in the detailed description of the FIG. 55A.

The foregoing examples have been provided merely for the purpose of explanation and are in no way to be construed as limiting of the body cleaning apparatus 100 and the methods disclosed herein. While the body cleaning apparatus 100 and the methods have been described with reference to various embodiments, it is understood that the words, which have been used herein, are words of description and illustration, rather than words of limitation. Furthermore, although the body cleaning apparatus 100 and the methods have been described herein with reference to particular means, materials, and embodiments, the body cleaning apparatus 100 and the methods are not intended to be limited to the particulars disclosed herein; rather, the body cleaning apparatus 100 and the methods extend to all functionally equivalent structures, methods and uses, such as are within the scope of the appended claims. Those skilled in the art, having the benefit of the teachings of this specification, may effect numerous modifications thereto and changes may be made without departing from the scope and spirit of the body cleaning apparatus 100 and the methods disclosed herein in their aspects.

I claim:

1. A motorized body cleansing apparatus comprising:

a base plate comprising a front surface and a rear surface, the rear surface of the base plate detachably attached to a support structure using first fasteners, the base plate comprising guideways positioned on the front surface of the base plate, the base plate further comprising a cavity configured between the guideways on the front surface of the base plate;

a plurality of rollers positioned in the guideways of the base plate, the rollers configured to roll within the guideways of the base plate;

a guide slide plate positioned on the rollers at the front surface of the base plate, the guide slide plate comprising elongate guide projections extending from a rear surface of the guide slide plate, the elongate guide projections of the guide slide plate configured to slide on the rollers at the front surface of the base plate;

a split cover plate positioned between the base plate and the guide slide plate, the split cover plate comprising:

a securing element fixedly attached to a body section of the base plate, the securing element comprising vertical slots configured to accommodate the elongate guide projections of the guide slide plate; and a cap element fixedly attached to an upper section of the base plate, the cap element configured to secure the guide slide plate to the base plate to preclude the guide slide plate from sliding out of the base plate;

a motion transmission assembly positioned in the cavity of the base plate and operably coupled to the guide slide plate, the motion transmission assembly configured to move the guide slide plate in an upward direction and a downward direction over the rollers; and a base member detachably attached to a front surface of the guide slide plate using second fasteners, the base member configured with one or more contoured profiles to conform to a body part of a user, the base member comprising one or more cleansing members attached to a front surface of the base member for cleansing the body part when the body part contacts and applies a pressure on the one or more cleansing members, while the motion transmission assembly moves the guide slide plate with the detachably attached base member in the upward direction and the downward direction.

2. The motorized body cleansing apparatus of claim 1, wherein the motion transmission assembly comprises:

a motor fixedly attached in the cavity of the base plate;

a worm gear mounted on a motor shaft of the motor;

a first transmission member mounted on a first shaft fixedly attached in and extending outwardly from the cavity of the base plate, the first transmission member configured to operably engage with the worm gear;

a second transmission member mounted on a second shaft rotatably attached in and extending outwardly from the cavity of the base plate, the second transmission member configured to operably engage with the first transmission member; and a third transmission member positioned in front of the second transmission member and mounted on the second shaft extending outwardly from the cavity of the base plate, the third transmission member configured to engage with a fourth transmission member fixedly attached to the rear surface of the guide slide plate, wherein the fourth transmission member along with the guide slide plate is configured to move in the upward direction and the downward direction by transmission of motion from the motor to the fourth transmission member via the first transmission member, the second transmission member, and the third transmission member.

3. The motorized body cleansing apparatus of claim 2, further comprising at least one switch positioned on the base plate, wherein the at least one switch is in electrical communication with the motor of the motion transmission assembly for activating the motor.

4. The motorized body cleansing apparatus of claim 1, wherein the first fasteners are hook and loop fasteners comprising hook sides and loop sides, wherein one of the hook sides and the loop sides are attached to the rear surface of the base plate, and wherein an opposing one of the hook sides and the loop sides are attached to a front surface of the support structure for allowing a detachable attachment of the motorized body cleansing apparatus to the support structure.

5. The motorized body cleansing apparatus of claim 4, wherein the opposing one of the hook sides and the loop sides of the hook and loop fasteners are configured on one or more strips affixed on the front surface of the support structure.

6. The motorized body cleansing apparatus of claim 5, wherein the one or more strips further comprise opposing loop extensions positioned at opposing ends of the one or more strips, wherein the opposing loop extensions are configured to facilitate removal of the one of the hook sides and the loop sides of the hook and loop fasteners attached to the rear surface of the base plate from the opposing one of the hook sides and the loop sides of the hook and loop fasteners attached to the front surface of the support structure.

7. The motorized body cleansing apparatus of claim 1, wherein the base member is configured as a membrane attached to a rear surface of the one or more cleansing members, wherein the membrane comprises drainage openings for draining fluids passing through the one or more cleansing members.

8. The motorized body cleansing apparatus of claim 7, wherein the retention member is made of a sponge material.

9. The motorized body cleansing apparatus of claim 1, wherein the one or more cleansing members comprise a retention member attached to the front surface of the base member, wherein the retention member is configured to retain a cleansing agent dispensed on the retention member, and wherein the retention member comprises a plurality of cavities configured to accommodate a plurality of flexible bristles, and wherein the flexible bristles are fixedly attached to the front surface of the base member and positioned within the cavities of the retention member, and wherein the flexible bristles and the retention member are configured to cleanse the body part when the body part contacts and applies the pressure on the flexible bristles and the retention member.

10. The motorized body cleansing apparatus of claim 1, wherein each of the one or more cleansing members comprises:

a stem attached to and extending outwardly from the front surface of the base member;

a cluster of flexible bristles, the flexible bristles curvedly branching outwards from an upper end of the stem; and a retention member detachably attached to one or more of the flexible bristles, the retention member configured to retain a cleansing agent dispensed on the retention member and cleanse the body part, when the body part contacts and applies the pressure on the one or more of the flexible bristles with the retention member.

11. The motorized body cleansing apparatus of claim 10, wherein the one or more of the flexible bristles curvedly branching outwards from the upper end of the stem defines a reservoir within the cluster, wherein the reservoir is configured to store and retain the cleansing agent and release the cleansing agent along the flexible bristles when the body part contacts and applies the pressure on the stem.

12. The motorized body cleansing apparatus of claim 10, wherein the retention member is detachably attached to a tip of each of the one or more of the flexible bristles, and wherein the retention member is configured to retain the cleansing agent proximal to the tip of the each of the one or more of the flexible bristles and cleanse the body part, when the body part contacts and applies the pressure on the one or more of the flexible bristles.

13. The motorized body cleansing apparatus of claim 10, wherein the cluster of the flexible bristles comprises one or more central flexible bristles extending from the upper end of the stem of the each of the one or more of the cleansing members, and radial flexible bristles surrounding the one or more central flexible bristles, wherein each of the radial flexible bristles curvedly branch outwards from the upper end of the stem to define a substantially spherical space above the upper end of the stem, wherein the substantially spherical space is configured to receive the retention member.

14. The motorized body cleansing apparatus of claim 13, wherein the retention member comprises one or more cavities configured to receive the one or more central flexible bristles when the retention member is inserted into the substantially spherical space defined by the radial flexible bristles.

15. The motorized body cleansing apparatus of claim 14, wherein the one or more central flexible bristles are configured to be exposed through the one or more cavities of the retention member to scrub the body part after the retention member collapses under a substantial increase in the pressure from the body part on the retention member.

* * * * *